US008849163B2

(12) United States Patent
Ikeguchi et al.

(10) Patent No.: US 8,849,163 B2
(45) Date of Patent: Sep. 30, 2014

(54) POWDER CONVEYING APPARATUS, IMAGE FORMING APPARATUS, AND POWDER CONTAINER

(75) Inventors: Hiroshi Ikeguchi, Kanagawa (JP); Shunji Katoh, Kanagawa (JP); Keiichi Yoshida, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 121 days.

(21) Appl. No.: 13/344,259

(22) Filed: Jan. 5, 2012

(65) Prior Publication Data

US 2012/0177414 A1 Jul. 12, 2012

(30) Foreign Application Priority Data

Jan. 6, 2011 (JP) ..... 2011-001291
Feb. 21, 2011 (JP) ..... 2011-034849
Feb. 23, 2011 (JP) ..... 2011-036968

(51) Int. Cl.
*G03G 15/08* (2006.01)

(52) U.S. Cl.
CPC .... *G03G 15/0834* (2013.01); *G03G 2215/0685* (2013.01); *G03G 15/0848* (2013.01); *G03G 15/0844* (2013.01); *G03G 15/0874* (2013.01)
USPC ..... 399/258; 399/262

(58) Field of Classification Search
CPC ..... G03G 15/0874; G03G 15/0834; G03G 15/0844; G03G 15/0848; G03G 2215/0685
USPC ..... 399/258, 262
See application file for complete search history.

(56) References Cited

U.S. PATENT DOCUMENTS

| | | | | |
|---|---|---|---|---|
| 5,400,066 | A * | 3/1995 | Matsumoto et al. | 347/86 |
| 6,091,912 | A | 7/2000 | Kitajima et al. | |
| 6,097,903 | A | 8/2000 | Yahata et al. | |
| 6,151,471 | A | 11/2000 | Yahata et al. | |
| 6,628,913 | B2 * | 9/2003 | Matsumoto et al. | 399/258 |
| 7,904,006 | B2 * | 3/2011 | Muramatsu | 399/262 |
| 8,385,787 | B2 * | 2/2013 | Yamaguchi et al. | 399/258 |
| 2011/0200365 | A1 | 8/2011 | Ikeguchi | |

FOREIGN PATENT DOCUMENTS

| | | |
|---|---|---|
| JP | 2002-46843 | 2/2002 |
| JP | 2002-72645 | 3/2002 |
| JP | 2002-268346 | 9/2002 |
| JP | 3548402 | 4/2004 |
| JP | 2005-91879 | 4/2005 |
| JP | 2006-85067 | 3/2006 |
| JP | 2006-258926 | 9/2006 |
| JP | 3968268 | 6/2007 |
| JP | 4220798 | 11/2008 |
| JP | 4264295 | 2/2009 |
| JP | 2011-232540 | 11/2011 |
| JP | 2011-232541 | 11/2011 |
| JP | 2012-177878 | 9/2012 |

* cited by examiner

*Primary Examiner* — David Gray
*Assistant Examiner* — Carla Therrien
(74) *Attorney, Agent, or Firm* — Oblon, Spivak, McClelland, Maier & Neustadt, L.L.P.

(57) ABSTRACT

A powder conveying apparatus includes a powder containing unit that contains powder and at least a portion of which is deformable; a discharging unit that discharges the powder from the powder housing unit to an outside; a delivery member that moves toward the discharging unit side while pushing the deformable portion of the powder containing unit inward to thereby convey the powder to the discharging unit; and an oscillation applying unit that applies oscillation to the discharging unit. Driving of the oscillation applying unit is controlled in response to an operation of the delivery member.

5 Claims, 30 Drawing Sheets

POWDER CONVEYING APPARATUS, IMAGE FORMING APPARATUS, AND POWDER CONTAINER

CROSS-REFERENCE TO RELATED APPLICATIONS

The present application claims priority to and incorporates by reference the entire contents of Japanese Patent Application No. 2011-036968 filed in Japan on Feb. 23, 2011, Japanese Patent Application No. 2011-001291 filed in Japan on Jan. 6, 2011 and Japanese Patent Application No. 2011-034849 filed in Japan on Feb. 21, 2011.

BACKGROUND OF THE INVENTION

1. Field of the Invention

The present invention relates to a powder conveying apparatus that conveys powder contained in a powder container to a discharging unit, an image forming apparatus that includes the powder conveying apparatus, and the powder container.

2. Description of the Related Art

Electrophotographic image forming apparatuses, such as copiers, printers, facsimile machines, or multifunction peripherals having functions of copiers, printers and facsimile machines, generally form images by causing developing devices to form toner images with developer called toner or carrier. In such image forming apparatuses, toner is consumed through image formation; therefore, in general, toner cartridges containing toner are attached to the image forming apparatuses and when the toner cartridges become empty of the toner, the toner cartridges are replaced with new ones in order to replenish new toner.

In a toner supply system using the cartridges as described above, there is a user's demand to use up all toner in the cartridges in order to reduce running costs. Therefore, various methods have been employed, such as a method in which what is called a screw bottle that is a cylindrical container provided with an inner-mounted spiral protrusion is used as a toner cartridge and toner is gradually conveyed to a discharging unit by rotating the container, or a method in which a screw typically called an auger is provided inside the container and toner is conveyed to a discharging unit by rotating the screw.

In the conveying system using the auger, it is needed to arrange and rotate the screw inside the container, so that the configuration becomes complicated. Furthermore, in this conveying system, because a stack of toner is forcibly conveyed by the auger, load is applied to the toner and the toner may be aggregated or deteriorated. Moreover, arranging the screw inside the container that is a replaceable part leads to increase in costs of consumables, so that environmental loads increase because of resource consumption.

On the other hand, in the conveying system using the screw bottle, it is not needed to arrange a screw inside the container. Therefore, the configuration becomes simple. However, in this conveying system, because the container itself is rotated when it is used, the container usually has a shape of a cylinder with an outlet arranged on one side surface of the body thereof (a shape like a bottle being laid down). Therefore, the container is disadvantageous in that the capacity for housing toner becomes smaller than a container in a rectangular-solid shape or the container may be too slippery for a person to hold when the container is replaced.

Besides, the container provided with the inner-mounted auger or the screw bottle is constructed of a container called a "hard bottle" that is made of polyethylene terephthalate (PET) or the like. Therefore, there is a problem in recycling used containers. Specifically, while used containers are generally collected from users by manufacturers and then recycled, reused, or incinerated, because it is difficult to squeeze the containers of the hard bottle type to reduce the volume of the containers, the containers become bulky and costs for collection and transportation increase. Furthermore, when the collected containers are refilled with toner for reuse, there is a difficulty in cleaning the collected containers and toner filling efficiency is not good. Therefore, costs for reusing the collected containers also increase.

Alternatively, as a toner conveying system that does not use the screw bottle and the auger, there is a method in which a container is caused to oscillate (reciprocating movement) by applying shock to the container from outside or by bringing the container into contact with a stopper so that toner can be moved and discharged with the aid of the inertia force thereof (see Japanese Patent Application Laid-open No. 2002-46843, Japanese Patent Application Laid-open No. 2002-268346). In this system, when a large amount of toner is contained, the toner stacked in the container collectively moves by the oscillation, so that a satisfactory toner conveying speed can be assured per reciprocating oscillation. However, as the amount of toner in the container decreases, a stack of the toner collapses and the toner is thinly spread, so that the toner conveying speed per reciprocating oscillation decreases with a decrease in the height of the stack of the toner. Therefore, the conveying speed cannot be maintained. Furthermore, a writing system may be influenced by the oscillation of the container and image distortion may occur. Moreover, it takes a long time to fluidize the toner or the toner may be aggregated (blocked) due to an action similar to tapping that occurs by the oscillation.

There is a known developer supply device, in which a nozzle is inserted into a flexible container that houses toner and the toner is sucked out by a pump through the nozzle so as to be supplied to a developing device (see Japanese Patent Application Laid-open No. 2005-91879). In the toner supply system of this type, the volume of the flexible container is automatically reduced as the toner is sucked out by the pump. Accordingly, when the container becomes almost empty of the toner, the container is in a squeezed state. Therefore, costs needed to collect, transport, and reuse the used container can be reduced. Furthermore, because the volume of the container is reduced in accordance with the amount of toner remaining in the container, it is advantageous in that the amount of remaining toner can be recognized by the appearance of the container.

However, in the system in which the toner is sucked out by the pump, a discharge port of the container needs to be arranged with face down so that the toner can be easily sucked out through the discharge port (suction port). If the discharge port is arranged sideways and the container is placed in the horizontal direction, it is impossible to collect the toner to the vicinity of the discharge port by gravity, and the toner may be cross-linked and remain in the container without being discharged. Therefore, the container of this type, in which the toner is sucked out by the pump, cannot be placed in the horizontal direction, and the ways to place the container are largely limited. Specifically, to smoothly discharge the toner from the container, the container needs to be inclined by 50° or more with respect to the horizontal plane when the container is placed. Therefore, in the configuration using the container of this type, it is needed to ensure an installation space for a container that is practically long in a vertical direction. As a result, it is difficult to reduce the size of the entire image forming apparatus in the vertical direction.

As a method for discharging toner from a flexible container without using the pump as described above, a method has been proposed in which a convex member is pressed against and moved along a container from the outside of the container such that contained toner is pushed out through a discharge port (see Japanese Patent Application Laid-open No. H11-143195). With this method, it is possible to discharge toner even when the container is placed so as to extend in the horizontal direction.

However, in the configuration in which the toner is discharged by pushing the container by the convex member as described above, if the toner is packed due to the pressing action of the convex member, toner discharging may be inhibited. In the worse case, blocking may occur due to aggregation of the toner and the toner cannot be discharged from the container.

Japanese Patent Application Laid-open No. 2006-258926 discloses an image forming apparatus that includes a toner discharge port formed on a bottom plate of a toner cartridge; a shutter that closes the discharge port; and a shutter open-close mechanism that opens and closes the shutter. The shutter open-close mechanism opens the discharge port in accordance with an operation of attaching the toner cartridge to an apparatus main body and closes the discharge port in accordance with an operation of pulling the toner cartridge out of the apparatus main body. The shutter open-close mechanism includes engagement concave portions formed on left and right side surfaces of the shutter in the attachment direction; and engagement pins as engaging members that are arranged on the apparatus main body side and that are engaged with and disengaged from the engagement concave portions. The engagement pins engaged with the engagement concave portions are supported by an engagement maintaining means to maintain the engaged state.

When the toner cartridge is inserted and reaches near a predetermined position, the engagement pins arranged on an oscillation tray enter guide grooves arranged on a bottom plate member. At this time, the engagement pins are biased in a direction along the inner wall surfaces of the guide grooves by a spring and move relative to the movement of the toner cartridge. Inclined surfaces that shift the engagement pins outward are formed on the guide grooves, and when the inclined surfaces come into contact with the engagement pins, the engagement pins move outward. Engagement aid protrusions are formed at end positions of the inclined surfaces on the outer wall surfaces of the guide grooves. When the engagement pins pass over the inclined surfaces, the engagement pins receive a moving force from the spring and move inward. At the same time, the engagement pins come into contact with the engagement aid protrusions, so that the engagement pins are reliably engaged with the engagement concave portions of the shutter. With this engagement, the movement of the shutter is stopped while the movement of the toner cartridge is continued, so that the shutter is gradually opened to thereby open the toner discharge port.

On the other hand, when the toner cartridge is pulled out, the shutter is gradually closed. When the engagement pins engaged with the engagement concave portions are returned to the positions of the engagement aid protrusions, the shutter completely closes the toner discharge port. After the shutter closes the toner discharge port, the engagement pins come off from the engagement concave portions. Therefore, the discharge port is completely closed when the toner cartridge is pulled out, so that it is possible to prevent toner dispersion or toner leakage at the time of replacement.

However, if the toner cartridge is repeatedly replaced while the image forming apparatus is used over time, the spring is repeatedly expanded and contracted by the engagement and disengagement of the engagement pins with the engagement concave portions along with the shutter open-close operation. Accordingly, elastic fatigue occurs on the spring and the spring may be deteriorated. If the spring is deteriorated, it becomes difficult to bias the engagement pins by the spring with a desired biasing force, so that the engagement pins may not be engaged with and disengaged from the engagement concave portions. As a result, it becomes difficult to successfully open or close the shutter over time.

As a conveying system different from the above conveying systems, there is proposed a system in which a deformable container is used and a delivery member is pressed against and moved along the container from outside to discharge contained toner (see Japanese Patent Application Laid-open No. H11-143195 (Japanese Patent No. 3548402)). With this conveying system, it is possible to convey the toner with small stress, prevent aggregation or deterioration of the toner, and prevent occurrence of abnormal images due to large oscillation or shock. Furthermore, because it is possible to reduce the size of the container, when used containers to be recycled are collected and transported from user sites to manufacturers because of replacement of cartridges or bottles, the collection and the transportation can be performed easily at lower costs.

There is also a known developer supply device in which a nozzle is inserted into a discharge hole arranged on a flexible container, developer sucked out by a pump through the nozzle is supplied to a developing device, and the volume of the flexible container is automatically reduced in accordance with the supply of the developer (see Japanese Patent Application Laid-open No. 2006-085067).

Such a flexible powder container that does not have a conveying member inside thereof is advantageous in that the volume of the container can be reduced at the time of collection. However, to ensure the powder conveyance, it is difficult to place the powder container such that a longitudinal side extends in the horizontal direction. Therefore, it is difficult to place the powder container parallel to the developing device to reduce the size of the entire image forming apparatus. Specifically, if a spiral groove is formed on the flexible powder container and the container is rotated to supply developer, the container is twisted by the rotation and the developer cannot be conveyed. Furthermore, if developer is to be conveyed without arranging a delivery member inside the container, it is difficult to obtain an angle at which the gravity is utilized to move the developer. As a result, the developer may be cross-linked and remains in the powder container without being discharged. As described above, because it is difficult to place the conventional flexible developer container (powder container) in the horizontal direction, the container needs to be inclined toward the discharging unit by an angle (normally, 50° or greater) slightly greater than the repose angle of the powder. Therefore, the container that is practically long in the vertical direction needs to be arranged, so that the shape of the image forming apparatus, the capacity of the container, and the arrangement of the container are largely limited.

In the above-mentioned system in which the delivery member is pressed against and moved along the deformable container from outside in order to discharge the contained toner, air in the container is also pushed out by the stack of the toner in the container in some cases, and a greater amount of toner than needed may be discharged by the airflow. To prevent the excessive amount of toner from being discharged by air, an air filter that releases air to the outside may be arranged on a toner discharge path. However, the air filter may be gradually clogged and needs to be replaced periodically.

SUMMARY OF THE INVENTION

It is an object of the present invention to at least partially solve the problems in the conventional technology.

According to an aspect of the present invention, there is provided a powder conveying apparatus, the powder conveying apparatus including a powder containing unit that houses powder and at least a portion of which is deformable; a discharging unit that discharges the powder from the powder housing unit to an outside; a delivery member that moves toward the discharging unit side while pushing the deformable portion of the powder containing unit inward to thereby convey the powder to the discharging unit; an oscillation applying unit that applies oscillation to the discharging unit; and a driving unit that controls to drive the oscillation applying unit in response to an operation of the delivery member.

According to another aspect of the present invention, there is provided a powder supply device, the powder supply device including a powder container that has a powder discharge port for supplying powder through a powder receiving port that is arranged on a body of the powder supply device; a powder discharge port open-close member that is arranged slidably relative to the powder container and that opens and closes the powder discharge port, wherein the powder container is configured movably between a supply position, at which the powder discharge port faces the powder receiving port and the powder is supplied, and a retraction position, to which the powder container is retracted from the supply position, and the powder discharge port open-close member opens the powder discharge port along with an attachment operation by which the powder container moves from the retraction position to the supply position, and closes the powder discharge port along with a retraction operation by which the powder container moves from the supply position to the retraction position, the powder supply device further including a locking member that locks the powder discharge port open-close member and that is arranged on the body of the powder supply device so as to move between a locking position, at which the discharge port open-close member is locked, and a release position, to which the locking member is retracted from the locking position and at which locking of the powder discharge port open-close member is released, wherein the powder discharge port open-close member slides relative to the powder container along with the attachment operation of the powder container to thereby open the powder discharge port and displace the locking member from the release position to the locking position to lock the powder discharge port open-close member, and the powder discharge port reaches a position facing the powder discharge port open-close member along with the retraction operation of the powder container to thereby cause the powder discharge port open-close member to close the powder discharge port, and thereafter, the locking member comes into contact with and is biased by the powder container so as to be displaced from the locking position to the release position to thereby release locking between the powder discharge port open-close member and the locking member.

According to still another aspect of the present invention, there is provided a powder container, the powder container including a containing unit that houses powder; and a discharging unit that discharges the powder from the containing unit to an outside, wherein at least a portion of a wall surface of the containing unit is formed of a flexible wall surface that can be deformed so as to protrude to the inside of the containing unit, a protrusion that is obtained by deforming the flexible wall surface so as to protrude inward is moved from the containing unit to the discharging unit to thereby move the powder toward the containing unit, and the containing unit includes a ventilation portion for communicating between spaces that are separated by the protrusion inside the containing unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
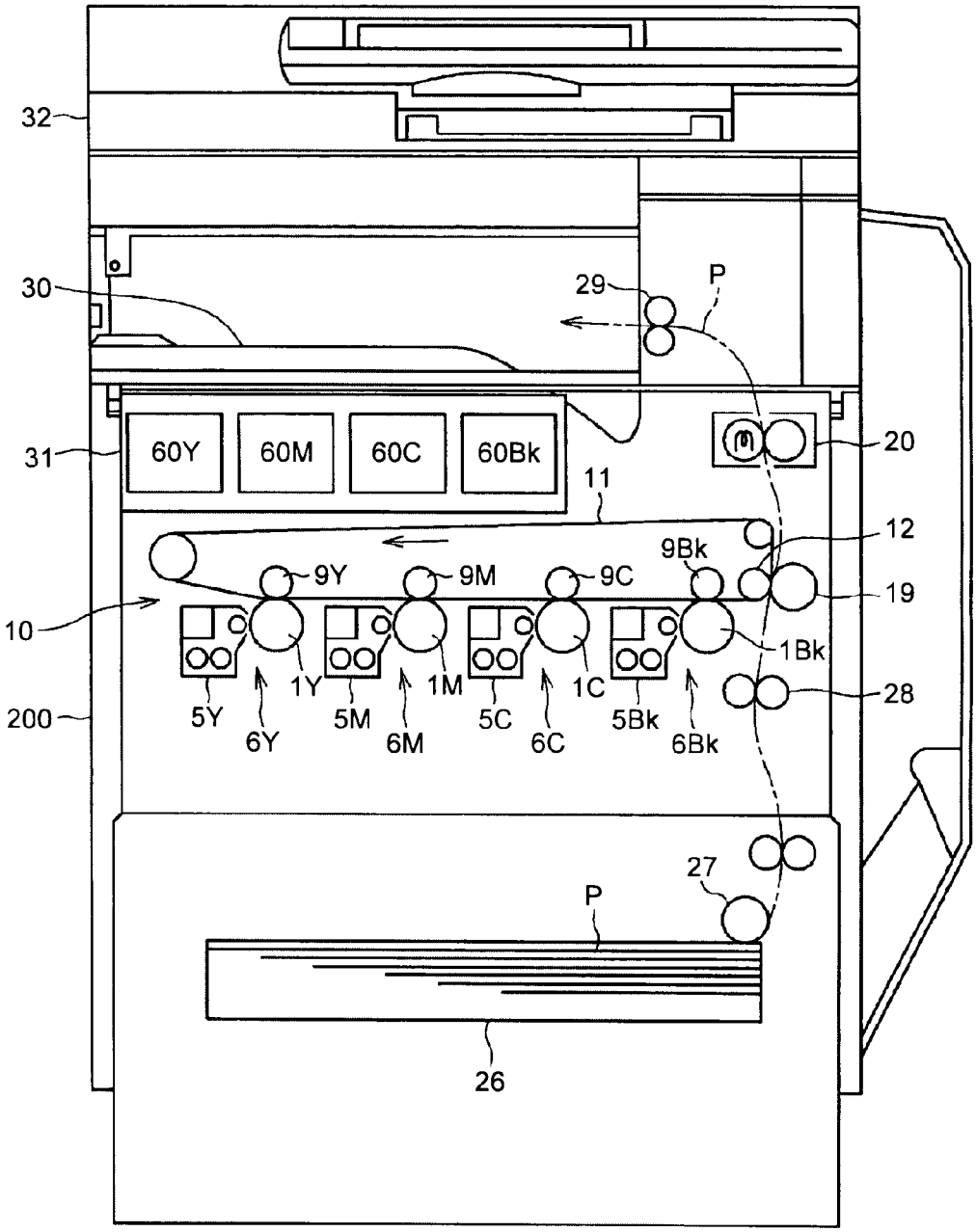
FIG. 1 is a configuration diagram of a printer as an image forming apparatus according to the present embodiment.

Exemplary embodiments will be described below with reference to the accompanying drawings. In the drawings, the same or equivalent components are denoted by the same reference numerals and redundant explanation will be appropriately simplified or will not be repeated.

First Embodiment

An overall configuration and operations of an image forming apparatus will be described below with reference to FIGS. 1 and 2.

FIG. 1 is a configuration diagram of a printer as the image forming apparatus. FIG. 2 is an enlarged view of an image forming unit of the image forming apparatus.

As illustrated in FIG. 1, image forming units 6Y, 6M, 6C, and 6Bk corresponding to respective colors (yellow, magenta, cyan, and black) are arranged side by side and opposite to an intermediate transfer belt 11 of an intermediate transfer unit 10. The four image forming units 6Y, 6M, 6C, and 6Bk installed in an apparatus main body 200 have substantially the same configurations except for colors of toner to be used in image formation processes. Therefore, in FIG. 2, alphabets (Y, M, C, and Bk) assigned to the image forming units 6, photosensitive drums 1, and primary transfer bias rollers 9 are omitted.

Figure 2:
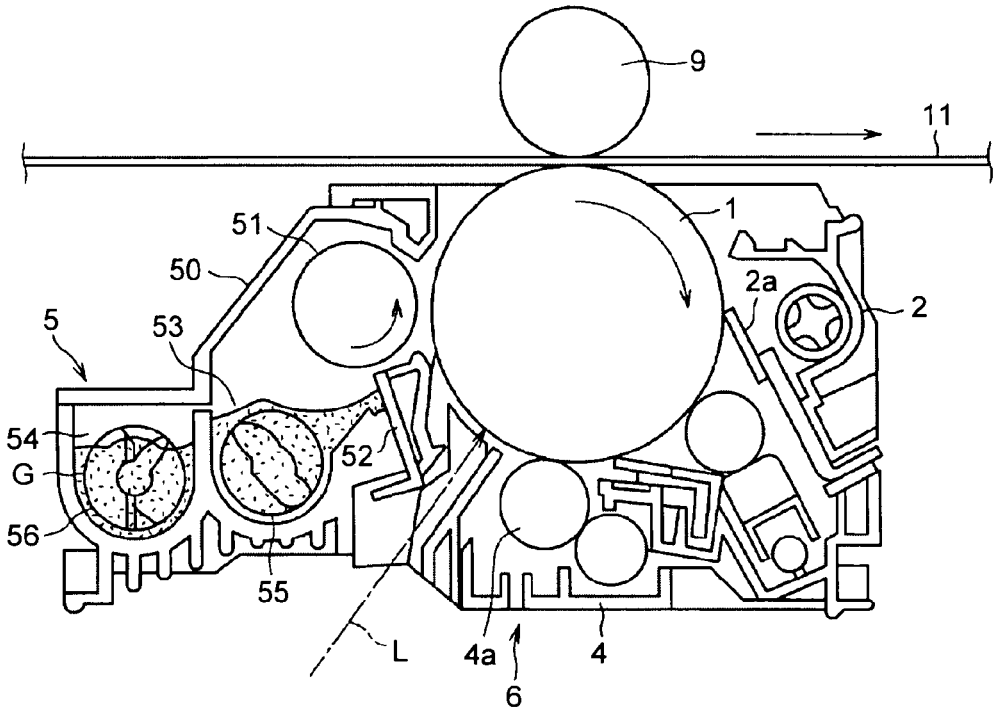
FIG. 2 is an enlarged view of an image forming unit of the image forming apparatus.

As illustrated in FIG. 2, the image forming unit 6 includes the photosensitive drum 1 as an image carrier and includes a charging unit 4, a developing device 5 as a developing unit, and a cleaning unit 2, which are arranged around the photosensitive drum 1 (only the developing devices 5 are illustrated in FIG. 1). The image formation processes (a charging process, an exposing process, a developing process, a transfer process, and a cleaning process) are performed on the photosensitive drum 1, so that a desired toner image is formed on the photosensitive drum 1.

Each of the photosensitive drum 1, the charging unit 4, the developing device 5, and the cleaning unit 2 in the image forming unit 6 is detachably attached to the apparatus main body 200 of the image forming apparatus. Each unit can be replaced with new own when the unit ends its life.

In the first embodiment, each of the photosensitive drum 1, the charging unit 4, the developing device 5, and the cleaning unit 2 in the image forming unit 6 is configured as one independent unit. However, these units can be integrated as a process unit that can be detachably attached to the apparatus main body 200. In this case, the maintenance operability of the image forming unit 6 can be improved.

The configuration of the developing device 5 in the image forming unit 6 will be described in detail below with reference to FIG. 2.

As illustrated in FIG. 2, the developing device 5 includes a developing roller 51 as a developer carrier arranged opposite to the photosensitive drum 1; a doctor blade 52 as a developer regulating member arranged below the developing roller 51; two conveying screws 55 and 56 as developer stirring conveying members arranged inside developer containers 53 and 54, respectively; and a case 50 for containing developer G. As the developer G, two-component developer formed of carrier and toner is used. A toner concentration sensor (not illustrated) for detecting the toner concentration in the developer G is arranged in the developing device 5.

As illustrated in FIG. 2, the photosensitive drum 1 is rotated clockwise in FIG. 2 by a driving unit (not illustrated). A charging roller 4*a* uniformly charges the surface of the photosensitive drum 1 at the position of the charging unit 4 (the charging process).

The surface of the photosensitive drum 1 reaches an irradiation position of laser light L emitted from an exposing unit (not illustrated) and an electrostatic latent image is formed on the surface by exposure scanning (the exposing process) at this position.

The surface of the photosensitive drum 1 reaches a position opposing to the developing roller 51 of the developing device 5. At this position, the electrostatic latent image is developed, so that a desired toner image is formed (the developing process).

The surface of the photosensitive drum 1 reaches a position opposing to both of the intermediate transfer belt 11 and the primary transfer bias roller 9. At this position, the toner image on the photosensitive drum 1 is transferred to the intermediate transfer belt 11 (the primary transfer process). At this time, a small amount of residual toner remains on the photosensitive drum 1.

The surface of the photosensitive drum 1 reaches a position opposing to the cleaning unit 2. At this position, a cleaning blade 2*a* collects the residual toner remaining on the photosensitive drum 1 (the cleaning process).

The surface of the photosensitive drum 1 reaches a position opposing to a neutralizing unit (not illustrated). At this position, a residual potential on the photosensitive drum 1 is removed.

In this manner, a series of the image formation processes performed on the photosensitive drum 1 is completed.

The image formation processes described above are performed on each of the four image forming units 6Y, 6M, 6C, and 6Bk. That is, the exposing unit (not illustrated) arranged below the image forming units applies the laser light L (see FIG. 2) to the photosensitive drum 1 of each of the image forming units 6Y, 6M, 6C, and 6Bk on the basis of image information read by a reading unit 32 illustrated in FIG. 1. More specifically, the exposing unit emits the laser light L from a light source and irradiates the photosensitive drum 1 with the laser light L via a plurality of optical elements while scanning the laser light L by a polygon mirror that is being rotated. Thereafter, toner images of the respective colors formed on the photosensitive drums 1 through the developing process are transferred to the intermediate transfer belt 11 in a superimposed manner. Consequently, a color image is formed on the intermediate transfer belt 11.

The four primary transfer bias rollers 9Y, 9M, 9C, and 9Bk and the photosensitive drums 1Y, 1M, 10, and 1Bk sandwich the intermediate transfer belt 11, so that respective primary transfer nips are formed. A transfer bias voltage with a polarity opposite to the polarity of toner is applied to each of the primary transfer bias rollers 9Y, 9M, 9C, and 9Bk.

The intermediate transfer belt 11 moves in the direction of an arrow in the figure and sequentially passes through the primary transfer nips of the primary transfer bias rollers 9Y, 9M, 9C, and 9Bk. Accordingly, the toner images of the respective colors on the photosensitive drums 1Y, 1M, 10, and 1Bk are primary transferred to the intermediate transfer belt 11 in a superimposed manner.

The intermediate transfer belt 11 on which the toner images of the respective colors are transferred in the superimposed manner reaches a position opposing to a secondary transfer roller 19. At this position, a secondary transfer backup roller 12 and the secondary transfer roller 19 sandwich the intermediate transfer belt 11, so that a secondary transfer nip is formed. The color toner image formed on the intermediate transfer belt 11 is transferred to a transfer material P, such as a transfer sheet, conveyed to the position of the secondary transfer nip. At this time, residual toner that has not been transferred to the transfer material P remains on the intermediate transfer belt 11. The residual toner on the intermediate transfer belt 11 is removed by a belt cleaning device (not illustrated).

In this manner, a series of transfer processes performed on the intermediate transfer belt 11 is completed.

The transfer material P is conveyed to the position of the secondary transfer nip from a feeding unit 26 arranged below the apparatus main body 200 via a feed roller 27, a registration roller pair 28, and the like.

More specifically, a plurality of transfer materials P, such as transfer sheets, is housed in the feeding unit 26 in a stacked manner. When the feed roller 27 is rotated counterclockwise in FIG. 1, the topmost transfer material P is fed toward a nip between rollers of the registration roller pair 28.

The transfer material P conveyed to the registration roller pair 28 temporarily stops at a position of the roller nip of the registration roller pair 28 whose rotation is stopped. Thereafter, the registration roller pair 28 is rotated and the transfer material P is conveyed toward the secondary transfer nip in synchronization with a timing of the color image on the intermediate transfer belt 11. Accordingly, a desired color image is transferred to the transfer material P.

The transfer material P on which the color image is transferred at the position of the secondary transfer nip is further conveyed to a position of a fuser unit 20. At this position, the color image transferred on the surface of the transfer material P is fixed to the transfer material P due to heat and pressure applied by a fuser roller and a pressing roller.

Thereafter, the transfer material P passes through a nip between rollers of a discharge roller pair 29 and is discharged to the outside of the apparatus. The transfer material P discharged to the outside of the apparatus main body 200 by the discharge roller pair 29 is stacked, as an output image, on a stacking unit 30.

In this manner, a series of the image formation processes in the image forming unit is completed.

In FIG. 1, a toner supply unit 31 is arranged above the intermediate transfer unit 10. The toner supply unit 31 includes four toner supply devices 60Y, 60M, 60C, and 60Bk, each of which is filled with toner of a corresponding color. A toner conveying path is extended from each of the toner supply devices 60Y, 60M, 60C, and 60Bk to corresponding one of the developing devices 5Y, 5M, 5C, and 5Bk. Toner is supplied from the toner supply devices 60Y, 60M, 60C, and 60Bk to the developing devices 5Y, 5M, 5C, and 5Bk via the respective toner conveying paths. Therefore, it is possible to supply toner in accordance with the consumption amount of toner in each of the developing devices 5Y, 5M, 5C, and 5Bk. Consequently, the developing devices can be used for a long period of time.

The four toner supply devices 60Y, 60M, 60C, and 60Bk have the same configurations except for colors of toner contained therein. Therefore, in the following, the configuration of only one toner supply device will be described.

Figure 3:
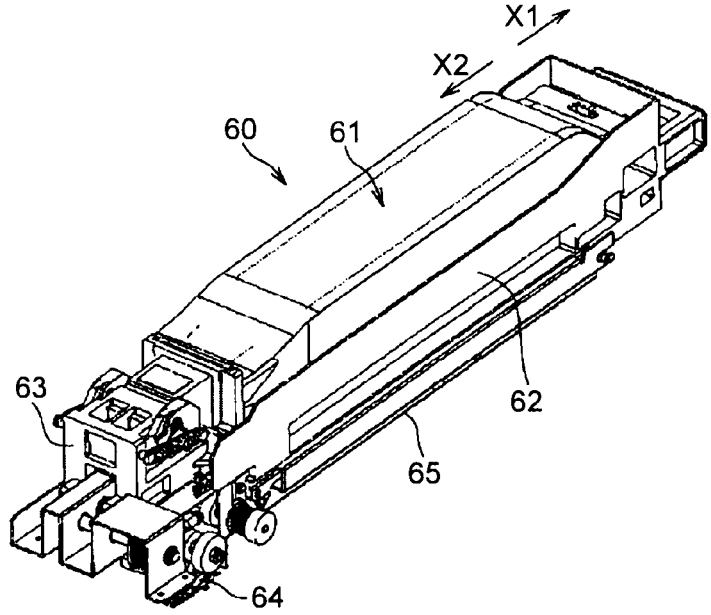
FIG. 3 is a perspective view of a toner supply device.

FIG. 3 is a perspective view of the toner supply device. In FIG. 3, an alphabet (Y, M, C, or Bk) assigned to the toner supply device 60 is omitted.

As illustrated in FIG. 3, the toner supply device 60 includes a toner cartridge 61 as a toner container (a powder container) that is filled with toner; a pullout tray 62 as a holder member that holds the toner cartridge 61; a fixing unit 63 that fixes the toner cartridge 61; and a sub hopper 64 that accumulates toner discharged from the toner cartridge 61. A toner conveying pipe (not illustrated) for conveying the toner accumulated in the sub hopper 64 toward the developing device is connected to the sub hopper 64.

The pullout tray 62 is mounted so that the pullout tray 62 can move in the horizontal direction relative to a main-body frame 65. When the pullout tray 62 is moved in a direction of an arrow X1 in the figure, the pullout tray 62 is pulled out of the apparatus main body. On the other hand, when the pullout tray 62 is moved in a direction of an arrow X2, the pullout tray 62 is housed in the apparatus main body.

Figure 4A:
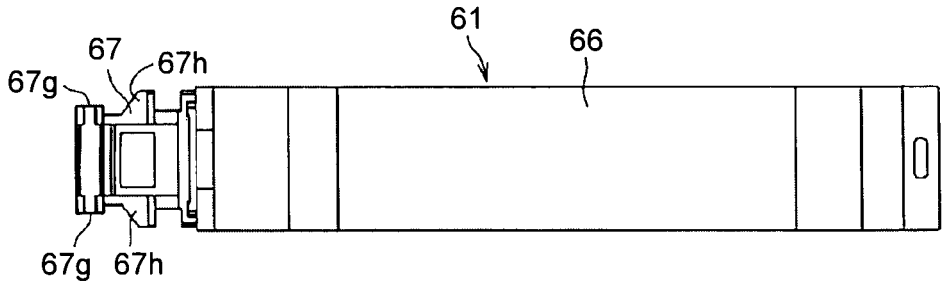
FIGS. 4A to 4D are configuration diagrams of a toner cartridge.
Figure 4B:
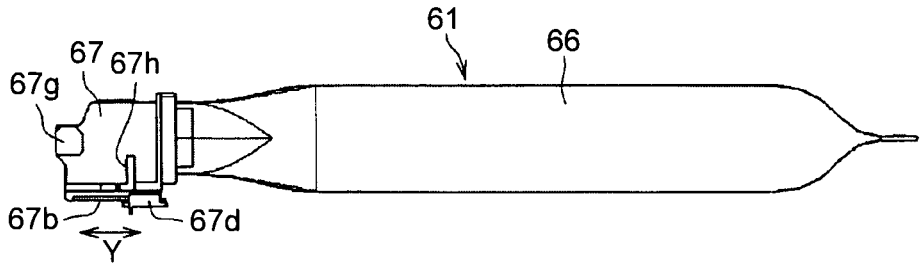
Figure 4C:
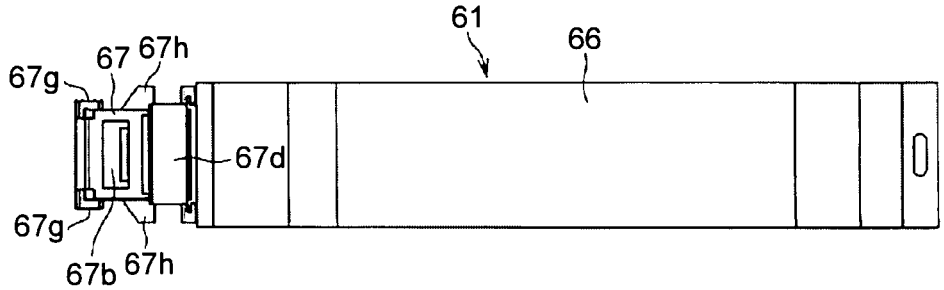
Figure 4D:
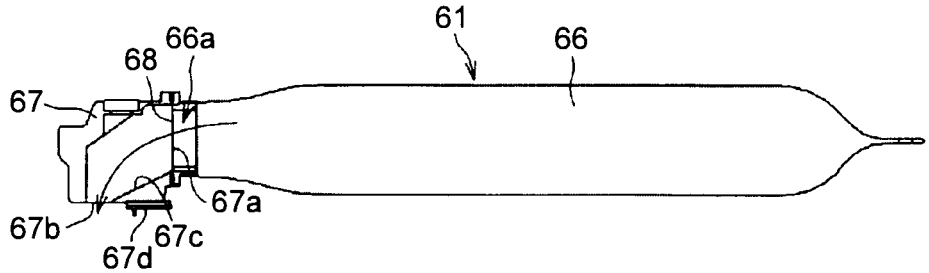

FIGS. 4A to 4D are configuration diagrams of the toner cartridge 61. Specifically, FIG. 4A is a plan view, FIG. 4B is a side view, FIG. 4C is a bottom view, and FIG. 4D is a cross-sectional view of the toner cartridge 61.

As illustrated in FIGS. 4A to 4D, the toner cartridge 61 includes a toner containing unit (a powder containing unit) 66 for containing toner as powder; and a discharging unit 67 for discharging toner from the toner containing unit 66 to the outside.

As illustrated in FIG. 4D, the toner containing unit 66 is a deformable longitudinal bag member with a toner inlet port (a powder inlet port) 66*a* that is opened on one end side thereof. As a material of the toner containing unit 66, a flexible material is used, such as a thin sheet material made of PET. The toner containing unit 66 illustrated in FIGS. 4A to 4D is formed by bonding four sheet members. However, the toner containing unit 66 may be formed in a bag shape by connecting sides of one sheet material. The toner containing unit 66 includes an opening holder member 68 that keeps the toner inlet port 66*a* open so that toner can be easily supplied through the toner inlet port 66*a*. In the first embodiment, P×P toner (with an average particle diameter of 5.8 μm) produced by Ricoh Company, Ltd. is housed in the toner containing unit 66. For example, when the approximate inside dimension of the toner containing unit 66 is 60 mm×60 mm×400 mm, about 500 g of toner can be housed in the toner containing unit 66.

As a material of the toner containing unit 66, a sheet material made of a single or a combination of various resin materials may be used. Examples of the resin materials include PA (polyamide resin or nylon), PE (high density polyethylene or low density polyethylene), PC (polycarbonate resin), PP (polypropylene resin), PS (polystyrene resin), PAN (polyacrylonitrile resin), PET (polyester resin), PVC (polyvinyl chloride resin), and PVDC (polyvinylidene chloride resin). In the first embodiment, four types of resin sheets made of PP, PET, PA, and LDPE (low density polyethylene) are adhered to one another. As a sheet forming method, any thin-film forming method, such as physical vapor deposition (PVD) or chemical vapor deposition (CVD), is applicable. When the sheets are bonded by thermal welding, adhesiveness can be improved by using LDPE in the innermost sheet layer.

As illustrated in FIG. 4D, the discharging unit 67 includes an inlet 67*a* for introducing toner; and a discharge port 67*b* for discharging toner. In the first embodiment, the discharge port 67*b* is arranged so as to face downward. Therefore, it is possible to allow toner to fall from the discharge port 67*b* to the sub hopper 64 by weight, enabling to simplify the configuration for discharging toner. An inclined surface 67*c*, which is inclined downward from the inlet 67*a* to the discharge port 67*b*, is arranged in the discharging unit 67 so that the toner can smoothly be conveyed to the discharge port 67*b*. It is preferable to set the inclination angle of the inclined surface 67*c* with respect to the horizontal plane to be 10° or greater. A slide shutter 67*d* for opening and closing the discharge port 67*b* is arranged on the bottom surface (the lower surface) of the discharge port 67*b* so that the slide shutter 67*d* can slide in a direction of an arrow Y in FIG. 4B.

Figure 5A:
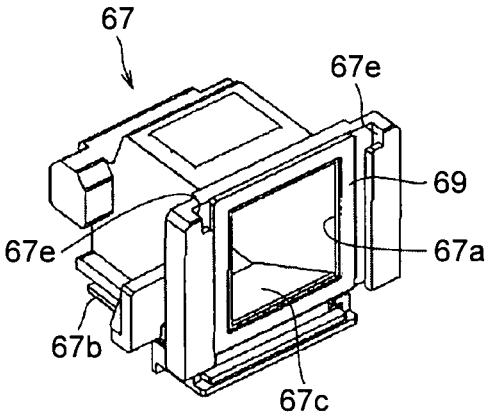
FIGS. 5A to 5C are exploded views of the toner cartridge.
Figure 5B:
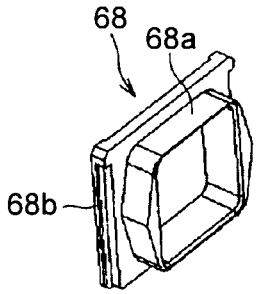
Figure 5C:
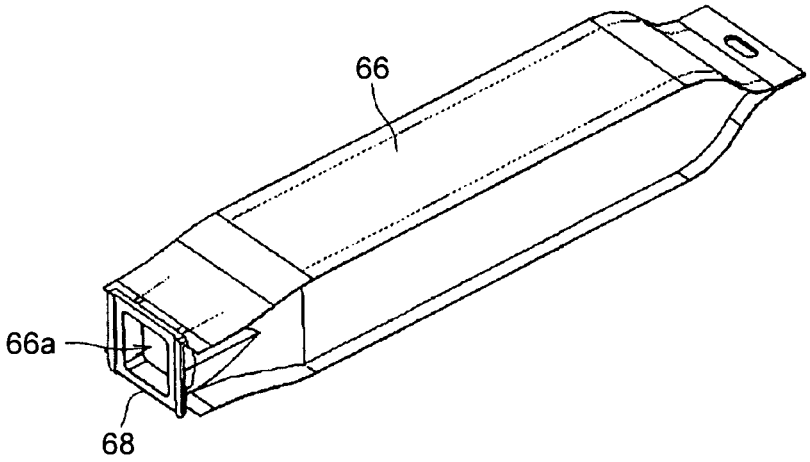

FIGS. 5A to 5C are exploded views of the toner cartridge 61. Specifically, FIG. 5A is a perspective view of the discharging unit 67, FIG. 5B is a perspective view of the opening holder member 68, and FIG. 5C is a perspective view of the opening holder member 68 arranged on the toner containing unit 66.

As illustrated in FIG. 5B, the opening holder member 68 includes a short tubular insertion member 68*a* and a flange-shaped connection portion 68*b*, which are integrated with each other. As illustrated in FIG. 5C, the insertion member 68*a* is insertable into the toner inlet port 66*a* of the toner containing unit 66. In the first embodiment, the toner containing unit 66 and the opening holder member 68 are bonded by thermal welding; however, it is possible to bond them with adhesive agent. The outer shape of the insertion member 68*a* is an approximate hexagon so that an insertion portion of the insertion member 68*a* can be easily held in the vertical direction in FIG. 5C at the time of the thermal welding.

As illustrated in FIG. 5A, a pair of grooves 67*e* that can be engaged with the connection portion 68*b* of the opening holder member 68 is arranged on the inlet 67*a* side of the discharging unit 67. After the opening holder member 68 is inserted and bonded to the toner containing unit 66 as described above, the opening holder member 68 is inserted and engaged with the grooves 67*e* from above, so that the toner containing unit 66 and the discharging unit 67 are integrally connected to each other. A seal member 69 is arranged on a connection portion between the discharging unit 67 and the opening holder member 68 in order to prevent toner from leaking from the connection portion.

Figure 6A:
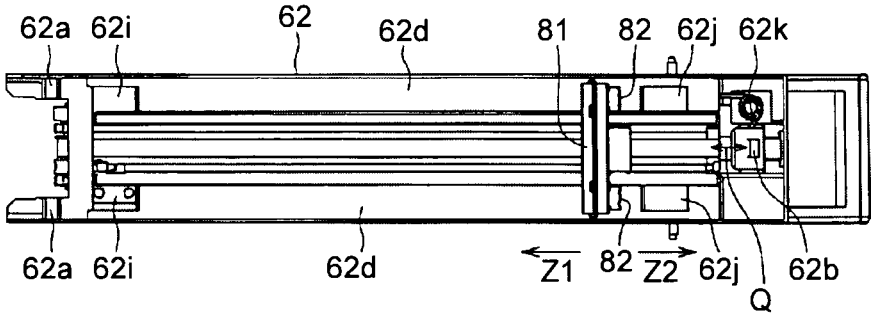
FIG. 6A is a plan view of a pullout tray before the toner cartridge is attached.
Figure 6B:
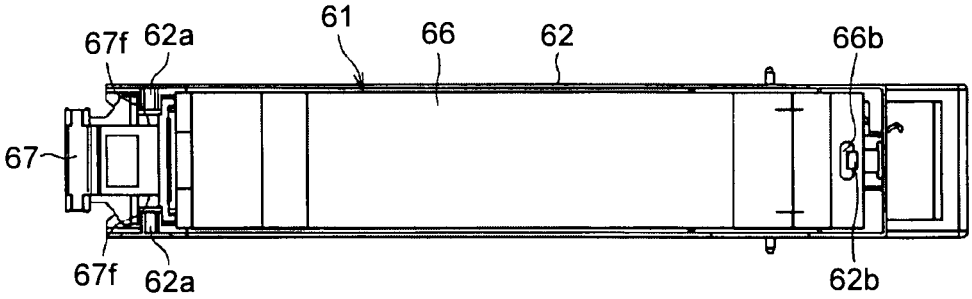
FIG. 6B is a plan view the pullout tray after the toner cartridge is attached.

FIG. 6A is a plan view of the pullout tray 62 before the toner cartridge 61 is attached. FIG. 6B is a plan view of the pullout tray 62 after the toner cartridge 61 is attached.

As illustrated in FIG. 6B, concave portions 67*f* are arranged on both side surfaces of the discharging unit 67. Convex portions 62*a* are arranged on the pullout tray 62 so as to correspond to the positions of the concave portions 67*f*, so that the convex portions 62*a* can be inserted into the concave portions 67*f*. A hole portion 66*b*, which is a to-be-engaged portion to be engaged with an engaging portion of other unit, is formed on an end portion of the toner containing unit 66 on the side opposite to the discharging unit 67 side. A hook-shaped hook portion 62*b* as the engaging portion is arranged on the pullout tray 62 so as to correspond to the position of the hole portion 66*b*.

By inserting the hook portion 62*b* to the hole portion 66*b* so that they are engaged with each other and inserting the convex portions 62*a* into the concave portions 67*f*, the toner cartridge 61 is attached to the pullout tray 62. When the toner cartridge 61 is attached as described above, the convex portions 62*a* and the concave portions 67*f* are not in contact with each other. However, when the toner cartridge 61 moves in the longitudinal direction along with the pullout tray 62 being pulled out of the apparatus main body or being housed in the apparatus main body, the convex portions 62*a* come into contact with the concave portions 67*f*, so that the movement of the toner cartridge 61 in the longitudinal direction can be regulated.

When the toner cartridge 61 is detached from the pullout tray 62, the concave portions 67*f* are separated from the convex portions 62*a* and the hook portion 62*b* is disengaged from the hole portion 66*b*. In the first embodiment, the convex portions 62*a* (or the concave portions 67*f*) have the same shapes; however, if the shapes are made different, it is possible to prevent the toner cartridge 61 from being erroneously attached.

As illustrated in FIG. 6A, the hook portion 62*b* is attached so as to be movable in a direction indicated by an arrow Q in the figure relative to the pullout tray 62. That is, the hook portion 62*b* is configured so that it can move in a direction toward the discharging unit 67 side and in a direction opposite to the discharging unit 67 while the toner cartridge 61 is attached to the pullout tray 62 (the state illustrated in FIG. 6B). Furthermore, as illustrated in FIG. 6A, the hook portion 62*b* is biased to the right in the figure by a torsion coil spring 62*k* that is an elastic member. Therefore, when the hook portion 62*b* is inserted into the hole portion 66*b* of the toner containing unit 66 so as to be hooked, the hook portion 62*b* is pulled by the biasing force of the torsion coil spring 62*k* toward the direction opposite to the discharging unit 67, so that the toner containing unit 66 is maintained at a predetermined position. It is possible to employ a member other than the torsion coil spring as the elastic member for pulling the hook portion 62*b*. However, in the first embodiment, the configuration for pulling the hook portion 62*b* is made compact by using the torsion coil spring 62*k*.

Figure 7A:
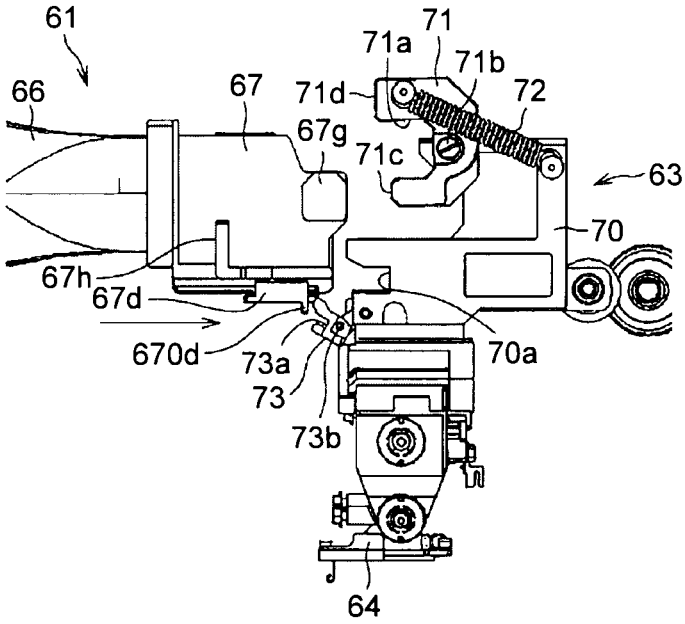
FIGS. 7A and 7B are enlarged views of a fixing unit.
Figure 7B:
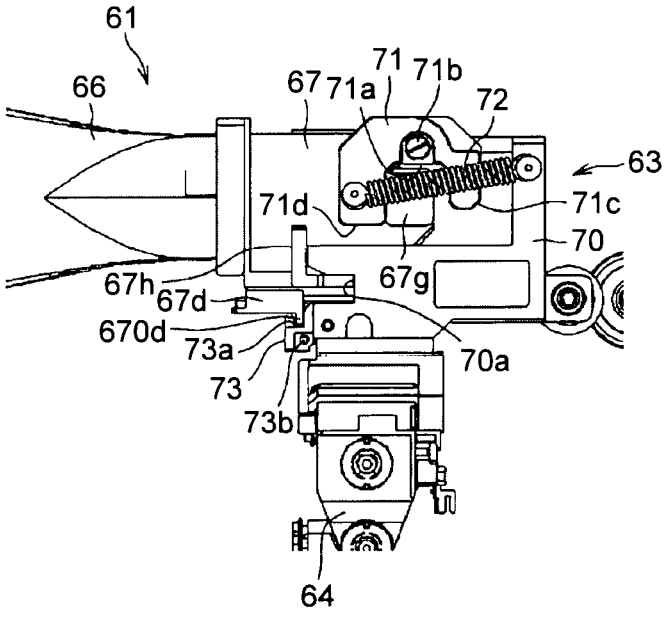

FIGS. 7A and 7B are enlarged views of the fixing unit 63. Specifically, FIG. 7A illustrates a state before the toner cartridge 61 is fixed to the fixing unit 63, and FIG. 7B illustrates a state after the toner cartridge 61 is fixed to the fixing unit 63.

As illustrated in FIGS. 7A and 7B, the fixing unit 63 includes a main body 70 connected to an upper portion of the sub hopper 64; a fixing arm 71 attached to an upper portion of the main body 70; a spring member 72 attached between the fixing arm 71 and the main body 70; and a shutter opening member 73 attached to the main body 70 on the lower side of the fixing arm 71. The fixing arm 71, the spring member 72, and the shutter opening member 73 are arranged on each of the front side and the back side in the figures.

The fixing arm 71 has an approximate C-shape with a concave portion 71*a*. The fixing arm 71 is attached to the main body 70 so that the fixing arm 71 can rotate about a horizontal support shaft 71*b* that is arranged in the center of the fixing arm 71. By rotating the fixing arm 71 about the support shaft 71*b*, the fixing arm 71 is switched between a fixing released position illustrated in FIG. 7A and a fixed position illustrated in FIG. 7B.

The spring member 72 is a tensile coil spring. One end of the spring member 72 is attached to the fixing arm 71 and the other end of the spring member 72 is attached to the main body 70. As illustrated in FIGS. 7A and 7B, when the fixing arm 71 rotates between the fixed position and the fixation released position, the end of the spring member 72 attached to the fixing arm 71 moves across a rotation fulcrum (the support shaft 71*b*) of the fixing arm 71. By causing the spring member 72 to move across the rotation fulcrum along with the rotation of the fixing arm 71, the fixing arm 71 is biased by the spring member 72 in the rotation direction.

Protrusions 67*g* as to-be-fixed portions to be fixed to the fixing arm 71 are arranged on the discharging unit 67. The protrusions 67*g* are arranged on the respective side surfaces of the discharging unit 67 (see FIG. 4A or FIG. 4C).

The shutter opening member 73 is attached to the main body 70 so that the shutter opening member 73 can rotate about a horizontal support shaft 73*b*. The shutter opening member 73 includes a concave portion 73*a* for holding a convex portion 670*d* of the slide shutter 67*d* arranged on the discharging unit 67.

A notch portion 70*a* is formed on the main body 70 of the fixing unit 63. L-shaped protrusions 67*h* that come into contact with an upper portion of the notch portion 70*a* are arranged on the respective side surfaces of the discharging unit 67.

To fix the toner cartridge 61 to the fixing unit 63, the toner cartridge 61 is first attached to the pullout tray 62 as described above with reference to FIGS. 6A and 6B. Then, the pullout tray 62 is moved in a direction in which the pullout tray 62 is housed in the apparatus main body (in the direction of the arrow X2 in FIG. 3). Along with this housing operation, as illustrated in FIG. 7A, when the discharging unit 67 of the toner cartridge 61 approaches the fixing unit 63, the protrusion 67*g* arranged on the discharging unit 67 comes into contact with one end portion 71*c* (a lower end portion in FIG. 7A) of the fixing arm 71 and causes the fixing arm 71 to rotate counterclockwise in the figure against the biasing force applied by the spring member 72. Accordingly, the fixing arm 71 is switched from the fixation released position illustrated in FIG. 7A to the fixed position illustrated in FIG. 7B. As a result, as illustrated in FIG. 7B, the protrusion 67*g* is fitted into the concave portion 71*a* of the fixing arm 71 and is sandwiched and fixed by an end portion 71*d* (a left end portion in FIG. 7B) of the fixing arm 71 and the edge of the main body 70. When the spring member 72 moves across the rotation fulcrum of the fixing arm 71 along with the rotation of the fixing arm 71, the spring member 72 applies a biasing force to the fixing arm 71 in a direction in which the fixing arm 71 is maintained at the switched position.

Furthermore, as the discharging unit 67 of the toner cartridge 61 approaches the fixing unit 63, the protrusions 67*h* arranged on the discharging unit 67 enter the notch portion 70*a* of the main body 70 and come into contact with the upper portion of the notch portion 70*a* (see FIG. 7B). Therefore, backlash of the discharging unit 67 in the vertical direction can be prevented.

Moreover, the slide shutter 67*d* arranged on the discharging unit 67 comes into contact with the shutter opening member 73 and causes the shutter opening member 73 to rotate clockwise in the figure. Accordingly, as illustrated in FIG. 7B, the convex portion 670*d* of the discharging unit 67 is inserted and held in the concave portion 73*a* of the shutter opening member 73. At this time, because the shutter opening member 73 rotates and comes into contact with the main body 70, further rotation of the shutter opening member 73 can be regulated. Therefore, the slide shutter 67*d* is pushed by the shutter opening member 73 and move to the rear side of the discharging unit 67. Consequently, the slide shutter 67*d* (a discharge port) is opened so that the toner can be discharged from the discharging unit 67 to the sub hopper 64.

In this manner, the fixation of the toner cartridge 61 to the fixing unit 63 is completed.

When the fixation of the toner cartridge 61 is to be released, the pullout tray 62 is moved in the direction in which the pullout tray 62 is pulled out of the apparatus main body (in the direction of the arrow X1 in FIG. 3). With this pullout operation, the toner cartridge 61 moves to the left in FIG. 7B, so that the protrusion 67*g* arranged on the discharging unit 67 pushes the end portion 71*d* of the fixing arm 71 and causes the fixing arm 71 to rotate clockwise in the figure against the biasing force applied by the spring member 72. Accordingly, the fixing arm 71 is switched from the fixed position illustrated in FIG. 7B to the fixation released position illustrated in FIG. 7A, so that the protrusions 67*g* is separated from the fixing arm 71. At the same time, the protrusions 67*h* and the slide shutter 67*d* arranged on the discharging unit 67 are separated from the notch portion 70*a* and the shutter opening member 73, respectively, so that the fixation of the toner cartridge 61 is released. A spring or the like (not illustrated) applies a biasing force to the slide shutter 67*d* separated from the shutter opening member 73 so that the slide shutter 67*d* moves in the direction in which the discharge port is closed. Therefore, toner leakage from the discharge port can be prevented.

As described above, according to the first embodiment, the rotation operation of the fixing arm 71 and the open-close operation of the slide shutter 67*d* can be performed in synchronization with the pullout/housing operation of the pullout tray 62 (the attachment/detachment operation to/from the fixing unit 63). Therefore, it is possible to easily perform the operations of fixing and releasing the toner cartridge 61 and the operations of opening and closing the discharge port, enabling to ensure good operability. The spring member 72 applies a force to the fixing arm 71 in a rotation direction by moving across the rotation fulcrum of the fixing arm 71 along with the rotation of the fixing arm 71. Therefore, it is possible to reliably hold the fixing arm 71 at the switched position. It is also possible to prevent backlash of the discharging unit 67 in the vertical direction because the protrusions 67*h* come into contact with the notch portion 70*a*. Therefore, it is possible to stabilize the fixed state of the toner cartridge. In the first embodiment, the toner containing unit 66 and the discharging unit 67 are integrally attached to and detached from the pullout tray 62. However, it is possible to fix the discharging unit 67 to the pullout tray 62 (or to the fixing unit 63) such that the toner containing unit 66 is attached to and detached from the discharging unit 67.

Figure 8:
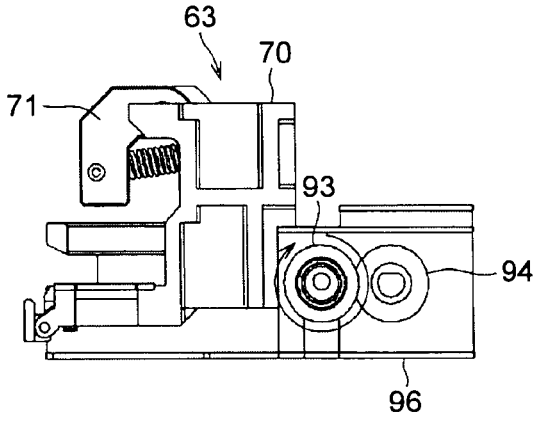
FIG. 8 is a cross-sectional view of the fixing unit.

FIG. 8 is a cross-sectional view of the fixing unit 63.

Figure 9:
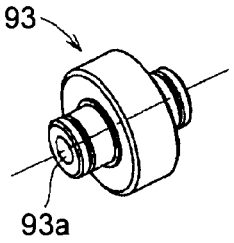
FIG. 9 is a perspective view of an eccentric weight.

As illustrated in FIG. 8, the fixing unit 63 includes an eccentric weight 93 that is provided on a rotation shaft and that functions as an oscillation applying unit. As illustrated in FIG. 9, the eccentric weight 93 has an insertion hole 93*a* formed at a position deviated from the center thereof. The eccentric weight 93 is rotatably attached to the fixing unit 63 via a rotation shaft that is inserted into the insertion hole 93*a*. A driving unit 94 arranged on the fixing unit 63 applies a driving force to the eccentric weight 93 to rotate the eccentric weight 93, thereby causing oscillation to occur. The amount of eccentricity of the eccentric weight 93 (the amount of deviation from the center of rotation) is set to be 1 mm or smaller, so that the oscillation to be generated is extremely small. Rectangular supporting members 95 (see FIG. 10) as a pair are attached to both ends of the rotation shaft that is inserted through the eccentric weight 93. Each of the supporting members 95 rotates together with the eccentric weight 93.

Figure 10:
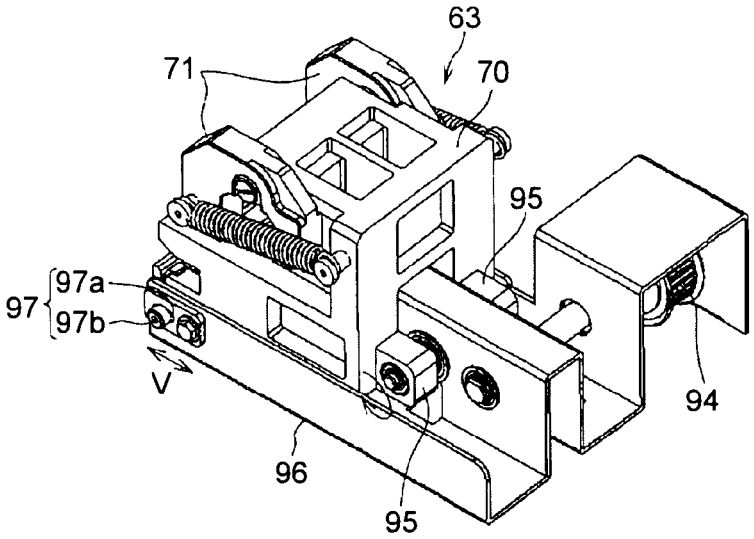
FIG. 10 is a perspective view of the fixing unit.
Figure 11:
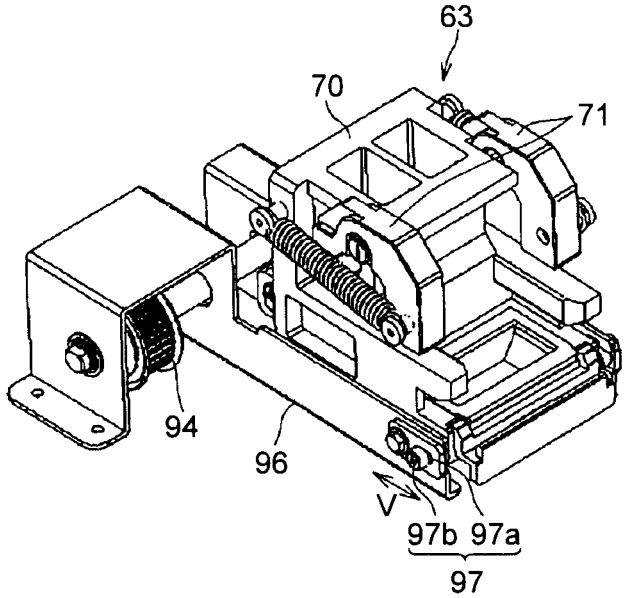
FIG. 11 is a perspective view of the fixing unit.

As illustrated in FIGS. 10 and 11, the main body 70 of the fixing unit 63 is attached such that the main body 70 can oscillate in the horizontal direction (in the direction of an arrow V in the figures) via an oscillation supporting unit 97 with respect to a base unit 96 fixed to the apparatus main body. Specifically, the oscillation supporting unit 97 includes long holes 97*a* that are elongated in the horizontal direction and formed on both side surfaces of the base unit 96; and bolts 97*b* that are inserted into the long holes 97*a*. One end portion of the main body 70 is attached to the base unit 96 with the bolts 97*b* inserted into the long holes 97*a*. As described above, the main body 70 is configured so that it can oscillate. Therefore, it is possible to effectively oscillate the main body 70. Furthermore, in the first embodiment, the eccentric weight 93 is arranged on an end portion side separate from the end portion where the oscillation supporting unit 97 is arranged, in order to more effectively oscillate the main body 70.

Figure 12:
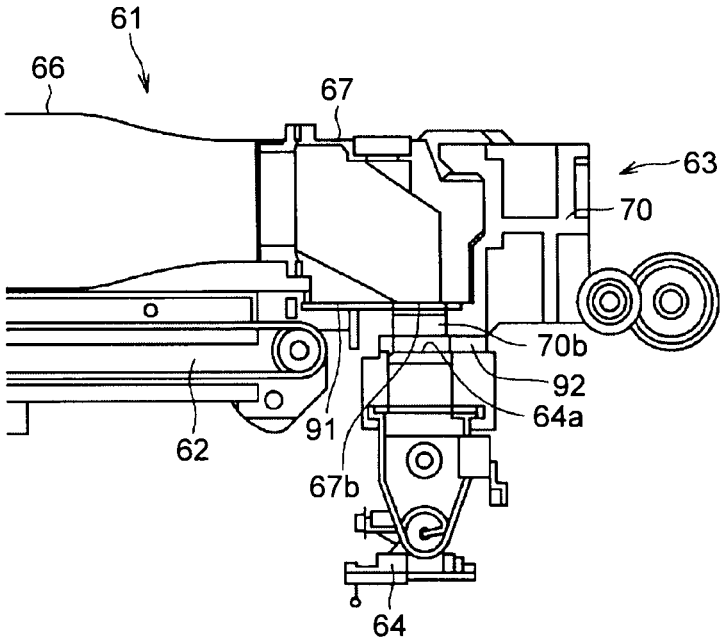
FIG. 12 is a cross-sectional view of the fixing unit to which the toner cartridge is fixed.

FIG. 12 is a cross-sectional view of the fixing unit 63 to which the toner cartridge 61 is fixed.

As illustrated in FIG. 12, a communication path 70*b* for communicating the discharge port 67*b* of the discharging unit 67 and an entrance portion 64*a* of a toner conveying path (a powder conveying path) of the sub hopper 64 is formed on the main body 70 of the fixing unit 63. A first seal member 91 is arranged at a connection portion between the communication path 70*b* and the discharge port 67*b* in order to prevent toner leakage. A second seal member 92 is arranged on a connection portion between the communication path 70*b* and the entrance portion 64*a* of the sub hopper 64 in order to prevent toner leakage. The second seal member 92 is formed of an elastic body that is thicker than the first seal member 91. Examples of a material of the elastic body include low rebound urethane foam. Because the second seal member 92 is interposed between the fixing unit 63 and the sub hopper 64, the fixing unit 63 and the sub hopper 64 are connected with a space therebetween (in a non-contact state). In this manner, the fixing unit 63 and the sub hopper 64 are connected to each other with a space therebetween (in the non-contact state) via the elastic body (the second seal member 92), so that it becomes possible not to transmit the oscillation generated by the fixing unit 63 to the sub hopper 64.

Furthermore, as illustrated in FIG. 12, when the discharging unit 67 is fixed to the fixing unit 63, the pullout tray 62 and the discharging unit 67 are not in contact with each other. Therefore, the oscillation applied from the fixing unit 63 to the discharging unit 67 is not transmitted from the discharging unit 67 to the pullout tray 62.

Figure 13:
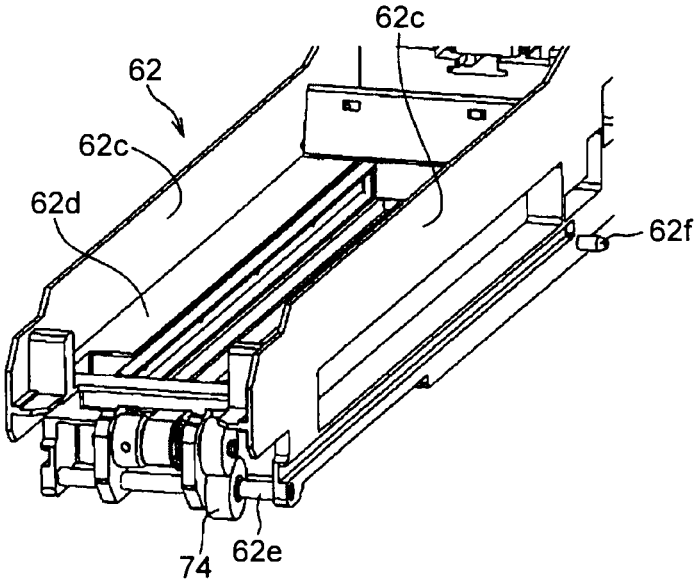
FIG. 13 is a perspective view of the pullout tray.

FIG. 13 is a perspective view of the pullout tray 62.

As illustrated in FIG. 13, the pullout tray 62 includes a pair of side walls 62*c* for supporting both side surfaces of the toner cartridge 61; and a placement surface 62*d* for placing the toner cartridge 61. A main reference shaft 62*e* to be used as a main reference at the time of attachment to the main-body frame 65 is arranged on the front end portions of the side walls 62*c* in the figure. In the first embodiment, the main reference shaft 62*e* is used as a support shaft of a transmission gear 74 that transmits a driving force to a toner conveying apparatus, which will be described below. Sub reference shafts 62*f* to be used as sub reference at the time of attachment to the main-body frame 65 are arranged to respective back end portions of the side walls 62*c* in the figure.

Figure 14:
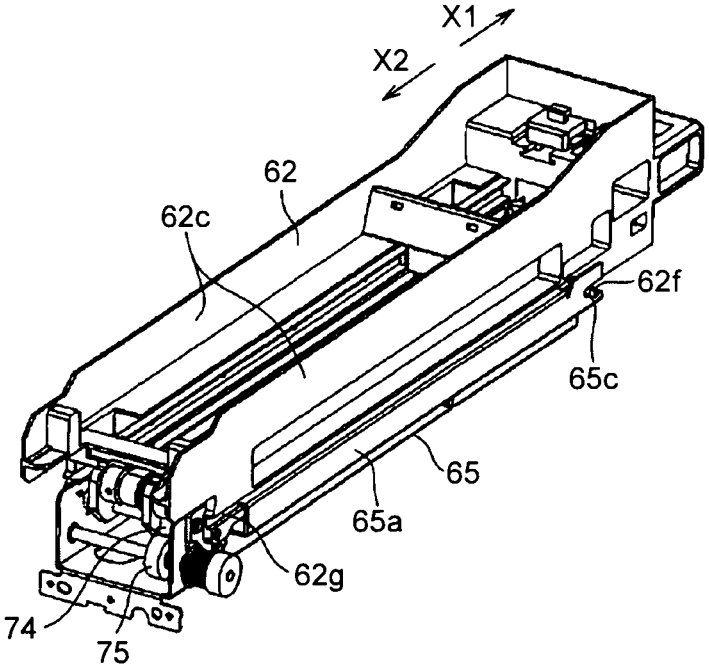
FIG. 14 is a perspective view of the pullout tray attached to a main-body frame.

FIG. 14 is a perspective view of the pullout tray 62 attached to the main-body frame 65.

As illustrated in FIG. 14, the main-body frame 65 includes a pair of guide rails 65*a* extending in the pullout direction X1 and the housing direction X2 of the pullout tray 62. An upper edge of each of the guide rails 65*a* is inserted in corresponding one of grooves 62*g* that are formed on the respective side walls 62*c* of the pullout tray 62. Therefore, the pullout tray 62 is movable in the pullout direction X1 and the housing direction X2 along the guide rails 65*a*.

Figure 15:
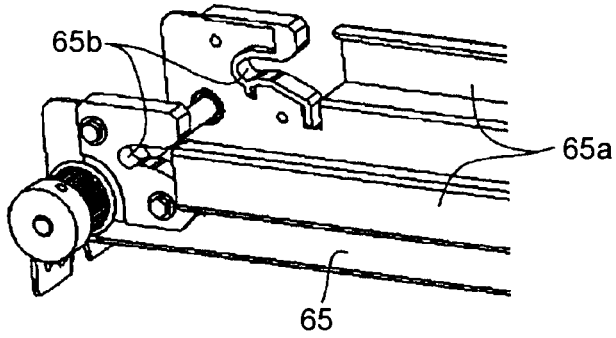
FIG. 15 is an enlarged view of the main-body frame.

First positioning concaves 65*b* that can be engaged with the main reference shaft 62*e* of the pullout tray 62 are formed on an end portion of the main-body frame 65 on the front side in the figure (see FIG. 15). Second positioning concaves 65*c* that can be engaged with the sub reference shafts 62*f* are formed on an end portion of the main-body frame 65 on the back side in the figure. Therefore, when the pullout tray 62 is moved in the housing direction X2, the main reference shaft 62*e* and the sub reference shafts 62*f* are inserted in and engaged with the first positioning concaves 65*b* and the second positioning concaves 65*c*, respectively, so that the position of the pullout tray 62 can be fixed at a predetermined position with respect to the main-body frame 65.

As illustrated in FIG. 14, a drive gear 75 that is driven by a driving device is arranged on the end portion of the main-body frame 65 on the front side in the figure. The drive gear 75 is engaged with the transmission gear 74 when the pullout tray 62 is housed in the apparatus main body and positioned in the main-body frame 65.

Figure 16:
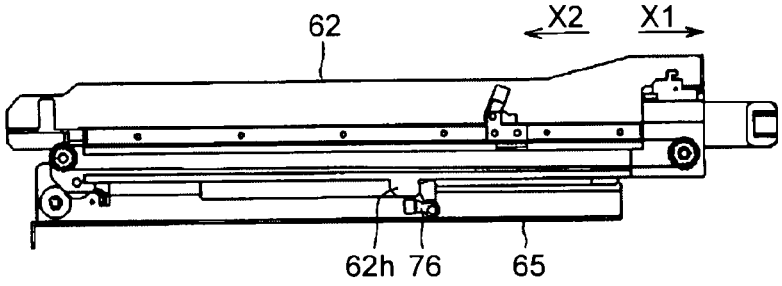
FIG. 16 is a cross-sectional side view of the main-body frame and the pullout tray.

As illustrated in FIG. 16, a pressing member 76 for pressing and fixing the pullout tray 62 is arranged on the main-body frame 65. In the first embodiment, the pressing member 76 is formed as a combination of two levers. When the pullout tray 62 is moved in the housing direction X2, a convex portion 62*h* arranged on the bottom surface of the pullout tray 62 is sandwiched and pressed by the two levers so that the pullout tray 62 is pushed toward the first positioning concaves 65*b* side and the second positioning concaves 65*c* side so that the position of the pullout tray 62 can be fixed.

Figure 17:
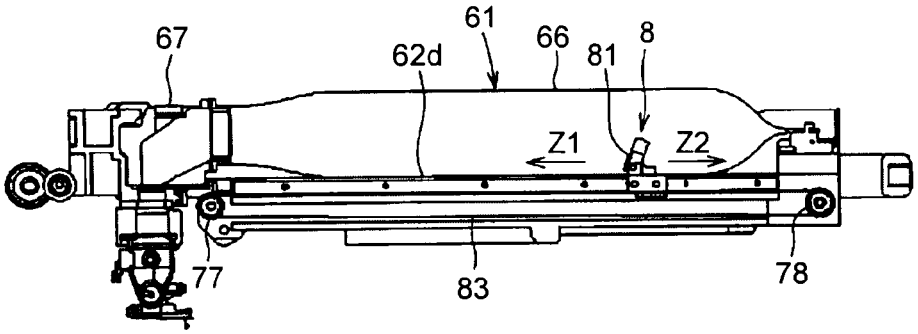
FIG. 17 is a cross-sectional side view of the pullout tray and components.

As illustrated in FIG. 17, a toner conveying apparatus (a powder conveying apparatus) 8 for conveying toner in the toner containing unit 66 toward the discharging unit 67 side is arranged on the pullout tray 62. The configuration of the toner conveying apparatus 8 will be described in detail below with reference to FIGS. 17 to 20.

Figure 18:
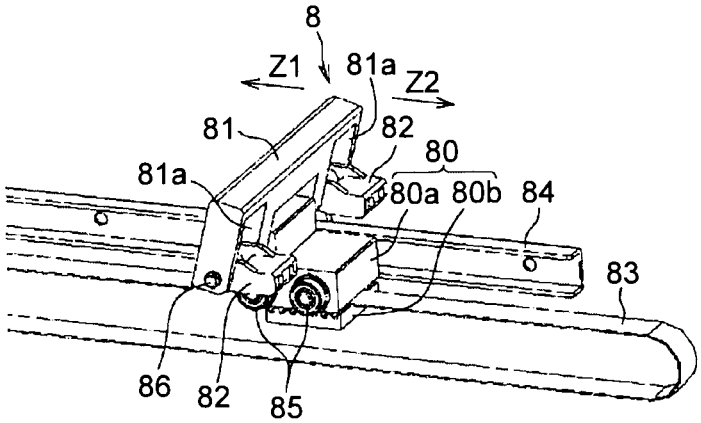
FIG. 18 is a configuration diagram of a toner conveying apparatus.

As illustrated in FIG. 18, the toner conveying apparatus 8 includes a base member 80; a delivery member 81 and a pair of leg members 82, which are attached to the base member 80; a belt member 83 as a moving means for moving the base member 80; and a pair of guide rails 84 as guide members for guiding the base member 80. In FIG. 18, illustration of the guide rail 84 on the front side is omitted.

The base member 80 is divided into an upper portion 80*a* and a lower portion 80*b*. The upper portion 80*a* and the lower portion 80*b* sandwich the belt member 83 so that the base member 80 is attached to the belt member 83. The belt member 83 is an endless belt and stretched between two rollers 77 and 78 (see FIG. 17) arranged on the pullout tray 62. The belt member 83 rotates both in the forward direction and the reverse direction upon transmission of a driving force from the transmission gear 74 (see FIG. 13) to the roller 77. By rotating the belt member 83 in the forward direction and in the reverse direction, the base member 80 can reciprocate in a delivery direction Z1 toward the discharging unit 67 and a return direction Z2 opposite to the delivery direction, together with the delivery member 81 and the leg members 82 attached to the base member 80.

Two rollers 85 as rotary members that roll on the guide rails 84 are arranged on each of the side surfaces of the base member 80. By arranging the rollers 85 on the base member 80, the base member 80 can smoothly move along the guide rails 84. The pair of the guide rails 84 is fixed to the pullout tray 62.

As illustrated in FIG. 18, the delivery member 81 and the leg members 82 are attached such that they can be opened or closed with respect to each other about a horizontal support shaft 86. More specifically, the delivery member 81 and the leg members 82 can separately rotate about the support shaft 86. When the delivery member 81 or the leg members 82 rotate about the support shaft 86, the delivery member 81 and the leg members 82 are opened or closed with respect to each other. The delivery member 81 and the leg members 82 are biased by a torsion coil spring as a biasing member (not illustrated) in a direction in which the delivery member 81 and the leg members 82 are opened with respect to each other. Housing concaves 81*a* for housing the leg members 82 when the leg members 82 are closed are formed on the delivery member 81.

Figure 19:
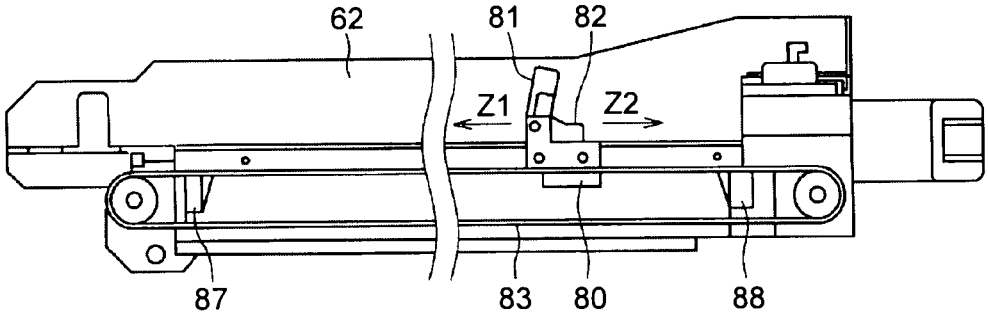
FIG. 19 is a cross-sectional side view of the pullout tray.

The rotation direction of the belt member 83 is switched by two switches 87 and 88 illustrated in FIG. 19. The switches 87 and 88 as moving-direction switching means are arranged at respective moving-direction switching positions of the delivery member 81. More specifically, the switch 87 is arranged on one end (a left end in the figure) in the delivery direction Z1 of the pullout tray 62 and the switch 88 is arranged on the other end (a right end in the figure) in the return direction Z2 of the pullout tray 62. When the delivery member 81 reaches one of the moving-direction switching positions, the base member 80 comes into contact with the switch 87 or the switch 88 arranged at this position. That is, the base member 80 functions as an input means that turns on the switch 87 or the switch 88 by coming into contact with the switch 87 or the switch 88. As described above, the moving direction of the delivery member 81 is switched between the delivery direction Z1 and the return direction Z2 by bringing the base member 80 into contact with the switch 87 or the switch 88, so that the toner delivery operation can be continuously performed. It is possible to arrange a non-contact sensor instead of the contact sensor such that the sensor is turned on when a to-be-detected portion (an input means) arranged on the base member 80 is brought close to the non-contact sensor.

Figure 20:
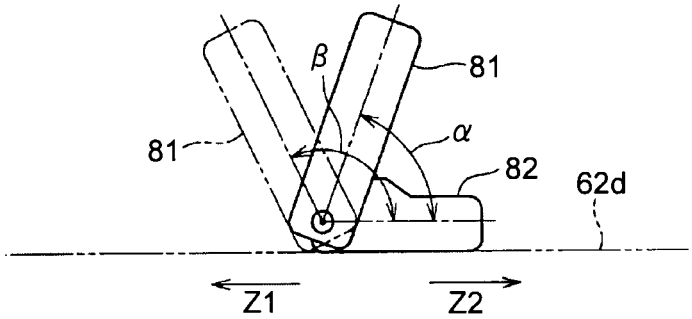
FIG. 20 is a side view of a delivery member and a leg member.

FIG. 20 is a side view of the delivery member 81 and the leg members 82.

As illustrated in FIG. 20, the leg members 82 come into contact with the placement surface 62*d* of the pullout tray 62 and can reciprocate in the delivery direction Z1 and the return direction Z2 along the placement surface 62*d*. That is, the placement surface 62*d* also has a function as a guide surface for guiding the leg members 82. As described above, the delivery member 81 and the leg members 82 are biased by the torsion coil spring so that the delivery member 81 and the leg members 82 are opened with respect to each other. The leg members 82 are supported horizontally by contact with the placement surface 62*d*. The delivery member 81 is biased so that the delivery member 81 rotates in the delivery direction Z1 (to the discharging unit 67 side) and is opened with respect to the horizontally-supported leg members 82. A regulating unit, such as a stopper (not illustrated), regulates the rotation of the delivery member 81 in the opening direction against the biasing force applied by the torsion coil spring. Therefore, the delivery member 81 is supported so as to stand with respect to the placement surface 62*d* (the state indicated by a bold line in the figure). As described above, the placement surface 62*d* and the regulating unit maintain an opening angle between the delivery member 81 and the leg members 82 to a predetermined angle α so that the delivery member 81 can be in a predetermined standing state with respect to the placement surface 62*d*.

An opening angle β in FIG. 20 is an angle obtained when the delivery member 81 is not regulated by the regulating unit. That is, the angle β is an opening angle obtained when the torsion coil spring is in a normal state. As illustrated in FIG. 20, the opening angle β maintained by the torsion coil spring in the normal state is set in a range greater than the opening angle α, at which the delivery member 81 is in the predetermined standing state, and smaller than 180°.

As illustrated in FIG. 6A, concave portions 62*i* and 62*j* in which the leg members 82 can be inserted are arranged on respective end portions in the directions (the delivery direction Z1 and the return direction Z2) in which the leg members 82 reciprocate on the placement surface 62*d*. In the first embodiment, by arranging the concave portions 62*i* and 62*j*, the delivery member 81 can be switched between a standing state and a laid state with respect to the placement surface 62*d*.

The operations of switching the delivery member 81 between the standing state and the laid state will be described below with reference to FIGS. 21A to 21D and 22A to 22D.

Figure 21A:
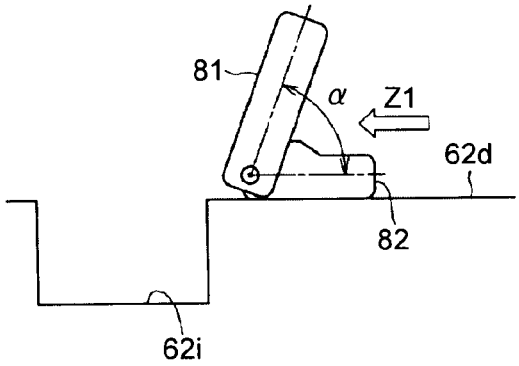
FIGS. 21A to 21D are diagrams for explaining operations for switching the delivery member from a standing state to a laid state.

FIG. 21A illustrates a state before the delivery member 81 reaches the concave portions 62*i* that are arranged on the end side in the delivery direction Z1. In this state, the opening angle between the delivery member 81 and the leg members 82 is maintained at the predetermined angle α by the regulating unit (not illustrated) and the placement surface 62*d*, and the delivery member 81 is in the predetermined standing state with respect to the placement surface 62*d*.

Figure 21B:
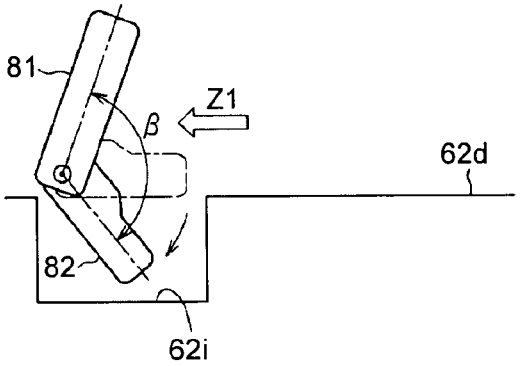

As illustrated in FIG. 21B, when the delivery member 81 moves in the delivery direction Z1 and the leg members 82 reach the positions of the concave portions 62*i*, because the placement surface 62*d* that supports the leg members 82 is not present at this position, the leg members 82 are opened downward because of the biasing force applied by the torsion coil spring (not illustrated). Therefore, the leg members 82 enter the concave portions 62*i*. The opening angle between the delivery member 81 and the leg members 82 at this time is the angle β that is the angle maintained when the torsion coil spring is in the normal state.

When the delivery member 81 reaches the positions of the concave portions 62*i*, the base member 80 comes into contact with the switch 87 illustrated in FIG. 19, so that the moving direction of the delivery member 81 is switched.

Figure 21C:
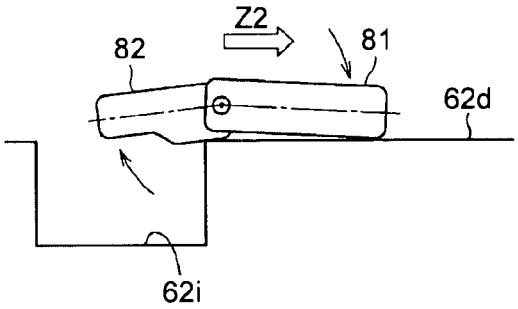

As illustrated in FIG. 21C, when the moving direction is switched and the delivery member 81 moves in the return direction Z2, the leg members 82 come into contact with the edges of the concave portions 62*i* (near the opening) and the tips of the leg members 82 are lifted upward. When the leg members 82 are lifted upward and rotate further in the opening direction, the opening angle becomes greater than the angle β. Therefore, the biasing force applied by the torsion coil spring acts in the closing direction. As a result, the delivery member 81 receives a biasing force in the closing direction and is laid on the placement surface 62*d*.

Figure 21D:
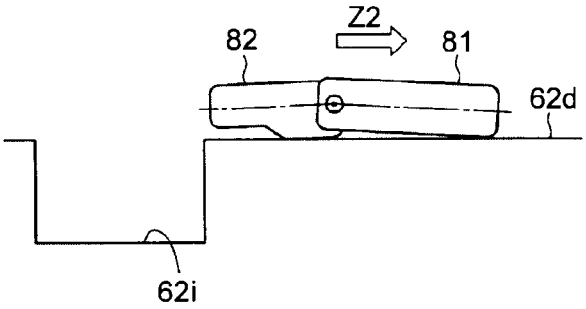

As illustrated in FIG. 21D, when the leg members 82 are separated from the concave portions 62*i*, the delivery member 81 and the leg members 82 are laid horizontally on the placement surface 62*d*. More specifically, the opening angle between the delivery member 81 and the leg members 82 is nearly 180°, so that the delivery member 81 and the leg members 82 are biased in the closing directions by the torsion coil spring. However, because the rotation of the delivery member 81 and the leg members 82 is regulated by the placement surface 62*d*, the delivery member 81 and the leg members 82 are kept laid horizontally. The delivery member 81 and the leg members 82 are configured so that they are not opened by 180° or greater.

Figure 22A:
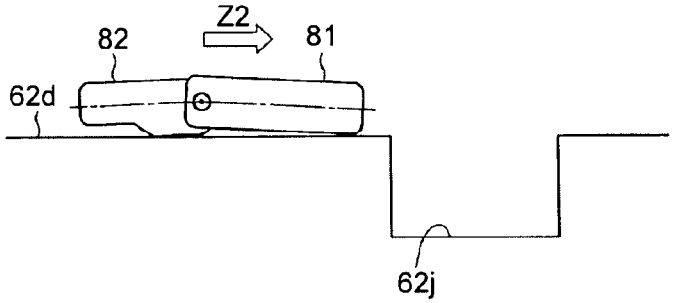
FIGS. 22A to 22D are diagrams for explaining operations for switching the delivery member from the laid state to the standing state.

FIG. 22A illustrates a state before the delivery member 81 being laid in the above manner reaches the concave portions 62*j* that are arranged on the end side in the return direction Z2. In this state, similarly to the state in FIG. 21D, the delivery member 81 and the leg members 82 are opened by nearly 180° and are laid horizontally on the placement surface 62*d*.

Figure 22B:
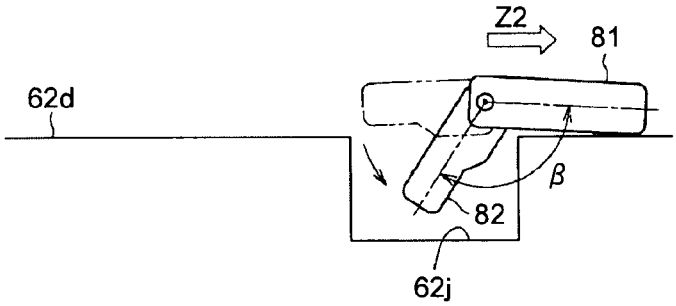

As illustrated in FIG. 22B, when the leg members 82 reach the positions of the concave portions 62*j*, because the placement surface 62*d* that supports the leg members 82 is not present at these positions, the leg members 82 are closed downward because of a biasing force applied by the torsion coil spring and enter the concave portions 62*j*. The opening angle between the delivery member 81 and the leg members 82 at this time is the angle β that is the angle maintained when the torsion coil spring is in the normal state. The delivery member 81 is configured so that it cannot enter the concave portions 62*j*; therefore, the delivery member 81 passes over the concave portions 62*j*.

When the delivery member 81 reaches the positions of the concave portions 62*j*, the base member 80 comes into contact with the switch 88 illustrated in FIG. 19, so that the moving direction of the delivery member 81 is switched.

Figure 22C:
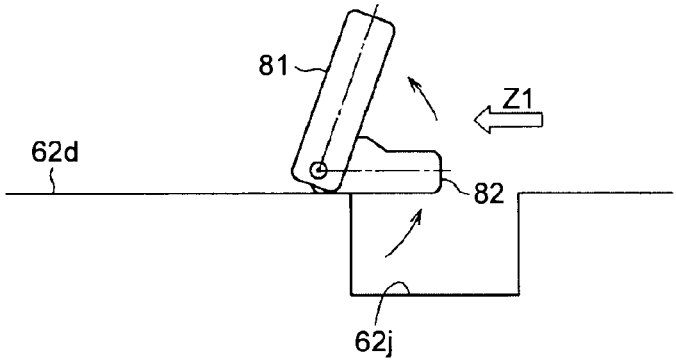

As illustrated in FIG. 22C, when the moving direction is switched and the delivery member 81 moves in the delivery direction Z1, the leg members 82 come into contact with edges of the concave portions 62*j* (near the opening) and the tips of the leg members 82 are lifted upward. When the leg members 82 are lifted upward and rotate further in the closing direction, the opening angle becomes smaller than the angle β. Therefore, the biasing force applied by the torsion coil spring acts in the opening direction. As a result, the delivery member 81 receives a biasing force in the opening direction and is caused to stand.

Figure 22D:
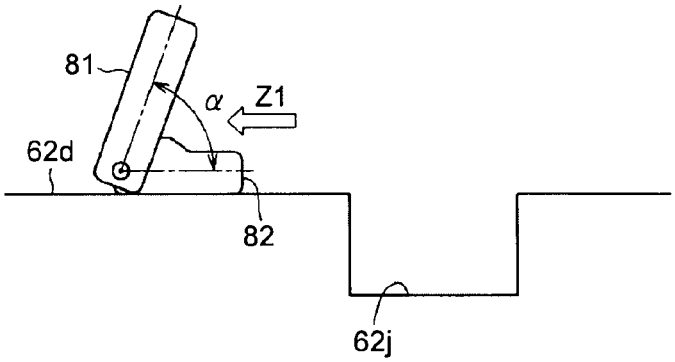

As illustrated in FIG. 22D, when the leg members 82 are separate from the concave portions 62*j*, the delivery member 81 is maintained in the standing state at the predetermined opening angle α.

A toner delivery operation (a conveying operation) by the toner conveying apparatus 8 according to the present embodiment will be described below with reference to FIGS. 23A to 23C.

Figure 23A:
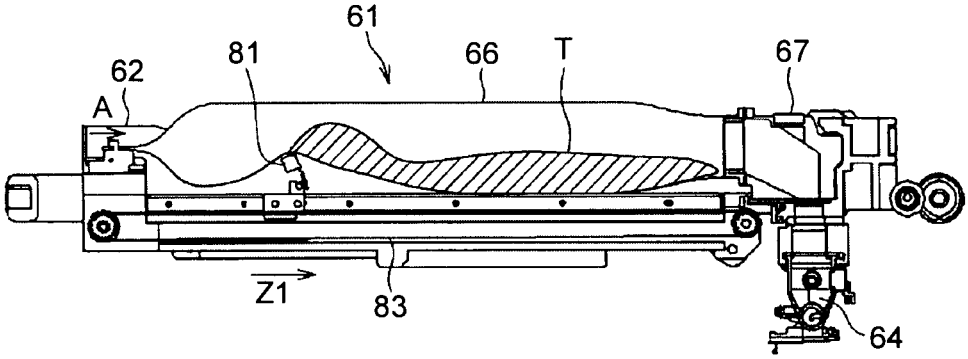
FIGS. 23A to 23C are diagrams for explaining toner delivery operations.
Figure 23B:
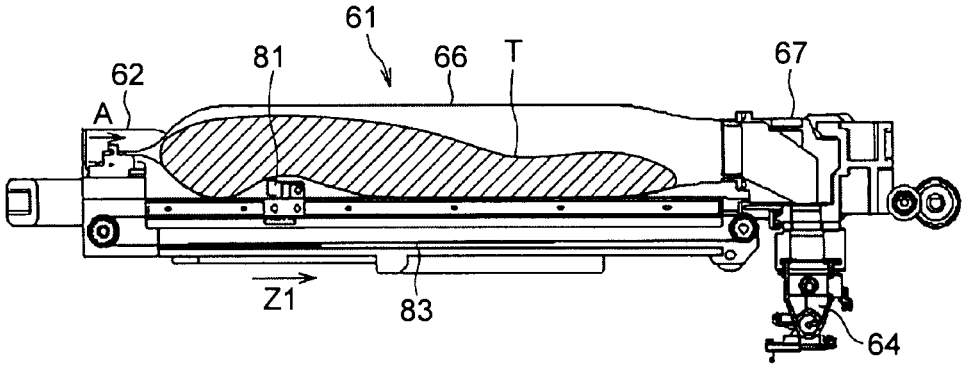
Figure 23C:
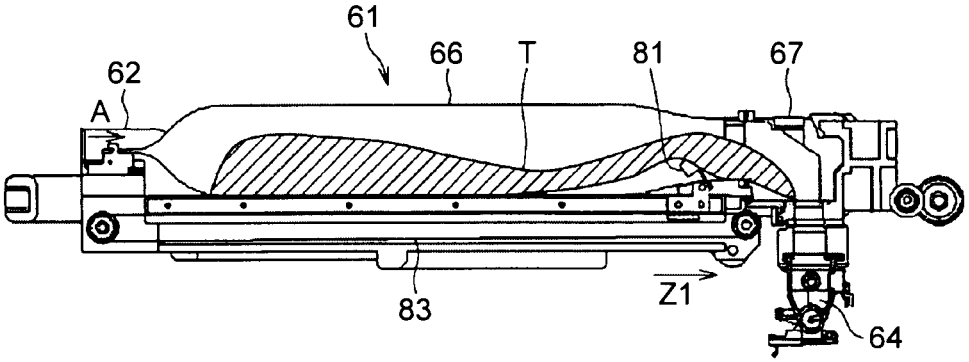

In FIGS. 23A to 23C, the toner cartridge 61 is attached to the pullout tray 62 and the pullout tray 62 is housed in the apparatus main body. Therefore, a driving device of the apparatus main body can transmit a driving force to the belt member 83 to reciprocate the delivery member 81.

FIG. 23A illustrates a state in which the remaining amount of toner T in the toner containing unit 66 is relatively reduced.

In this case, the delivery member 81 is standing because of the biasing force applied by the torsion coil spring. Therefore, the bottom surface of the toner containing unit 66 is pushed inward by the standing delivery member 81. The delivery member 81 moves in the delivery direction Z1 while pushing the toner containing unit 66 inward, so that the toner T is pushed and moved toward the discharging unit 67 by the delivery member 81. The toner T that is moved toward the discharging unit 67 side is discharged downward from the discharging unit 67 by the inertia force and weight thereof and then introduced into the sub hopper 64. Furthermore, because the inclined surface 67*c* (see FIG. 4D) is arranged on the discharging unit 67, the toner T slides along the inclined surface 67*c* and is smoothly discharged. Moreover, the oscillation applying unit applies small oscillation to the discharging unit 67, so that it is possible to accelerate the discharge of the toner T from the discharging unit 67 and prevent adhesion of the toner T to the discharging unit 67.

FIG. 23B illustrates a state in which the toner containing unit 66 contains a large amount of toner T.

In an area where a large amount of toner T is present inside the toner containing unit 66, the toner containing unit 66 becomes harder because of the stack of the toner T and becomes heavier because of the weight of the toner T. Therefore, as illustrated in FIG. 23B, the delivery member 81 is in the laid state and the amount of push by the delivery member 81 against the toner containing unit 66 becomes small. The delivery member 81 moves in the delivery direction Z1 while the delivery member remains laid in an area where a large amount of the toner T is present. Thereafter, when the delivery member 81 reaches a position near the discharging unit 67 where the amount of the toner T is relatively small, the delivery member 81 stands and the amount of push by the delivery member 81 is increased as illustrated in FIG. 23C. As described above, because the delivery member 81 stands and the amount of push is increased near the discharging unit 67, the toner T that can be discharged in sequence from toner that can be easily moved near the discharging unit 67.

As described above, according to the first embodiment, the amount of push by the delivery member 81 changes in accordance with the amount of the toner in the toner containing unit 66. Therefore, it is possible to stably and reliably convey the toner to the discharging unit 67 regardless of the amount of the toner remaining inside the toner containing unit 66.

It is possible to adjust the pushing force of the delivery member 81 to an appropriate value by appropriately changing a biasing force, which is applied to the delivery member 81 by the torsion coil spring, depending on the material (flexibility or the like) or the maximum toner capacity of the toner containing unit 66. In this case, even when the biasing force applied by the torsion coil spring is increased, because the rotation of the delivery member 81 can be regulated by the regulating unit (not illustrated) in the first embodiment, it is possible to maintain the predetermined standing state of the delivery member 81.

Figure 24:
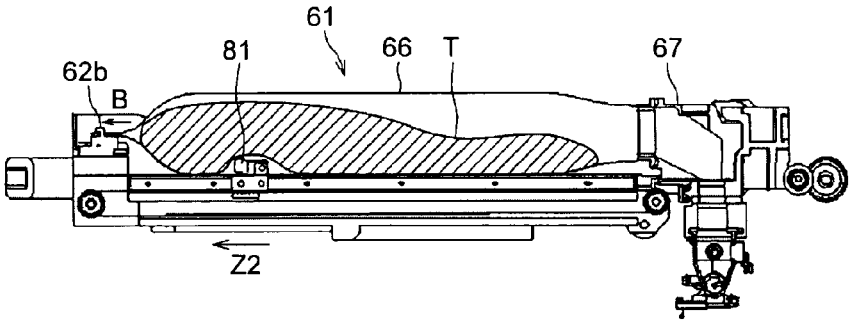
FIG. 24 is a diagram for explaining an operation for returning the delivery member.

As illustrated in FIG. 24, when the delivery member 81 is returned to the initial position, the delivery member 81 is switched to the laid state. Therefore, it is possible to prevent the toner from being backward by the delivery member 81 moving in the return direction Z2. Furthermore, as described with reference to FIGS. 21A to 21D and 22A to 22D, the operation of switching the delivery member 81 between the standing state and the laid state can be realized by a simple mechanism in which the leg members 82 are inserted into the concave portions 62*i* or the concave portions 62*j*. Therefore, it is possible to simplify the overall configuration. It may be possible to use through holes instead of the concave portions 62*i* and 62*j*.

As illustrated in FIGS. 23A to 23C, the delivery member 81 pushes the toner containing unit 66 toward the discharging unit 67 when the delivery member 81 moves at the time of the toner delivery operation. Accordingly, the hook portion 62*b* with which the end portion of the toner containing unit 66 is engaged is pulled and moved toward the discharging unit 67 side (in the direction of an arrow A in the figures). In this manner, in the first embodiment, the hook portion 62*b* moves as the toner containing unit 66 is pushed, so that it becomes possible to prevent a sudden increase in the load on the toner containing unit 66 when the delivery member 81 pushes the toner containing unit 66. Therefore, it is possible to suppress wear damage of the toner containing unit 66.

Thereafter, as illustrated in FIG. 24, when the delivery member 81 is returned, the hook portion 62*b* is pulled back to the direction opposite to the discharging unit 67 (in the direction of an arrow B in the figure) by the torsion coil spring 62*k* (see FIG. 6A). Therefore, the toner containing unit 66 is maintained at a predetermined position.

In the first embodiment, the sub hopper 64 is arranged below the discharging unit 67 such that the toner discharged from the discharging unit 67 is temporarily accumulated in the sub hopper 64 and then conveyed from the sub hopper 64 to the developing device. This configuration is made to address the situation in which, when the toner is directly conveyed from the discharging unit 67 to the developing device without through the sub hopper 64, the toner cannot be supplied with high accuracy because the toner is intermittently discharged from the discharging unit 67. Therefore, in the first embodiment, the sub hopper 64 is arranged so that the toner can be supplied to the developing device with higher accuracy. As a means for conveying the toner from the sub hopper 64 to the developing device, it is possible to use free fall due to the gravity or a known conveying means, such as a screw, a coil, or a pump. With the sub hopper 64, it becomes also possible to prevent the toner from leaking through the screw or the coil that is the conveying means.

Furthermore, in the first embodiment, the entire toner containing unit 66 is formed of a deformable member, so that the used toner containing unit 66 can be folded up compactly. Therefore, it becomes possible to reduce environmental loads associated with collection, delivery, or reuse. It is also possible to form only a portion of the toner containing unit 66, such as a portion to be pushed by the delivery member 81, by using a deformable member.

Moreover, in the first embodiment, the discharging unit 67 is caused to oscillate at the frequency of 30 Hz and the amplitude of 0.3 mm. The frequency and the amplitude depend on the types of toner to be used. However, preferable ranges of the frequency and the amplitude are 10 to 100 Hz for the frequency and 0.1 to 1 mm for the amplitude. When the frequency is lower than 10 Hz or when the amplitude is smaller than 0.1 mm, the effect to accelerate the toner discharge and to prevent adhesion of toner to the discharging unit 67 is lowered. On the other hand, when the frequency is higher than 100 Hz or when the amplitude is greater than 1 mm, the oscillation becomes too large, so that the image forming apparatus itself may oscillate and image formation may be influenced by the oscillation. Therefore, in the first embodiment, the frequency and the amplitude are set to be in the above ranges in order to prevent the influence on the image formation and to exert the effect of the toner discharge acceleration and the toner adhesion prevention in a desirable manner.

Figure 25:
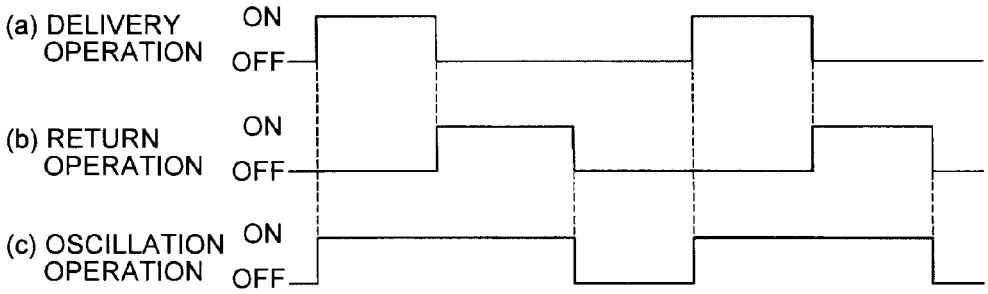
FIG. 25 is a diagram illustrating an example of an operation timing chart of the delivery member and an oscillation applying unit.

FIG. 25 is a diagram illustrating an example of an operation timing chart of the delivery member and the oscillation applying unit.

FIG. 25(*a*) is a timing chart of ON/OFF of the delivery operation of the delivery member 81 and FIG. 25(*b*) is a timing chart of ON/OFF of the return operation of the delivery member 81. The delivery member 81 moves toward the discharging unit 67 side during the ON-state in FIG. 25(*a*) and moves toward the opposite side of the discharging unit 67 during the ON-state in FIG. 25(*b*). FIG. 25(*c*) is a timing chart of ON/OFF of driving of the oscillation applying unit.

In this example, both in the delivery operation and in the return operation, the oscillation is applied to the discharging unit 67 by switching the oscillation applying unit into the ON-state. In this manner, the oscillation applying unit is driven in synchronization with the movement of the delivery member 81, so that even if toner is present in the discharging unit 67 when the delivery member 81 moves toward the discharging unit 67 side (at the time of the delivery operation), the toner can be loosened by the oscillation applied by the oscillation applying unit and a space is generated between toner particles. Therefore, a force that may compress the toner can hardly be applied by the delivery operation. Consequently, it becomes possible to prevent toner blocking and to smoothly discharge the toner from the discharging unit 67. Furthermore, the toner pushed by the delivery member 81 can be loosened by the oscillation, so that it becomes possible to stabilize the volume of the toner to be conveyed, enabling to increase the stability of the toner conveyance.

It may be possible to separately drive the delivery member 81 and the oscillation applying unit by using different driving means when the delivery member 81 and the oscillation applying unit are driven in synchronization with each other. However, by driving the delivery member 81 and the oscillation applying unit by using a common driving means, it becomes possible to reduce costs. When the common driving means is used, it becomes possible to drive the delivery member 81 and the oscillation applying unit in synchronization with each other without specially controlling the driving means.

Meanwhile, whether the toner is easily accumulated or not depends on the amount of toner in the toner containing unit 66 or the flowability of the toner. Specifically, when a large amount of toner remains in the toner containing unit 66 or when the flowability of the toner is low due to high temperature and humidity in the surrounding environment, the toner is easily aggregated by the pressure applied by the delivery member 81. Therefore, when the toner is in the state in which the toner is easily aggregated, it is preferable to generate the oscillation both in the delivery operation and in the return operation as described above in order to ensure the smooth toner conveyance.

Figure 26:
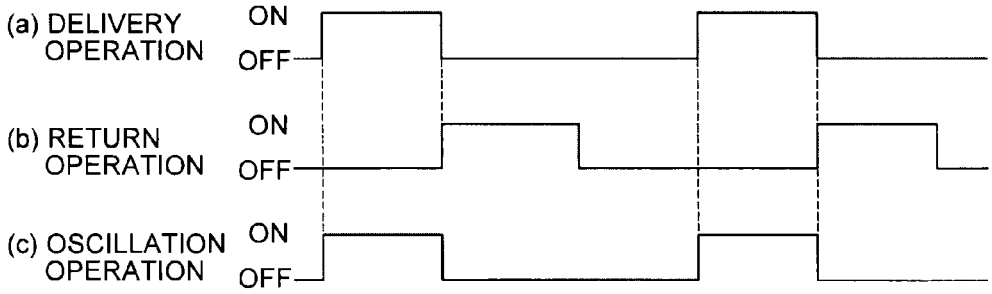
FIG. 26 is a diagram illustrating another example of the operation timing chart.

However, when the amount of the toner in the toner containing unit 66 is small and if the oscillation is applied to the discharging unit 67 at the time of the return operation, the stack of the toner generated at the time of the delivery operation collapses and the toner is spread out and returned from the discharging unit 67 to the toner containing unit 66, so that the amount of the toner to be conveyed may be reduced. Therefore, when the amount of the toner is small, as illustrated in the timing charts in FIG. 26, it is preferable to switch the oscillation applying unit into the OFF-state at the time of the return operation. As described above, when the amount of the toner is small, the oscillation is applied only at the time of the delivery operation and is not applied at the time of the return operation. Consequently, it becomes possible to prevent degradation in the toner conveyance capability due to the collapse of the stack of the toner at the discharging unit 67.

Figure 27:
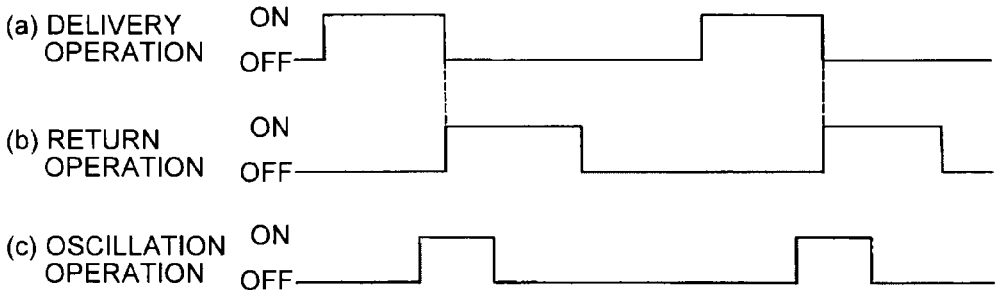
FIG. 27 is a diagram illustrating still another example of the operation timing chart.

When the flowability of the toner is high, it is not so necessary to assist the toner conveyance by the oscillation. Therefore, when the flowability of the toner is high, as illustrated in FIG. 27, it is possible to smoothly discharge the toner from the discharging unit 67 by driving the oscillation applying unit only when the delivery member 81 moves near the discharging unit 67. As described above, by driving the oscillation applying unit at a necessary timing, it becomes possible to reduce consumption of unnecessary driving energy.

It may also be possible to provide a toner-amount detecting means (a powder-amount detecting means) for detecting the amount of toner in the toner containing unit 66 or a toner-flowability detecting means (a powder-flowability detecting means) for detecting the flowability of the toner, and change the driving timing of the oscillation applying unit on the basis of detected information (the amount of the toner or the flowability of the toner).

Figure 28A:
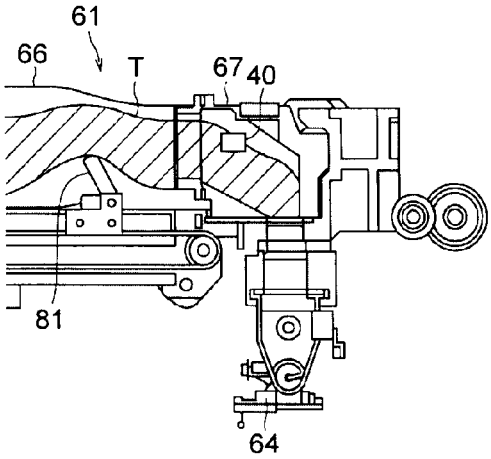
FIG. 28A is a diagram illustrating a state in which a toner sensor is arranged in the discharging unit of the embodiment and a large amount of toner is remaining in the toner container.
Figure 28B:
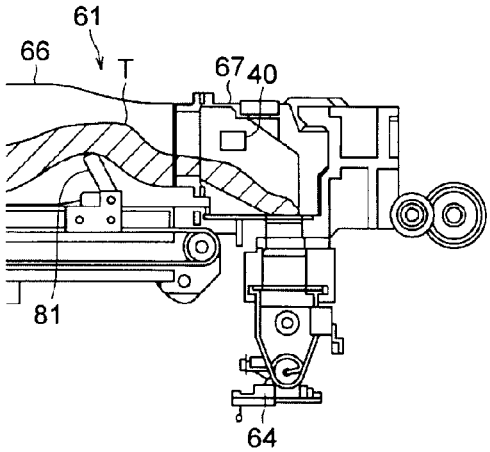
FIG. 28B is a diagram illustrating a state in which the toner sensor is arranged in the discharging unit of the embodiment and a small amount of toner is remaining in the toner container.

For example, as illustrated in FIGS. 28A and 28B, a toner sensor 40 as the toner-amount detecting means is arranged in the discharging unit 67 and presence or absence of toner is detected by using the toner sensor 40 when the toner T is conveyed to the discharging unit 67 by the delivery member 81. As illustrated in FIG. 28A, when the toner sensor 40 detects the toner T, because a large amount of toner T remains in the toner containing unit 66, the oscillation applying unit is driven even when the delivery member 81 is returned as illustrated in the timing chart of FIG. 25. On the other hand, when the toner sensor 40 does not detect the toner T as illustrated in FIG. 28B, because the amount of toner in the toner containing unit 66 is small, the driving of the oscillation applying unit is stopped when the delivery member 81 is returned as illustrated in the timing chart of FIG. 26. As described above, by automatically detecting the amount of the toner and changing the timing of the oscillation on the basis of the detection, it becomes possible to appropriately convey the toner depending on the amount of the toner.

As the toner-amount detecting means, a piezoelectric sensor or an optical sensor may be used. As the piezoelectric sensor, a particle level sensor of TSP 15 series produced by TDK Corporation may be used. When a transmissive optical sensor is used as the optical sensor, for example, a light-emitting unit and a light-receiving unit are arranged at opposite positions in the discharging unit 67. When toner blocks an optical path between the light-emitting unit and the light-receiving unit, it is detected that "toner is present". On the other hand, when the light is transmitted, it is detected that "toner is absent". To prevent the toner from remaining attached to the opposing surfaces of the light-emitting unit and the light-receiving unit, it is desirable to regularly remove attached toner by a cleaning member made of a film or the like.

As the toner-flowability detecting means, for example, a thermo-hygrometer may be used. The temperature and humidity around the apparatus is measured by the thermo-hygrometer and the driving timing of the oscillation applying unit is changed to the timing illustrated in FIG. 25 or the timing illustrated in FIG. 27 on the basis of the measurement result. Therefore, it becomes possible to automatically reduce a driving duration of the oscillation applying unit to reduce energy consumption when the flowability of the toner is high. Consequently, it becomes possible to appropriately convey the toner depending on the flowability of the toner.

As described above, according to the present invention, the driving of the oscillation applying unit is controlled depending on the operation of the delivery member, so that it is possible to efficiently cause the toner to flow. Therefore, it is possible to prevent packing or blocking of the toner, thereby enabling to smoothly and stably convey the toner. Furthermore, it is possible to reduce the amount of toner that ultimately remains in the toner containing unit, so that costs can be reduced. If the driving timing of the oscillation applying unit is changed depending on the amount of the toner in the toner containing unit or depending on the flowability of the toner, it becomes possible to appropriately convey the toner depending on various conditions.

The embodiment of the present invention is explained above. However, the present invention is not limited to the above embodiment. Various modifications may be made without departing from the scope of the general inventive concept of the present invention. For example, the toner containing unit 66 may be made of a transparent material, a translucent material, or an opaque material. Furthermore, the toner containing unit 66 may be colored in the same color as the toner contained therein.

It is also possible to increase the abrasion resistance of a bottom surface of the toner containing unit 66 (a contact surface of the delivery member 81) or form the bottom surface by using a thin film with a small coefficient of friction through various methods, such as PVD or CVD, in order to prevent abrasion of the bottom surface of the toner containing unit 66 due to the sliding contact with the delivery member 81. Alternatively, it is possible to arrange a mechanism that applies lubricant to at least one of the delivery member 81 and the toner containing unit 66 to reduce the friction therebetween in order to prevent abrasion.

It is also possible to form creases on the toner containing unit 66 in advance so that when the amount of toner contained in the toner containing unit 66 is reduced, the toner containing unit 66 can be folded up along the creases in accordance with the delivery operation of the delivery member 81. In this case, an operation of squashing the toner containing unit 66 is not needed when the used toner containing unit 66 is disposed, so that the convenience can be improved. Furthermore, the toner containing unit 66 can be easily deformed, so that the toner can be easily discharged.

It is also possible to apply the configuration of the embodiment to a powder conveying apparatus that conveys powder other than toner. The powder conveying apparatus according to the embodiment may be installed in other printers, copiers, facsimile machines, or multifunction peripherals having the functions of a printer, a copier, and a facsimile machine, instead of the printer illustrated in FIG. 1.

The toner used in the embodiment will be described in detail below.

Toner is mainly formed of a resin component, a pigment component, a wax component, and an external additive.

Examples of the resin include polystyrene resin, epoxy resin, polyester resin, polyamide resin, styrene acrylic resin, styrene-methacrylate resin, polyurethane resin, vinyl resin, polyolefin resin, styrene butadiene resin, phenolic resin, polyethylene resin, silicon resin, butyral resin, terpene resin, and polyol resin. Examples of the vinyl resin include homopolymer of styrene, such as polystyrene, poly-p-chlorostyrene, or polyvinyl toluene, or substitute of styrene; styrene copolymer, such as styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinyl methyl ether copolymer, styrene-vinyl ethyl ether copolymer, styrene-methyl vinyl ketone copolymer, styrene-butadiene copolymer, styrene-isoprene copolymer, styrene-acrylonitrile-indene copolymer, styrene-maleic acid copolymer, or styrene-maleic acid ether copolymer; polymethylmethacrylate; polybutylmethacrylate; polyvinyl chloride; and polyvinyl acetate.

The polyester resin is formed of dihydric alcohol as listed below in the group A and dibasic acid salts as listed below in the group B. It is possible to add trihydric alcohol or carboxylic acid as listed below in the group C, as a third component.

Group A: ethylene glycol; triethylene glycol; 1,2-propylene glycol; 1,3-propylene glycol; 1,4-butanediol; neopentyl glycol; 1,4-butenediol; 1,4-bis(hydroxymethyl)cyclohexane; bisphenol A; hydrogenated bisphenol A; polyoxyethylene bisphenol A; polyoxypropylene (2,2)-2,2'-bis(4-hydroxyphenyl)propane; polyoxypropylene (3,3)-2,2'-bis(4-hydroxyphenyl)propane; polyoxyethylene (2,0)-2,2-bis(4-hydroxyphenyl)propane; and polyoxypropylene (2,0)-2,2'-bis(4-hydroxyphenyl)propane.

Group B: maleic acid; fumaric acid; mesaconic acid; citraconic acid; itaconic acid; glutaconic acid; phthalic acid; isophthalic acid; terephthalic acid; cyclohexanedicarboxylic acid; succinic acid; adipic acid; sebacic acid; malonic acid; linolenic acid; and ester of acid anhydride of the above or ester of lower alcohol.

Group C: polyhydric alcohol containing at least three hydroxyl groups, such as glycerin, trimethylolpropane, or pentaerythritol; and polyvalent carboxylic acid containing at least three valences, such as trimellitic acid or pyromellitic acid. Examples of polyol resin include alkylene oxide adduct of epoxy resin and dihydric phenol; and a reactant of glycidyl ether, a compound that contains one active hydrogen that reacts with epoxy group in a molecule, and a compound that contains two or more active hydrogen that reacts with epoxy resin in a molecule.

The pigments used in the embodiment are listed below.

Examples of a black pigment include azine dyes, such as carbon black, oil furnace black, channel black, lamp black, acetylene black, or aniline black; metal salt azo dyes, metallic oxide, and combined metal oxide.

Examples of a yellow pigment include cadmium yellow, mineral fast yellow, nickel yellow, naples yellow, naphthol yellow S, hansa yellow G, hansa yellow 10G, benzidine yellow GR, quinoline yellow lake, permanent yellow NCG, and tartrazine lake.

Examples of an orange pigment include molybdenum orange, permanent orange GTR, pyrazolone orange, vulcan orange, indanthrene brilliant orange RK, benzidine orange G, and indanthrene brilliant orange GK.

Examples of a red pigment include colcothar, cadmium red, permanent red 4R, lithol red, pyrazolone red, watching red calcium salt, lake red D, brilliant carmine 6B, eosin lake, rhodamine lake B, alizarin lake, and brilliant carmine 3B.

Examples of a purple pigment include fast violet B and methyl violet lake.

Examples of a blue pigment include cobalt blue, alkaline blue, victoria blue lake, phthalocyanine blue, metal-free phthalocyanine blue, phthalocyanine blue partial chlorination product, fast sky blue, and indanthrene blue BC.

Examples of a green pigment include chrome green, chromium oxide, pigment green B, and malachite green lake.

It is possible to use one pigment or two or more pigments from among the above pigments. Particularly for color toner, it is necessary to uniformly disperse preferable pigments. Therefore, a system is employed in which a master batch with pigments dispersed at high concentrations is produced instead of directly introducing a large amount of pigments into resin, and the master batch is diluted and then introduced. In this case, solvent is generally used to accelerate the dispersion; however, in the embodiment, water is used for the dispersion in order to cope with the environmental problem or the like. When water is used, it is important to control a temperature in order to prevent the problem with remaining moisture in the master batch.

The toner of the embodiment contains a charge-controlling agent inside the toner particle (internal addition). The charge-controlling agent enables control of the optimal charge amount depending on a developing system. In particular, in the developing device to which the present invention is applied, it becomes possible to further stabilize a balance between the particle size distribution and the charge amount. As a substance that allows toner to have positive charge property, it is possible to use one of or a combination of two or more of the followings: nigrosine; quaternary ammonium salt; triphenylmethane dye; imidazole metal complex; or salts. As a substance that allows the toner to have negative charge property, salicylic acid metal complex, salts, organoboron salts, or calixarene compound is used.

It is possible to internally add a release agent to the toner of the embodiment in order to prevent offset at the time of photographic fixing. Examples of the release agent include natural waxes, such as candellia wax, carnauba wax, or rice wax; montan wax and derivative of montan wax; paraffin wax and derivatives of paraffin wax; polyolefin wax and derivatives of polyolefin wax; sasol wax; low-molecular-weight polyethylene; low-molecular-weight polypropylene; and alkylphosphorylated ester. The melting point of the release agent is preferably in a range from 65 to 90° C. When the melting point is lower than this range, the toner blocking easily occurs when the toner is stored. When the melting point is higher than this range, offset easily occurs in an area where a fixing temperature is low.

It is possible to add an additive agent in order to increase the dispersibility of the release agent. Examples of the additive agent include styrene acrylic resin, polyethylene resin, polystyrene resin, epoxy resin, polyester resin, polyamide resin, styrene methacrylate resin, polyurethane resin, vinyl resin, polyolefin resin, styrene butadiene resin, phenolic resin, butyral resin, terpene resin, and polyol resin. A combination of two or more substances from among the above may be used as the additive agent.

The resin may be crystalline polyester. Crystalline polyester is aliphatic polyester which has a crystal property and a sharp molecular weight distribution in which the absolute amount of lower molecular weight is maximized to the extent possible. This resin causes crystalline transformation at a glass transformation temperature (Tg), and at the same time, the melting viscosity is sharply reduced from the solid state, so that the fixation property to papers is expressed. With use of the crystalline polyester resin, it is possible to realize fixation at a low temperature without extremely reducing Tg of the resin or the molecular weight. Therefore, the preserving property is not reduced by the reduction in Tg. Furthermore, it is possible to prevent extreme glossiness due to the reduction in the molecular weight or prevent reduction in the offset resistance. Therefore, introducing the crystalline polyester resin is extremely advantageous to improve the toner fixability at a low temperature.

Regarding the toner, an inorganic fine powder as a flowability increasing agent may be added or fixed to the surface of the toner. The average diameter of the inorganic fine powder is preferably in a range form 10 to 200 [nm]. If the diameter is smaller than 10 [nm], it becomes difficult to generate surface irregularity that is advantageous in terms of the flowability. If the diameter is greater than 200 [nm], the shape of the powder becomes rough, which causes a problem with the shape of the toner.

Examples of the inorganic fine powder of the embodiment include oxide, hydroxide, carbonate, sulfate, and compound oxide of Si, Ti, Al, Mg, Ca, Sr, Ba, In, Ga, Ni, Mn, W, Fe, Co, Zn, Cr, Mo, Cu, Ag, V, or Zr. Among them, the following oxide is usually employed to ensure the safety and stability. That is, particles of silicon oxide (silica), titanium oxide, or aluminum oxide (alumina or corundum) are preferably used. It is also effective to perform surface modification treatment on the additive agent by using a hydrophobizing agent. A representative example of the hydrophobizing agent is a silane coupling agent as listed below.

Dimethyldichlorosilane, trimethylchlorosilane, methyltrichlorosilane, allyldimethyldichlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, hexaphenyldisilazane, and hexatolyldisilazane.

By performing the hydrophobizing treatment on the additive agent, moisture is not likely to be adsorbed to the surface of the additive agent that is a nano particle. Therefore, the stability of the toner is increased.

It is preferable that the 0.1 to 2 [weight %] of inorganic fine powder is used with respect to the toner. If the amount is smaller than 0.1 [weight %], the effect to ameliorate the toner aggregation is reduced. If the amount is greater than 2 [weight %], problems, such as toner dispersion between fine lines, contamination inside the apparatus, or damage or abrasion of the photosensitive element, easily occur.

It may be possible to add or fix a charge-controlling agent to the surface of a powder formed of at least resin and pigment so that the shape of the surface of the powder has a small pitch and a large pitch. A small particle with an average diameter of 5 to 200 [nm] is optimal.

It is possible to further add a small amount of other additive agents to the extent that does not practically cause adverse effect. Examples of the other additive agents include lubricant powder, such as Teflon (registered trademark) powder as organic powder, metal soap powder including stearic acid zinc powder, or polyvinylidene fluoride powder; abrasive agent, such as cerium oxide powder, silicon carbide powder, or strontium titanate powder; or a conductivity applying agent as a developing property improver, such as a conductive particle including carbon black powder, zinc oxide powder, tin oxide powder, or indium oxide powder, or an insulating powder coated with the conductive particle. The other additive agents may be used in a small amount as a developing property improver.

By adding the fine powder to the toner, the toner can be easily loosened when the delivery member 81 operates, so that even when the flowability of the toner is lowered because a toner supply operation is not performed for a while, it is possible to discharge the toner from a container.

Second Embodiment

A second embodiment will be explained below.

In the second embodiment, a locking member for locking a discharge port open-close member is provided. The locking member is arranged on the apparatus main body such that the locking member can be displaced between a locking position, at which a discharge port open-close member is locked, and a release position, to which the locking member is retracted from the locking position and at which the locking of the discharge port open-close member is released. The discharge port open-close member slides relative to the powder container along with the attachment/detachment operation of the powder container, to thereby open a powder discharge port and displace the locking member from the release position to the locking position to lock the discharge port open-close member. Furthermore, the powder discharge port reaches a position facing the discharge port open-close member along with a retraction operation of the powder container, so that the powder discharge port is closed by the discharge port open-close member. Thereafter, the locking member comes into contact with and is biased by the powder container so as to be displaced from the locking position to the release position, so that the locking of the discharge port open-close member by the locking member is released. Therefore, it becomes possible to provide a powder supply device and an image forming apparatus capable of successfully opening and closing the discharge port open-close member over time.

In the second embodiment described below, the basic configurations of the image forming apparatus, the image forming units, the toner supply device, and the toner cartridges are the same as those of the first embodiment. Therefore, the same components are denoted by the same reference numerals and the same explanation will not be repeated. Only configurations and operations specific to the second embodiment will be described below.

Figure 29A:
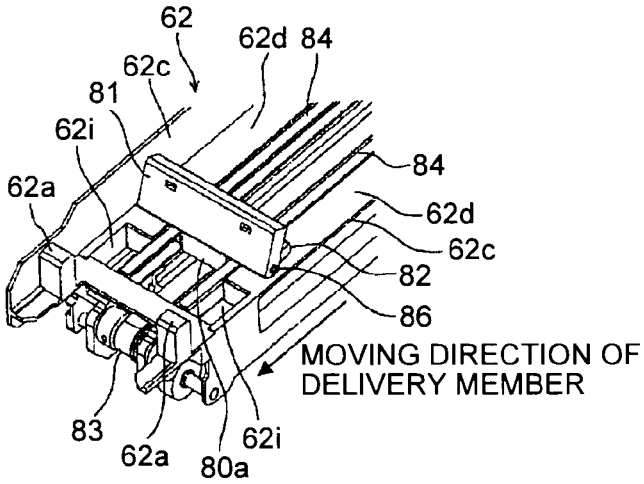
FIGS. 29A to 29C are perspective views of a pullout tray for explaining operations performed when a delivery member according to a second embodiment is switched from a standing state to a laid state.
Figure 29B:
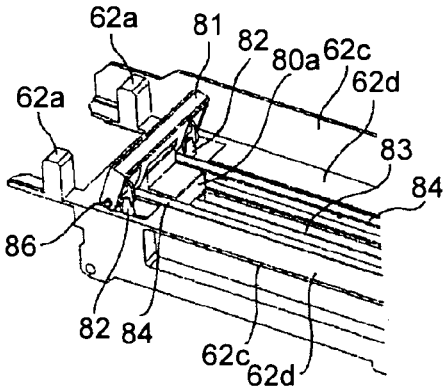
Figure 29C:
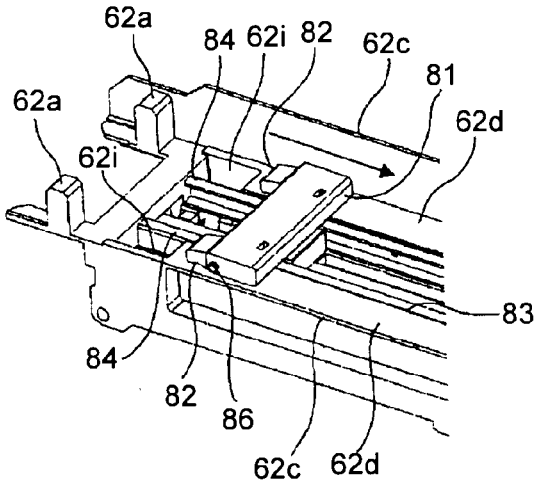

FIGS. 29A to 29C are perspective views of a pullout tray for explaining operations that are performed when a delivery member according to the second embodiment is switched from the standing state to the laid state. As explained above with reference to FIGS. 21A to 21D and 22A to 22D, the switching operation is performed to switch the delivery member 81 between the standing state and the laid state.

Figure 30A:
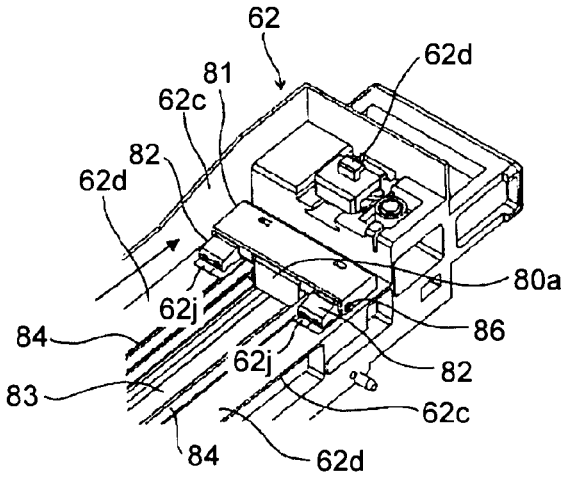
FIGS. 30A to 30C are perspective views of the pullout tray for explaining operations performed when the delivery member is switched from the laid state to the standing state.
Figure 30B:
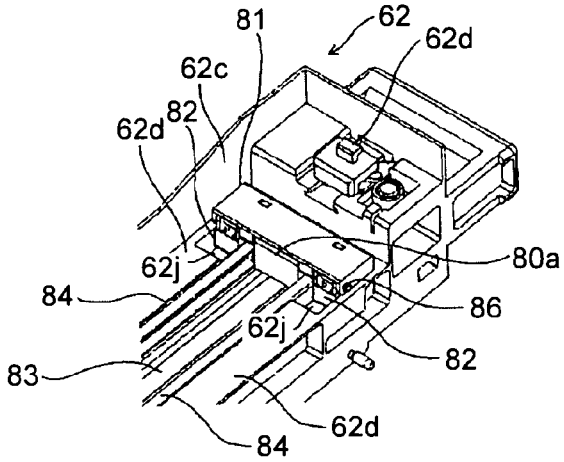

FIGS. 30A to 30B are perspective views of the pullout tray for explaining operations performed when the delivery member is switched from the laid state to the standing state.

As illustrated in FIG. 30A, when the leg members 82 reach the positions of the concave portions 62*j*, because the placement surface 62*d* that supports the leg members 82 is not present at these positions, the leg members 82 are closed downward because of a biasing force applied by the torsion coil spring and enter the concave portions 62*j* as illustrated in FIGS. 30B and 22B. The opening angle between the delivery member 81 and the leg members 82 at this time is an angle β that is the angle maintained when the torsion coil spring is in the normal state. The delivery member 81 is configured so that it cannot enter the concave portions 62*j*; therefore, the delivery member 81 passes over the concave portions 62*j*.

When the delivery member 81 reaches the positions of the concave portions 62*j*, the base member 80 comes into contact with the switch 88 illustrated in FIG. 19, so that the moving direction of the delivery member 81 is switched.

As illustrated in FIG. 22C, when the moving direction is switched and the delivery member 81 moves in the delivery direction Z1, the leg members 82 come into contact with edges of the concave portions 62*j* (near the opening) and the tips of the leg members 82 are lifted upward. When the leg members 82 are lifted upward and rotated further in the closing direction, the opening angle becomes smaller than the angle β. Therefore, the biasing force applied by the torsion coil spring acts in the opening direction. As a result, the delivery member 81 receives the biasing force in the opening direction and is caused to stand.

Figure 30C:
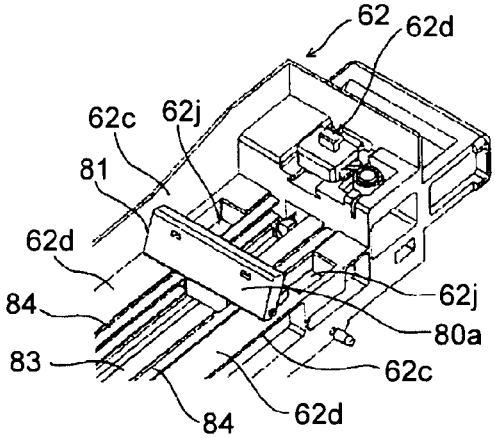

As illustrated in FIGS. 30C and 22D, when the leg members 82 are separated from the concave portions 62*j*, the delivery member 81 is maintained in the standing state at the predetermined opening angle α.

Furthermore, as illustrated in FIGS. 23A to 23C, the toner conveying apparatus 8 performs the toner delivery operation (the conveying operation).

As illustrated in FIGS. 23A to 23C, in an area where a large amount of the toner T is present inside the toner containing unit 66, the toner containing unit 66 becomes harder because of the stack of the toner T and becomes heavier because of the weight of the toner T. Therefore, as illustrated in FIG. 23B, the delivery member 81 is in the laid state and the amount of push by the delivery member 81 against the toner containing unit 66 becomes small. The delivery member 81 moves in the delivery direction Z1 while the delivery member remains laid in an area where a large amount of the toner T is present. Thereafter, when the delivery member 81 reaches a position near the discharging unit 67 where the amount of the toner T is relatively small, the delivery member 81 stands and the amount of push by the delivery member 81 is increased as illustrated in FIG. 23C. As described above, because the delivery member 81 stands and the amount of push is increased near the discharging unit 67, the toner T can be discharged in sequence from toner that can be easily moved near the discharging unit 67.

As described above, according to the second embodiment, similarly to the first embodiment, the amount of push by the delivery member 81 changes in accordance with the amount of toner in the toner containing unit 66. Therefore, it is possible to stably and reliably convey the toner to the discharging unit 67 regardless of the amount of toner remaining inside the toner containing unit 66. In particular, according to the second embodiment, it is possible to convey the toner with small stress, so that it is possible to prevent aggregation and deterioration of the toner. Furthermore, according to the second embodiment, large oscillation or shock can hardly occur, so that abnormal images can hardly be generated due to the oscillation.

It is possible to appropriately change the biasing force applied by the torsion coil spring to the delivery member 81, depending on the material (flexibility or retractility) or the maximum capacity of the toner containing unit 66, in order to adjust the pushing force of the delivery member 81 to an appropriate value. In this case, even if the biasing force applied by the torsion coil spring is increased, because the rotation of the delivery member 81 is regulated by a regulating unit (not illustrated) in the second embodiment, the delivery member 81 can be maintained in the predetermined standing state.

Furthermore, according to the second embodiment, the base member 80 comes into contact with the switch 87 or the switch 88 so that the moving direction of the delivery member 81 is switched between the delivery direction Z1 and the return direction Z2. Therefore, it is possible to continuously perform the toner delivery operation.

Moreover, when the delivery member 81 is returned to the initial position, the delivery member 81 is switched to the laid state, so that it is possible to prevent the toner from being returned by the delivery member 81 moving in the return direction Z2. Furthermore, as explained above with reference to FIGS. 19 and 20, the operation of switching the delivery member 81 between the standing state and the laid state 1 can be realized by a simple mechanism in which the leg members 82 are inserted into the concave portions 62*i* or the concave portions 62*j*. Therefore, it is possible to simplify the configuration. It may be possible to use through holes instead of the concave portions 62*i* and the concave portions 62*j*.

Furthermore, as explained above with reference to FIGS. 7A and 7B, according to the second embodiment, the rotation operation of the fixing arm 71 and the open-close operation of the slide shutter 67*d* can be performed in conjunction with the pullout/housing operation of the pullout tray 62 (the attachment/detachment operation to/from the fixing unit 63). Therefore, it is possible to easily perform the operations of fixing and releasing the toner cartridge 61 and the operations of opening and closing the discharge port, enabling to ensure good operability. The spring member 72 applies a force to the fixing arm 71 in a rotation direction by moving across the rotation fulcrum of the fixing arm 71 along with the rotation of the fixing arm 71. Therefore, it is possible to reliably hold the fixing arm 71 at the switched position by the biasing force. It is also possible to prevent backlash of the discharging unit 67 in the vertical direction because the protrusions 67*h* come into contact with the notch portion 70*a*. Therefore, it is possible to stabilize the fixed state of the toner cartridge 61. In the second embodiment, the toner containing unit 66 and the discharging unit 67 are integrally attached to and detached from the pullout tray 62. However, it is possible to fix the discharging unit 67 to the pullout tray 62 (or to the fixing unit 63) such that the toner containing unit 66 is attached to and detached from the discharging unit 67.

Figure 31:
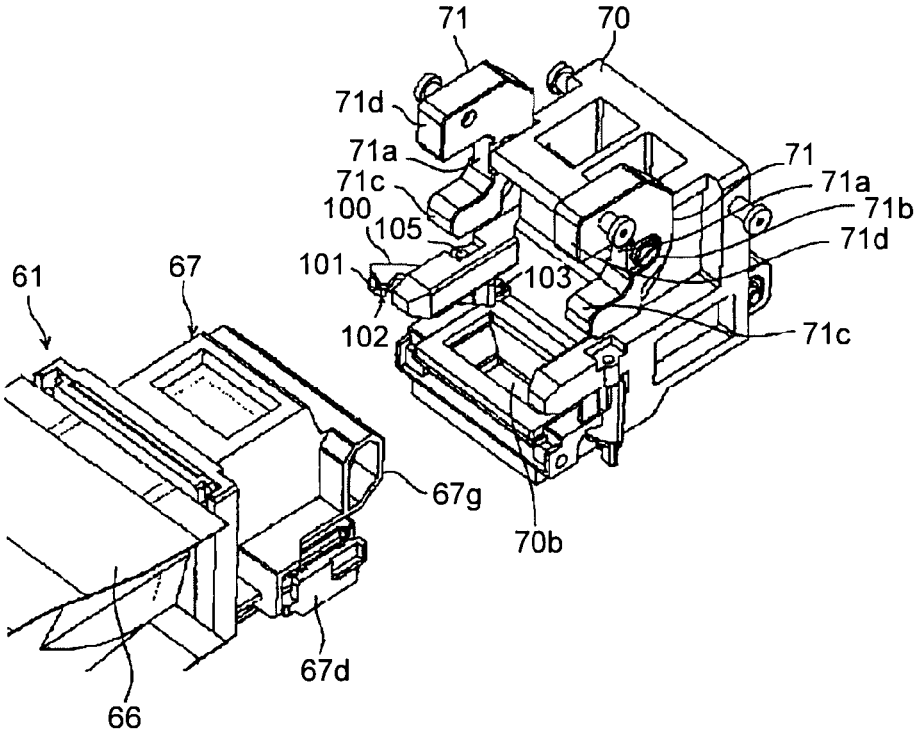
FIG. 31 is an upper perspective view of a main body of the toner supply device and the toner cartridge that are separate from each other, when viewed from obliquely above.
Figure 32:
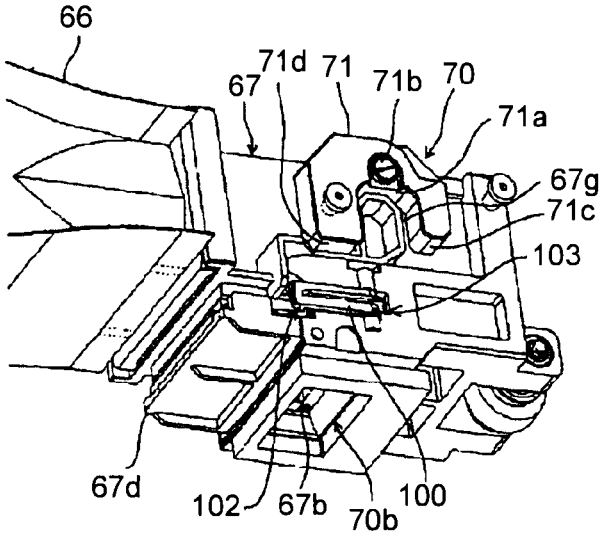
FIG. 32 is a lower perspective view of the main body of the toner supply device and the toner cartridge that are attached to each other, when viewed from obliquely below.
Figure 33:
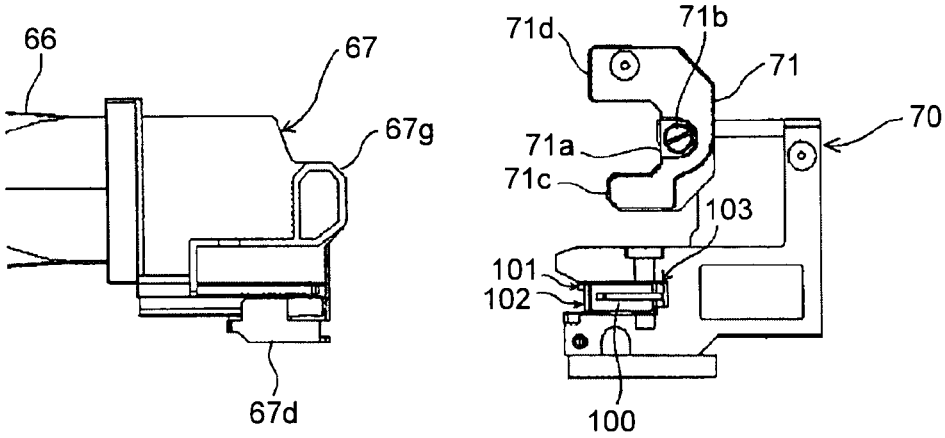
FIG. 33 is a side view of the main body of the toner supply device and the toner cartridge that are separate from each other, when viewed from side.
Figure 34:
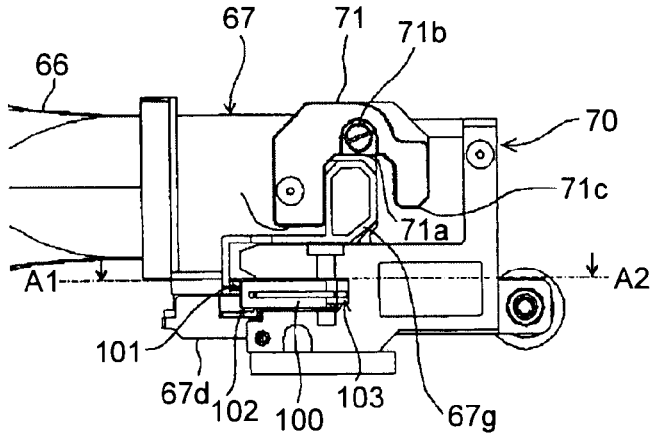
FIG. 34 is a side view of the main body of the toner supply device and the toner cartridge that are attached to each other, when viewed from side.
Figure 37:
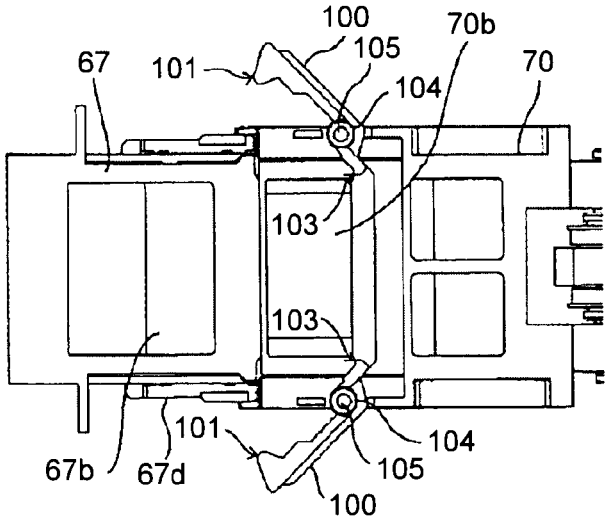
FIG. 37 is a top view of the main body of the toner supply device at a cross section taken along a line A1-A2 of FIG. 34 just before the discharging unit of the toner cartridge is attached to the main body, when viewed from above.
Figure 38:
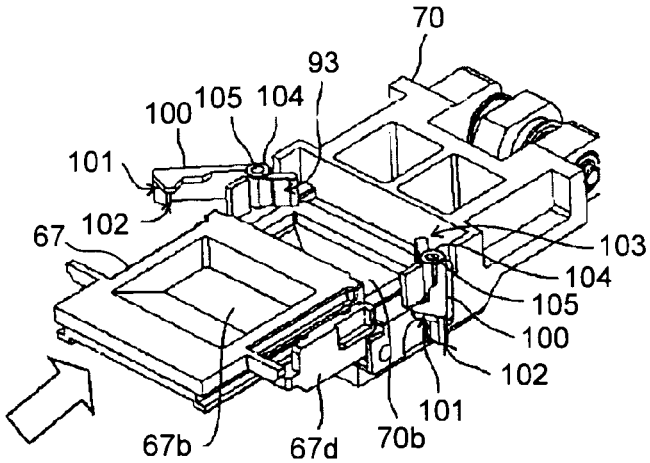
FIG. 38 is an upper perspective view of the main body of the toner supply device at the cross section taken along the line A1-A2 of FIG. 34 just before the discharging unit of the toner cartridge is attached to the main body, when viewed from obliquely above.

FIG. 31 is an upper perspective view of the main body 70 of the toner supply device 60 and the toner cartridge 61 that are separate from each other, when viewed from obliquely above. FIG. 32 is a lower perspective view of the main body 70 of the toner supply device 60 and the toner cartridge 61 that are attached to each other, when viewed from obliquely below. FIG. 33 is a side view of the main body 70 of the toner supply device 60 and the toner cartridge 61 that are separate from each other, when viewed from side. FIG. 34 is a side view of the main body 70 of the toner supply device 60 and the toner cartridge 61 that are attached to each other, when viewed from side. FIG. 37 is a top view of the main body 70 of the toner supply device 60 at a cross section taken along a line A1-A2 of FIG. 34 just before the discharging unit 67 of the toner cartridge 61 is attached to the main body 70, when viewed from above. FIG. 38 is an upper perspective view of the main body 70 of the toner supply device 60 at the cross section taken along the line A1-A2 of FIG. 34 just before the discharging unit 67 of the toner cartridge 61 is attached to the main body 70, when viewed from obliquely above.

When the toner cartridge 61 that is separate from the main body 70 of the toner supply device 60 is attached to the main body 70 of the toner supply device 60, the slide shutter 67*d* arranged on the discharging unit 67 of the toner cartridge 61 comes into contact with the main body 70. Then, when the discharging unit 67 of the toner cartridge 61 is inserted into the main body 70, the discharging unit 67 moves while opening the slide shutter 67*d*, and then comes into contact with a discharge-port contact portion 103 of a shutter fixing arm 100 that is arranged on the main body 70. Accordingly, the shutter fixing arm 100 rotates about a rotation shaft 105 and the discharging unit 67 is held by a discharge-port insertion portion 101. At the same time, shutter engaging portions 102 of the shutter fixing arm 100 engage with the slide shutter 67*d* from the both sides along with the rotation of the shutter fixing arm 100, thereby holding the slide shutter 67*d*.

The open-close operation of the slide shutter 67*d* arranged on the discharging unit 67 and the rotation operation of the shutter fixing arm 100 are performed on the approximately same plane, so that moment in the vertical direction does not occur. Therefore, it is possible to smoothly attach or detach the discharging unit 67 of the toner cartridge 61 to and from the main body 70 of the toner supply device 60.

Figure 35:
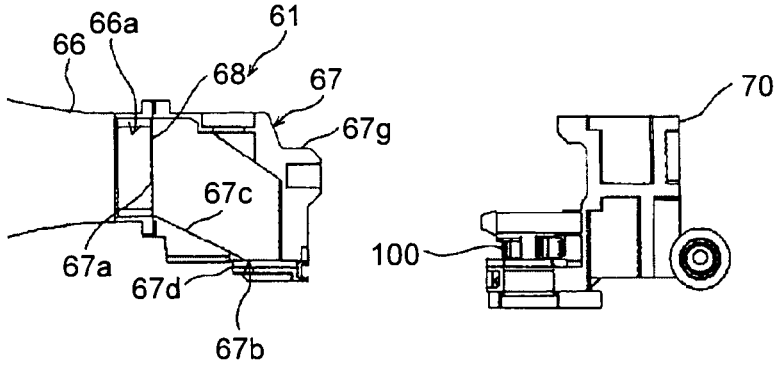
FIG. 35 is a cross-sectional view of the main body of the toner supply device and the toner cartridge, which are separate from each other.
Figure 36:
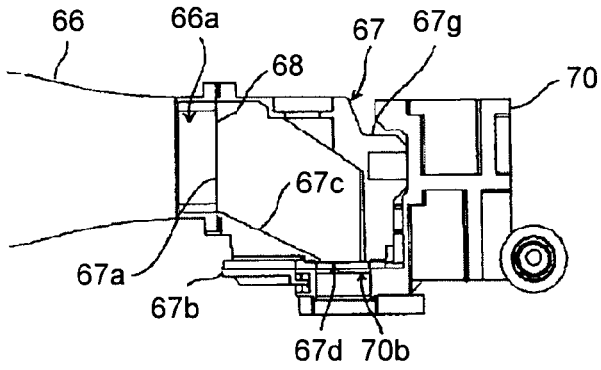
FIG. 36 is a cross-sectional view of the main body of the toner supply device and the toner cartridge, which are attached to each other.

FIG. 35 is a cross-sectional view of the main body 70 of the toner supply device 60 and the toner cartridge 61, which are separate from each other. FIG. 36 is a cross-sectional view of the main body 70 of the toner supply device 60 and the toner cartridge 61, which are attached to each other.

As illustrated in FIG. 35, when the toner cartridge 61 and the main body 70 of the toner supply device 60 are separate from each other, the discharge port 67*b* of the discharging unit 67 of the toner cartridge 61 is sealed by the slide shutter 67*d*. On the other hand, as illustrated in FIG. 36, when the discharging unit 67 of the toner cartridge 61 is attached to the main body 70 of the toner supply device 60, the slide shutter 67*d* moves to open the discharge port 67*b*, so that the opening of the main body 70 and the discharge port 67*b* communicate with each other and toner is supplied to a sub hopper (not illustrated) arranged below the main body 70.

Figure 39:
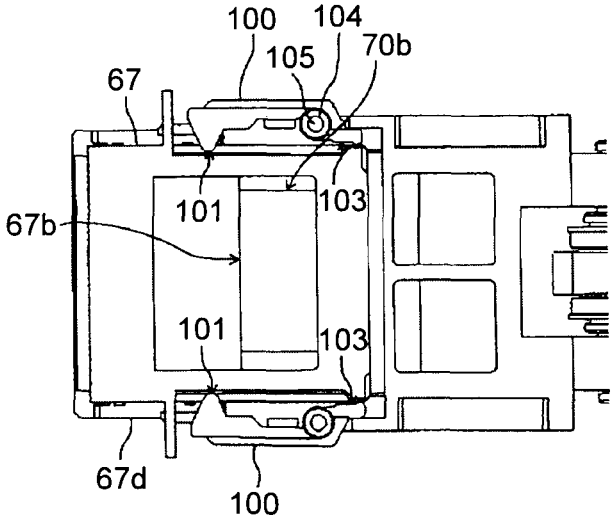
FIG. 39 is an upper cross-sectional view of the main body of the toner supply device at the cross section taken along the line A1-A2 of FIG. 34 with the discharging unit of the toner cartridge attached to the main body, when viewed from above.
Figure 40:
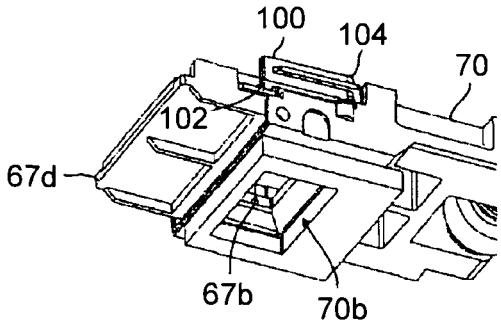
FIG. 40 is a lower perspective view of the main body of the toner supply device at the cross section taken along the line A1-A2 of FIG. 34 with the discharging unit of the toner cartridge attached to the main body, when viewed from obliquely below.

FIG. 39 is an upper cross-sectional view of the main body 70 of the toner supply device 60 at the cross section taken along the line A1-A2 of FIG. 34 with the discharging unit 67 of the toner cartridge 61 attached to the main body, when viewed from above. FIG. 40 is a lower perspective view of the main body 70 of the toner supply device 60 at the cross section taken along the line A1-A2 of FIG. 34 with the discharging unit 67 of the toner cartridge 61 attached to the main body, when viewed from obliquely below.

Figure 41:
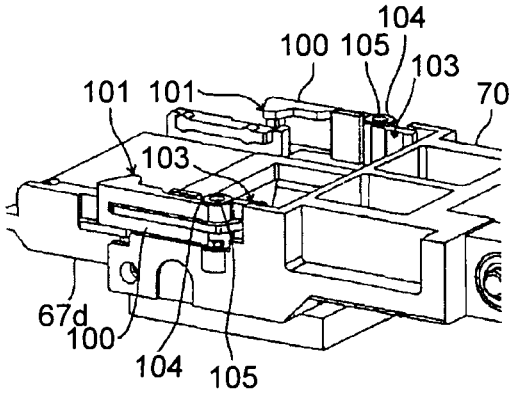
FIG. 41 is an upper perspective view of the main body of the toner supply device at the cross section taken along the line A1-A2 of FIG. 34 with the discharging unit of the toner cartridge attached to the main body, when viewed from obliquely above.
Figure 42:
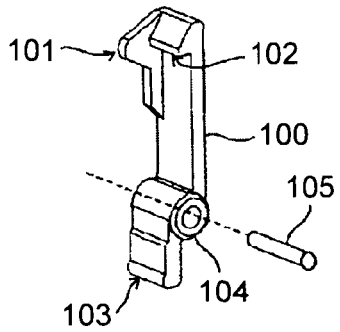
FIG. 42 is a schematic diagram of a shutter fixing arm.
Figure 43:
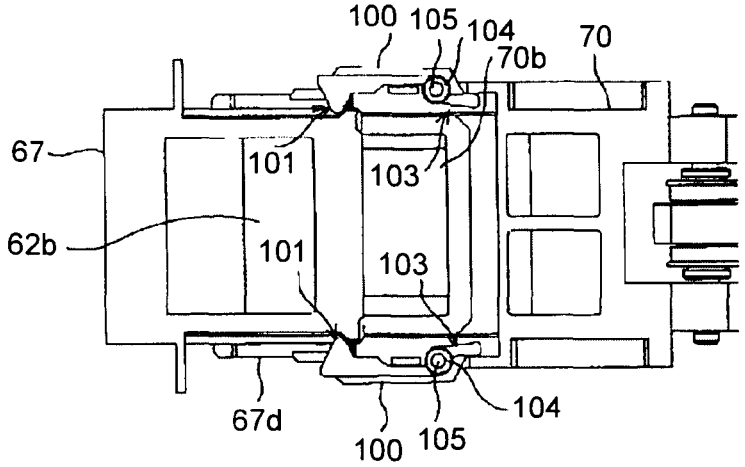
FIG. 43 is a diagram illustrating a state of an operation of pulling the discharging unit of the toner cartridge out of the main body of the toner supply device.
Figure 44:
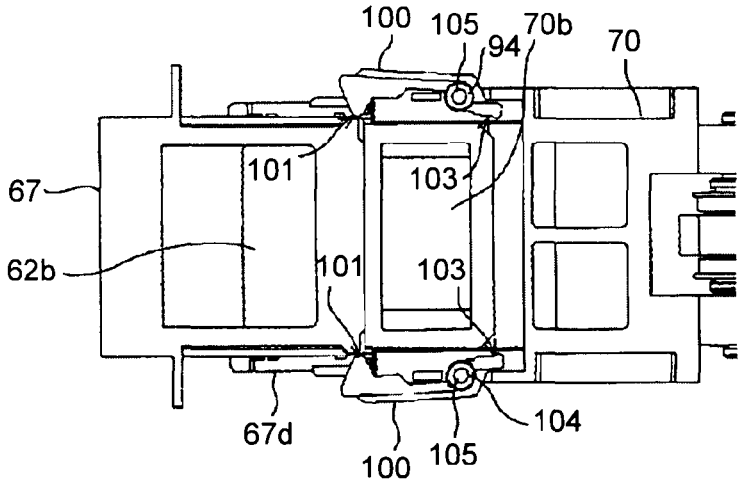
FIG. 44 is a diagram illustrating a state of the operation of pulling the discharging unit of the toner cartridge out of the main body of the toner supply device.
Figure 45:
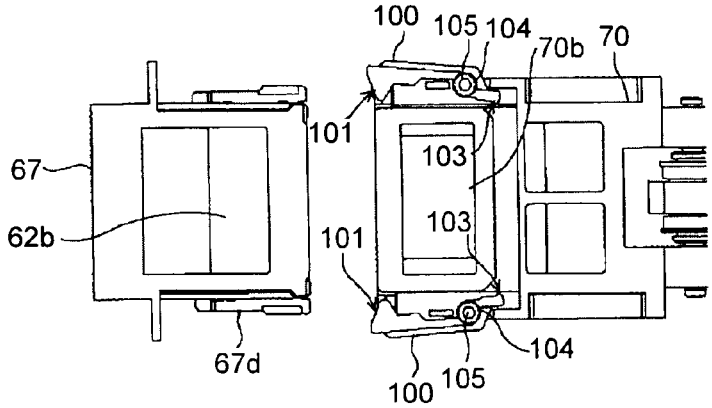
FIG. 45 is a diagram illustrating a state of the operation of pulling the discharging unit of the toner cartridge out of the main body of the toner supply device.
Figure 46:
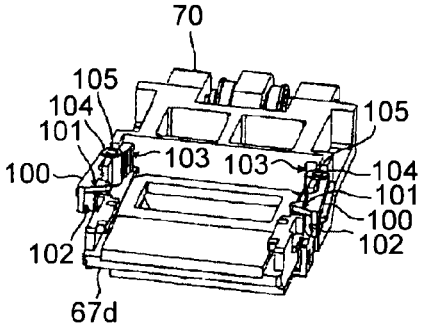
FIG. 46 is a diagram illustrating a state of the operation of pulling the discharging unit of the toner cartridge out of the main body of the toner supply device.

FIG. 41 is an upper perspective view of the main body 70 of the toner supply device 60 at the cross section taken along the line A1-A2 of FIG. 34 with the discharging unit 67 of the toner cartridge 61 attached to the main body, when viewed from obliquely above. FIG. 42 is a schematic diagram of the shutter fixing arm 100. The discharge-port insertion portion 101 that is inserted into a concave portion of the discharging unit 67 and the shutter engaging portion 102 that engages with a concave portion of the slide shutter 67*d* are arranged on one end of each of the shutter fixing arms 100. The discharge-port contact portion 103 that comes into contact with a side wall of the discharging unit 67 is arranged on the other end of each of the shutter fixing arms 100. A shaft hole 104, through which the rotation shaft 105 supported by the main body 70 is inserted, is arranged between both ends of each of the shutter fixing arms 100.

When the toner cartridge 61 is attached to the main body 70 of the toner supply device 60, the discharge-port contact portion 103 of the shutter fixing arm 100 comes into contact with the side wall of the discharging unit 67, so that the shutter fixing arm 100 rotates about the rotation shaft 105. By the rotation of the shutter fixing arm 100 as described above, the discharge-port insertion portion 101 of the shutter fixing arm 100 is inserted into the concave portion of the discharging unit 67, and at the same time, the shutter engaging portion 102 of the shutter fixing arm 100 is engaged with and fixed to the concave portion of the slide shutter 67*d*. The two shutter fixing arms 100 are arranged on the main body 70 of the toner supply device 60 in a symmetric manner, and they are engaged with the both sides of the slide shutter 67*d* simultaneously.

FIGS. 43, 44, 45, and 46 illustrate states of operations of pulling the discharging unit 67 of the toner cartridge 61 out of the main body 70 of the toner supply device 60.

When the discharging unit 67 is pulled out while the shutter engaging portions 102 of the shutter fixing arms 100 are engaged with the concave portions of the slide shutter 67*d*, only the discharging unit 67 moves while the slide shutter 67*d* is fixed to the shutter engaging portions 102, so that the discharge port 67*b* moves toward the upper side of the slide shutter 67*d* and is then closed by the slide shutter 67*d*. The discharge-port insertion portions 101 of the shutter fixing arms 100 come into contact with inclined surfaces of the concave portions of the discharging unit 67 immediately after the discharge port 67*b* is completely closed, and the shutter fixing arms 100 are moved in the opening direction until the shutter engaging portions 102 of the shutter fixing arms 100 are completely disengaged from the concave portions of the slide shutter 67*d*. Therefore, the slide shutter 67*d* can move along with the movement of the discharging unit 67, so that the discharging unit 67 with the slide shutter 67*d* is separated from the main body 70.

Figure 47:
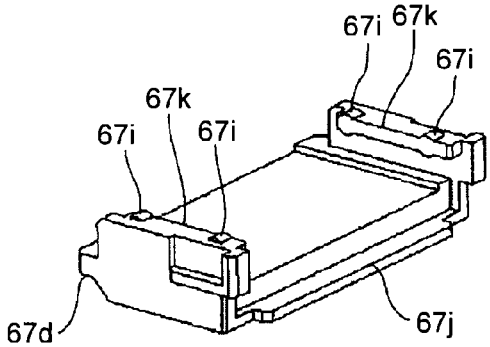
FIG. 47 is a front perspective view of a slide shutter viewed from obliquely upper front.
Figure 48:
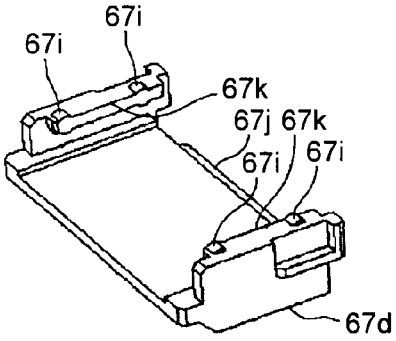
FIG. 48 is a rear perspective view of the slide shutter viewed from obliquely upper rear.
Figure 49:
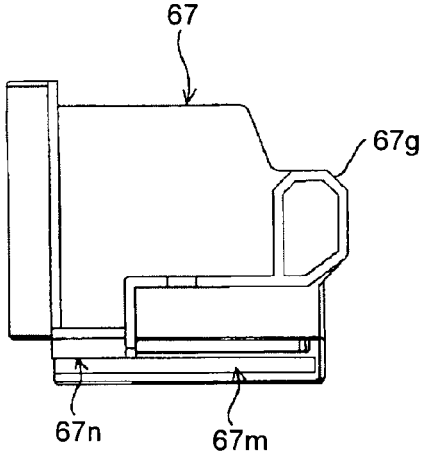
FIG. 49 is a side view of the discharging unit viewed from side.
Figure 50:
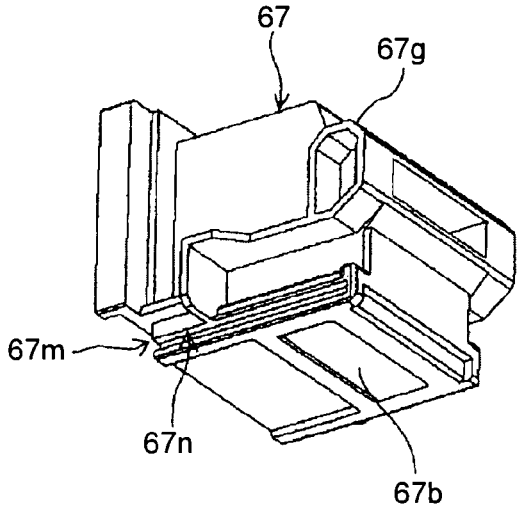
FIG. 50 is a lower perspective view of the discharging unit viewed from obliquely lower front.

FIG. 47 is a front perspective view of the slide shutter 67*d* viewed from obliquely upper front. FIG. 48 is a rear perspective view of the slide shutter 67*d* viewed from obliquely upper rear. FIG. 49 is a side view of the discharging unit 67 viewed from side. FIG. 50 is a lower perspective view of the discharging unit 67 viewed from obliquely lower front.

The circular arc surfaces of protrusions 67*i* arranged on slide portions 67*k* of the slide shutter 67*d* come into contact with upper wall surfaces 67*n* that are guide surfaces of guide grooves 67*m* arranged on the discharging unit 67. Because the circular arc surfaces of the protrusions 67*i* enter the guide grooves 67*m* and come into contact with the upper wall surfaces 67*n*, the slide portions 67*k* are fixed in the thickness direction. Therefore, it is possible to minimize the contact areas between the slide portions 67*k* and the guide grooves 67*m* when the slide shutter 67*d* is opened and closed, so that the operating force of the slide shutter 67*d* at the time of opening and closing can be minimized.

Figure 51:
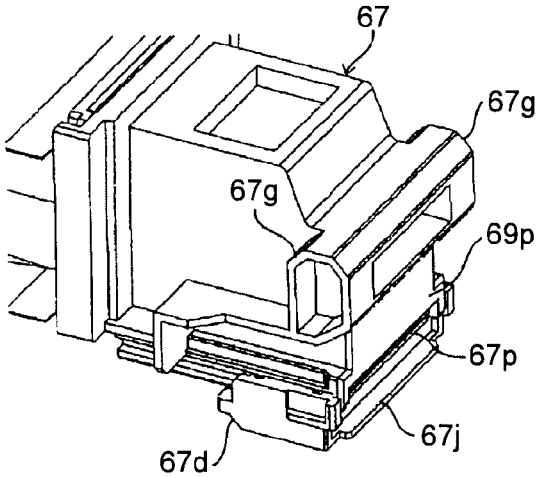
FIG. 51 is a front perspective view of a tip portion of the toner cartridge viewed from obliquely upper front.
Figure 52:
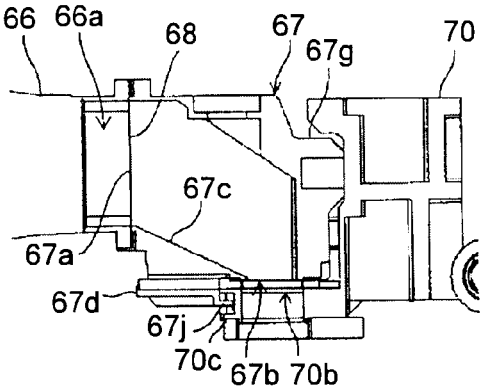
FIG. 52 is a cross-sectional view of the main body of the toner supply device and the toner cartridge that are attached to each other, when viewed from side.

FIG. 51 is a front perspective view of a tip portion of the toner cartridge 61 viewed from obliquely upper front. FIG. 52 is a cross-sectional view of the main body 70 of the toner supply device 60 and the toner cartridge 61 that are attached to each other, when viewed from side.

As illustrated in FIG. 51, a shutter wall portion 67*j* that is the tip portion of the slide shutter 67*d* extends outward than the position of an edge 67*p* on the tip side of the slide shutter 67*d* when the discharge port 67*b* is closed by the slide shutter 67*d*. A wall portion 69*p* that covers the edge 67*p* on the tip side of the discharge port 67*b* is arranged at the position above the discharge port 67*b* and outside the edge 67*p* on the tip side of the discharge port 67*b*. When the main body 70 of the toner supply device 60 and the discharging unit 67 of the toner cartridge 61 are separate from each other and the slide shutter 67*d* is closed, the edge 67*p* on the tip side of the discharge port 67*b* is surrounded by the wall portion 69*p* and the shutter wall portion 67*j* of the discharging unit 67 in the vertical direction. Therefore, the toner attached to the edge 67*p* on the tip side of the discharge port 67*b* can be prevented from dropping and a user can be prevented from touching the toner on the tip portion of the discharge port and getting dirt. Furthermore, as illustrated in FIG. 52, when the discharging unit 67 of the toner cartridge 61 is attached to the main body 70 of the toner supply device 60, the shutter wall portion 67*j* is housed so as to be covered and hidden by a concave portion 70*c* of the main body 70. Therefore, it is possible to prevent toner from being attached to the shutter wall portion 67*j* even when the toner is discharged from the discharge port 67*b*.

A configuration as illustrated in FIGS. 53A to 53D may be employed as the shutter open-close mechanism that opens and closes the slide shutter 67*d*. The shutter open-close mechanism illustrated in FIGS. 53A to 53D includes guide grooves 120 arranged on the discharging unit 67 of the toner cartridge 61; engagement concave portions 130 arranged on the left and right side surfaces of the slide shutter 67*d* in the attachment direction; and engagement pins 140 that are arranged on the main body 70 of the toner supply device 60 and that are displaceable to the left and right in the attachment direction in which the engagement pins 140 are engaged with and disengaged from the engagement concave portions 130 along the guide grooves 120. The shutter open-close mechanism opens the discharge port 67*b* of the toner cartridge 61 in accordance with the operation of attaching the toner supply device 60 of the toner cartridge 61 to the main body 70, and closes the discharge port 67*b* in accordance with the operation of pulling the toner cartridge 61 out of the main body 70.

Figure 53A:
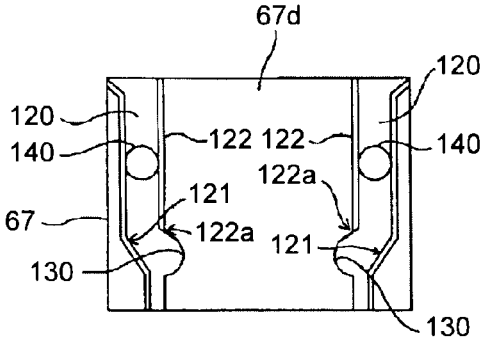
FIGS. 53A to 53D are diagrams illustrating another example of a shutter opening-closing member.
Figure 53B:
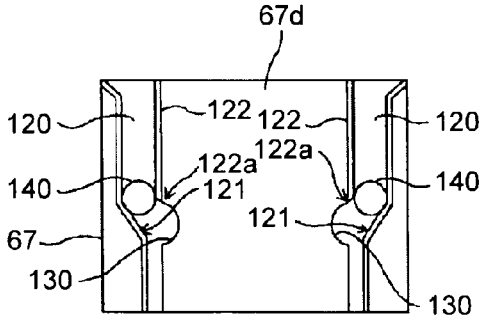
Figure 53C:
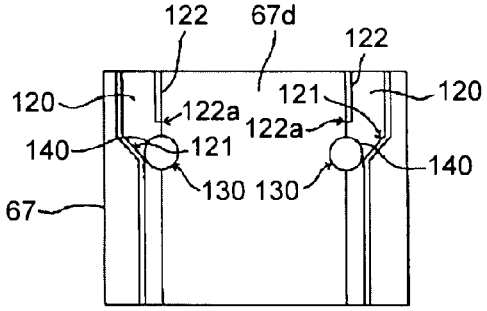
Figure 53D:
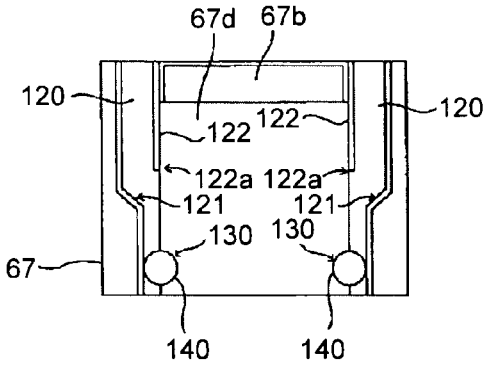

When the toner cartridge 61 is inserted into the vicinity of a predetermined position, the engagement pins 140 arranged on the main body 70 enter the guide grooves 120 arranged on the toner supply device 60 as illustrated in FIG. 53A. At this time, the engagement pins 140 move relative to the movement of the toner cartridge 61, along the wall surfaces of the guide grooves 120. Inclined surfaces 121 that shift the engagement pins 140 inward are arranged on the guide grooves 120. When the engagement pins 140 come into contact with the inclined surfaces 121 (see FIG. 53B), the engagement pins 140 move inward and engage with the engagement concave portions 130 arranged on the slide shutter 67*d* (see FIG. 53C). With this engagement, the movement of the slide shutter 67*d* is stopped even when the movement of the toner cartridge 61 is continued. Consequently, the slide shutter 67*d* starts opening and the discharge port 67*b* is opened (see FIG. 53D).

On the other hand, when the toner cartridge 61 is pulled out of the main body 70, the slide shutter 67*d* starts closing, and, when the engagement pins 140 engaged with the engagement concave portions 130 return to the positions of end portions 122*a* of guide walls 122 that form the guide grooves 120, the slide shutter 67*d* completely closes the discharge port 67*b*. After the slide shutter 67*d* closes the discharge port 67*b*, the engagement pins 140 come into contact with the end portions 122*a* of the guide walls 122 and are biased, so that the engagement pins 140 come off from the engagement concave portions 130. Therefore, the discharge port 67*b* is completely closed when the toner cartridge 61 is pulled out of the main body 70, so that it becomes possible to prevent toner dispersion or toner leakage at the time of replacing the toner cartridge.

As described above, according to the second embodiment, an image forming apparatus includes the toner cartridge 61 as a powder container having the discharge port 67*b* that is a powder discharge port for supplying powder to the receiving port that is a powder receiving port arranged on the main body 70 as an apparatus main body of the toner supply device 60; and the slide shutter 67*d* as a powder discharge port open-close member that is slidable relative to the toner cartridge 61 and that opens and closes the discharge port 67*b*. In the image forming apparatus, the toner cartridge 61 is movable between a supply position, at which the discharge port 67*b* is opposing to the communication path 70*b* and powder is supplied, and a retraction position, to which the toner cartridge is retracted from the powder supply position. Furthermore, the slide shutter 67*d* opens the discharge port 67*b* along with the attachment operation by which the toner cartridge 61 moves from the retraction position to the supply position, and the slide shutter 67*d* closes the discharge port 67*b* along with the retraction operation by which the toner cartridge 61 moves from the supply position to the retraction position. The image forming apparatus further includes the shutter fixing arms 100 as locking members that lock the slide shutter 67*d* and that are arranged on the main body 70 such that the shutter fixing arms 100 is movable between the locking position, at which the slide shutter 67*d* is locked, and the release position, to which the shutter fixing arms are retracted from the engaging position and at which the locking of the slide shutter 67*d* is released. The slide shutter 67*d* slides relative to the toner cartridge 61 along with the attachment operation of the toner cartridge 61, to thereby open the discharge port 67*b* and displace the shutter fixing arms 100 from the release position to the locking position to lock the slide shutter 67*d*. Furthermore, the discharge port 67*b* reaches the position facing the slide shutter 67*d* along with the retraction operation of the toner cartridge 61, so that the slide shutter 67*d* closes the discharge port 67*b*. Thereafter, the shutter fixing arms 100 come into contact with the toner cartridge 61 and are biased so as to be displaced from the locking position to the release position, so that the locking between the slide shutter 67*d* and the shutter fixing arms 100 is released. Therefore, the locking operation and the locking releasing operation of the slide shutter 67*d* by the shutter fixing arms 100 are performed by the action of a mechanical force that occurs when the slide shutter 67*d* is in contact with and biased by the main body 70. Consequently, even when the toner cartridge 61 is repeatedly replaced and the locking operation and the locking releasing operation of the slide shutter 67*d* by the shutter fixing arms 100 are repeated, elastic fatigue that may occur when an elastic member, such as a spring, is repeatedly used does not occur. Therefore, the slide shutter 61*d* can be successfully opened and closed over time.

Furthermore, according to the second embodiment, when the attachment operation of the toner cartridge 61 is performed, the slide shutter 67*d* comes into contact with the main body 70 along with the attachment operation of the toner cartridge 61, so that the movement of the slide shutter 67*d* along with the toner cartridge 61 is regulated. Therefore, the slide shutter 67*d* slides relative to the toner cartridge 61 to open the discharge port 67*b*, and the discharge-port contact portions 103 as one end portions of the shutter fixing arms 100 come into contact with the toner cartridge 61 to rotate the shutter fixing arms 100 about the rotation shaft 105 such that the shutter fixing arms 100 are displaced from the release position to the locking position. Accordingly, the shutter engaging portions 102 as the other end portions of the shutter fixing arms 100 locks the slide shutter 61*d*. When the retraction operation of the toner cartridge 61 is performed, the discharge-port insertion portions 101 on the other end portions of the shutter fixing arms 100 come into contact with the inclined surfaces of the concave portions of the discharging unit 67 of the toner cartridge 61. Therefore, the shutter fixing arms 100 rotate about the rotation shaft 105 and are displaced from the locking position to the release position. Accordingly, the locking between the slide shutter 61*d* and the shutter engaging portions 102 on the other end portions of the shutter fixing arms 100 is released. Therefore, the shutter fixing arms 100 can be displaced between the release position and the locking position by the contact of the toner cartridge 61 at the time of the attachment/detachment operation of the toner cartridge 61 to/from the main body 70.

Moreover, according to the second embodiment, the toner cartridge 61 includes the guide grooves 67*m* that are grooves for guiding the movement of the slide shutter 67*d* relative to the toner cartridge 61 in a predetermined direction at the upper wall surfaces 67*n* that are the guide surfaces. Besides, the slide shutter 61*d* includes the slide portions 67*k* having the protrusions 67*i* that are engaged with the guide grooves 67*m* and that come in slide contact with the upper wall surfaces 67*n*. Therefore, the position in the height direction is regulated by the insertion of the slide portions 67*k* of the slide shutter 67*d* into the guide grooves 67*m* of the discharging unit 67, and the sealing capability and the operability of the slide shutter 67*d* at the time of opening and closing the slide shutter 67*d* can be stabilized. As a result, it is possible to prevent backlash and fluctuation in the operating force, enabling to smoothly replace the toner cartridge 61.

Furthermore, according to the second embodiment, the protrusions 67*i* have circular arch shapes protruding toward the upper wall surfaces 67*n*. Therefore, it is possible to minimize the contact areas between the upper wall surfaces 67*n* of the guide grooves 67*m* of the toner cartridge 61 and the protrusions 67*i* of the slide portions 67*k* of the slide shutter 67*d*. Consequently, a frictional force at the time of the operation can be reduced to the minimum. Besides, even if the slide shutter 67*d* is bent due to a variation in the shape thereof, it is possible to reduce the influence on the operating force.

Moreover, according to the second embodiment, the shutter wall portion 67*j* that is the tip portion of the slide shutter 67*d* extends outward than the position of the edge 67*p* on the tip side of the discharge port 67*b* when the discharge port 67*b* is closed by the slide shutter 67*d*. Furthermore, the concave portion 70*c* that covers and hides the shutter wall portion 67*j* of the slide shutter 67*d* when the toner cartridge 61 is attached to the main body 70 is arranged on the main body 70. Therefore, even if a small amount of toner attached to the vicinity of the discharge port 67*b* drops, it is possible to receive the toner by the shutter wall portion 67*j* of the slide shutter 67*d*. Besides, the shutter wall portion 67*j* is housed so as to be covered and hidden by the concave portion 70*c* of the main body 70 when the toner cartridge 61 is attached to the main body 70. Therefore, it is possible to prevent toner from being attached to the shutter wall portion 67*j* even when the toner is discharged from the discharge port 67*b*. As a result, it is possible to prevent the toner from falling off and prevent a user or an environment from getting dirty by the toner when the toner cartridge 61 is removed from the main body 70.

Furthermore, according to the second embodiment, the wall portion 69*p* that covers the edge 67*p* on the tip side of the discharge port 67*b* is arranged at the position above the discharge port 67*b* and outside the position of the edge 67*p* on the tip side of the discharge port 67*b*. Therefore, it is possible to prevent a user from touching toner attached to the edge 67*p* on the tip side of the slide shutter 67*d* when the toner cartridge 61 is attached to or detached from the main body 70.

Moreover, according to the second embodiment, an image forming apparatus includes the photosensitive drum 1 as a latent image carrier; the developing device 5 that includes the developer containers 53 and 54 and that develops a latent image on the photosensitive drum 1 by using the developer in the developer containers 53 and 54; the toner cartridge 61 as a toner container that houses toner used by the developing device 5; and a toner supply means for supplying the toner from the toner cartridge 61 to the developer container. In the image forming apparatus, the toner supply device 60 of the second embodiment is used as the toner supply means. Therefore, even when the toner cartridge 61 is repeatedly replaced and the locking operation and the locking releasing operation of the toner cartridge 61 by the shutter fixing arms 100 are repeated, elastic fatigue that may occur when an elastic member, such as a spring, is repeatedly used does not occur. Consequently, it is possible to successfully open and close the slide shutter 61*d* over time, enabling to successfully supply toner from the toner supply device 60 to the developing device.

The second embodiment described above includes some aspects of the disclosure as set forth as follows.

According to a first aspect of the disclosure, a powder supply device includes a powder container that has a powder discharge port for supplying powder through a powder receiving port arranged on an apparatus main body; and a powder discharge port open-close member that is slidable relative to the powder container and that opens and closes the powder discharge port. In the powder supply device, the powder container is movable between a supply position, at which the discharge port is opposing to the powder receiving port and at which the powder is supplied, and an retraction position, to which the powder container is retracted from the supply position. Furthermore, the discharge port open-close member opens the discharge port along with the attachment operation by which the powder container moves from the retraction position to the supply position, and closes the discharge port along with the retraction operation by which the powder container moves from the supply position to the retraction position. The powder supply device further includes a locking member that locks the discharge port open-close member and that is arranged on the apparatus main body such that the locking member is movable between a locking position, at which the discharge port open-close member is locked, and a release position, to which the locking member is retracted from the locking position and at which the locking of the discharge port open-close member is released. The discharge port open-close member slides relative to the powder container along with the attachment operation of the powder container, to thereby open the discharge port and displace the locking member from the release position to the locking position to lock the discharge port open-close member. Furthermore, the discharge port reaches the position opposing to the discharge port open-close member along with the retraction operation of the powder container, so that the discharge port is closed by the discharge port open-close member. Thereafter, the locking member comes into contact with the powder container and biased so as to be displaced from the locking position to the release position, so that the locking between the discharge port open-close member and the locking member is released.

According to a second aspect of the disclosure, in the powder supply device as set forth in the first aspect of the disclosure, the discharge port open-close member comes into contact with the apparatus main body at the time of the attachment operation of the powder container, so that the movement of the discharge port open-close member is regulated. Therefore, the discharge port open-close member slides relative to the powder container to open the discharge port, and one end portion of the locking member comes into contact with the powder container to rotate the locking member about a rotation shaft such that the locking member is displaced from the release position to the locking position. Accordingly, the other end portion of the locking member locks the discharge port open-close member. When the retraction operation of the powder container is performed, the other end of the locking member comes into contact with the powder container to thereby rotate the locking member about the rotation shaft. Accordingly, the locking member is displaced from the locking position to the release position, so that the locking between the discharge port open-close member and the other end portion of the locking member is released.

According to a third aspect of the disclosure, in the powder supply device as set forth in the first aspect of the disclosure, the powder container includes a groove for guiding movement of the discharge port open-close member relative to the powder container in a predetermined direction at a guide surface. Furthermore, the discharge port open-close member includes a slide portion that has a protrusion that is engaged with the groove and that comes in slide contact with the guide surface.

According to a fourth aspect of the disclosure, in the powder supply device as set forth in the third aspect of the disclosure, the protrusion has a circular arch shape protruding toward the guide surface.

According to a fifth aspect of the disclosure, in the powder supply device as set forth in any one of the first to fourth aspects of the disclosures, a tip portion of the discharge port open-close member extends outward than the position of an edge of the discharge port when the discharge port is closed by the discharge port open-close member. Furthermore, the apparatus main body includes a concave portion that covers and hides the tip portion of the discharge port open-close member when the powder container is attached to the apparatus main body.

According to a sixth aspect of the disclosure, the powder supply device as set forth in any one of the first to fifth aspects of the disclosure further includes a wall portion that covers the edge of the discharge port at the position above the discharge port and outside the position of the edge of the discharge port.

According to a seventh aspect of the disclosure, an image forming apparatus includes a latent image carrier; a developing unit that includes a developer container and that develops a latent image on the image carrier by using a developer in the developer container; a toner container that houses toner used by the developing device; and a toner supply unit that supplies the toner from the toner container to the developer container. In the image forming apparatus, the powder supply device as set forth in any one of the first to sixth aspects of the disclosure is used as the toner supply unit.

According to the present invention, the locking operation and the locking releasing operation of the discharge port open-close member by the locking member is performed by causing the locking member to come into contact with the apparatus main body and to be displaced between the locking position and the release position by the mechanical action that occurs when the locking member is in contact with and biased by the apparatus main body. Therefore, even when the powder container is repeatedly replaced and the locking operation and the locking releasing operation of the discharge port open-close member by the locking member are repeated, elastic fatigue that may occur when an elastic member, such as a spring, is repeatedly used does not occur. Therefore, it is possible to successfully open and close the discharge port open-close member over time compared with a case that the locking operation and the locking releasing operation of the discharge port open-close member by the locking member is performed by displacing the locking member between the locking position and the release position by using an elastic force of an elastic member, such as a spring.

Third Embodiment

A third embodiment will be explained below.

In the third embodiment, a powder container includes a containing unit that houses powder and at least a portion of which is deformable; and a discharging unit that discharges the powder from the containing unit to the outside. A ventilation portion is also provided that, when a protrusion that is deformed so as to protrude to the inside of the containing unit is moved toward the discharging unit by a delivery member, returns air in a space in front of the protrusion to a space behind the protrusion. Therefore, when the protrusion, which is formed so as to protrude inward and deforms a flexible wall surface of the powder container, is moved to discharge a predetermined amount of powder from the discharging unit, it is possible to prevent an excessive amount of powder from being discharged by the air that is pushed out of the powder container from the discharging unit together with the powder.

In the third embodiment described below, the basic configurations of the image forming apparatus, the image forming units, the toner supply device, and the toner cartridges are the same as those explained in the first embodiment. Therefore, the same components are denoted by the same reference numerals and the same explanation will not be repeated. Only configuration and operations specific to the third embodiment will be described below.

Figure 54A:
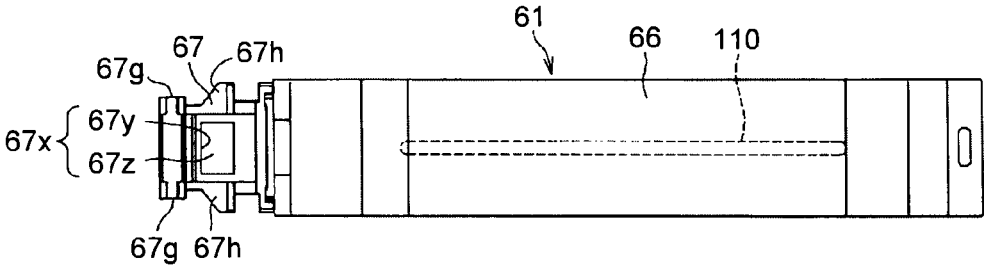
FIGS. 54A to 54D are configuration diagrams of a toner cartridge according to a third embodiment.
Figure 54B:
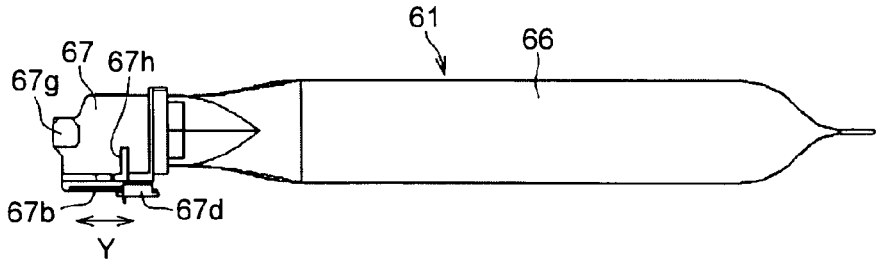
Figure 54C:
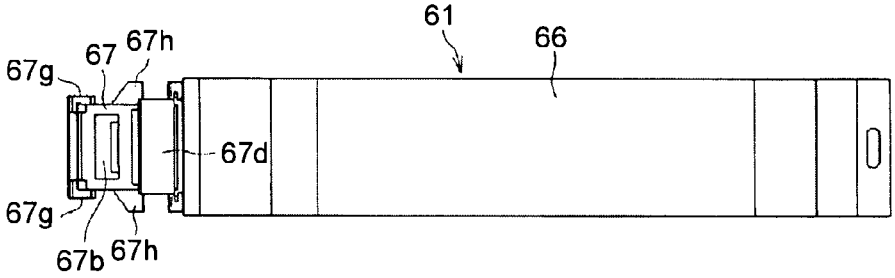
Figure 54D:
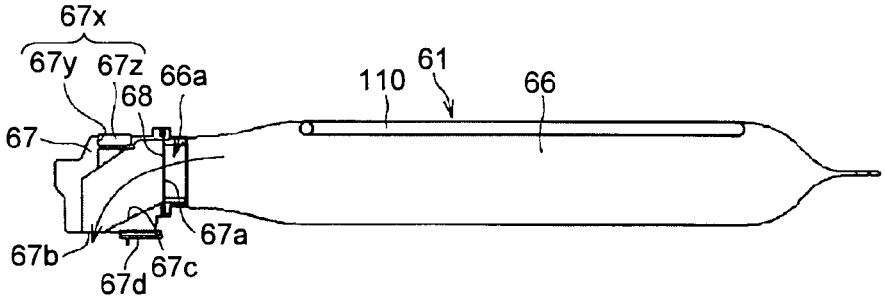

FIGS. 54A to 54D are configuration diagrams of a toner cartridge according to the third embodiment. Specifically, FIG. 54A is a plan view, FIG. 54B is a side view, FIG. 54C is a bottom view, and FIG. 54D is a cross-sectional view. The toner cartridge 61 according to the third embodiment includes a ventilation tube 110 in addition to the configuration of the toner cartridge 61 illustrated in FIG. 5C.

In FIGS. 54A to 54D, when the toner containing unit 66 is connected to the opening holder member 68 by heat sealing, if the LDPE is present in the innermost layer of the toner containing unit 66, the heat-sealing characteristics can be improved. The toner container may be colored in the same color as the developer contained therein. It is also possible to form a thin film that increases the abrasion resistance or decrease a coefficient of friction on the surface layer by using various methods, such as PVD or CVD. It is also possible to arrange a mechanism that applies various lubricant materials in order to reduce the friction against the delivery member as described below.

As illustrated in FIGS. 54A and 54D, the ventilation tube 110 extending in the longitudinal direction of the toner cartridge (in the moving direction of the delivery member 81 as described later) is arranged in the center in the width direction of the upper wall surface of the toner containing unit 66 of the toner cartridge 61. The ventilation tube 110 has, for example, a linear shape with a diameter of about 5 mm and the length of about 20 to 25 cm. The ventilation tube 110 is integrally fixed to the inner surface of the toner cartridge 61 and both ends of the ventilation tube 110 are opened inside the toner cartridge 61. It is possible to arrange only one ventilation tube 110. Alternatively, it is possible to arrange a plurality of ventilation tubes 110 in parallel to one another.

As illustrated in FIGS. 54A and 54B, a respiration portion 67*x* that enables ventilation in and out may be arranged on the upper surface of the discharging unit 67. The respiration portion 67*x* includes an air hole 67*y* opened on the upper surface of the discharging unit 67 and a filter 67*z* attached to the air hole 67*y* for preventing toner leakage. The respiration portion 67*x* is arranged so as to be opposed to the discharge port 67*b* via a moving path through which the toner introduced from the inlet 67*a* moves to the discharge port 67*b*. The respiration portion 67*x* is not necessarily needed; however, it is preferable to arrange the respiration portion 67*i* as a safety mechanism for the case that the ventilation tube 110 is clogged with toner. By arranging the respiration portion 67*x* on the discharging unit 67, it becomes possible to easily discharge air particularly at the vicinity of the discharging unit 67 when the ventilation tube 110 is clogged, enabling to more reliably prevent toner spout. By arranging the respiration portion 67*x* on the upper surface of the discharging unit 67, it is possible to prevent the respiration portion 67*x* from being clogged with toner. Besides, because the respiration portion 67*x* is arranged so as to face the discharge port 67*b* arranged on the discharging unit 67, it is possible to more effectively discharge air.

Figure 55:
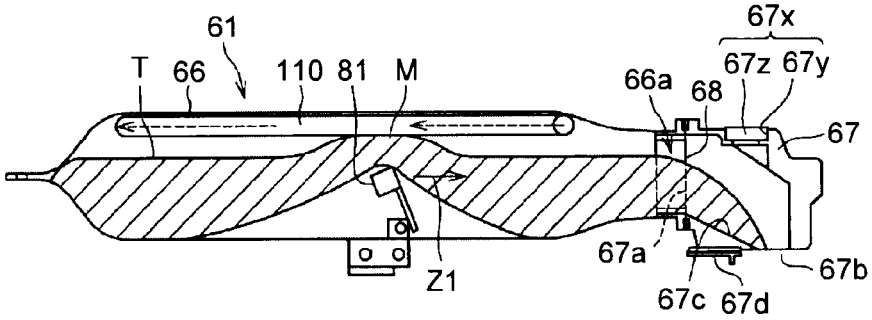
FIG. 55 is a cross-sectional view of the toner cartridge according to the third embodiment.
Figure 61:
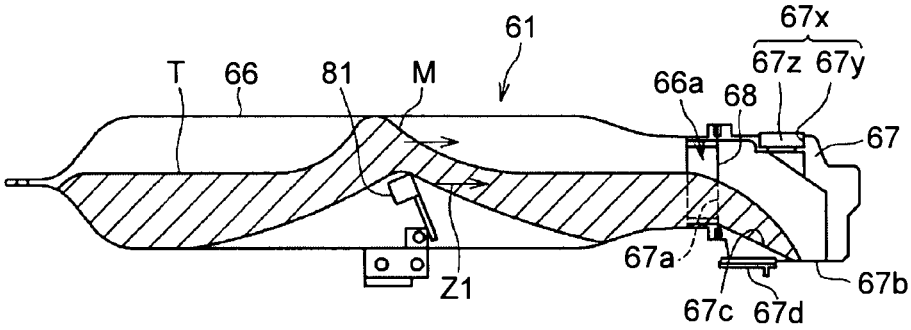
FIG. 61 is a cross-sectional view of the toner cartridge for explaining a problem with the toner cartridge.

If the toner containing unit 66 is pushed and deformed inward by the delivery member 81 at the time of the toner delivery operation as illustrated in FIG. 55, toner is stacked inside the toner containing unit 66 and an elevated portion M of the toner may reach the upper wall surface of the toner containing unit 66. In this case, the interior of the toner containing unit 66 may be divided into front and rear spaces by the elevated portion M of the toner as illustrated in FIG. 61 such that the front and rear spaces inside the toner containing unit 66 are completely separate from each other. When the front and rear spaces are separate from each other, and if the delivery member 81 moves in the delivery direction Z1, excessive toner may be pushed and discharged by airflow that occurs when air in the front space is pushed out of the discharge port, so that the pressure in the rear space decreases and the toner containing unit 66 may be contracted, resulting in toner aggregation (blocking). However, in the third embodiment, because the ventilation tube 110 is arranged on the upper wall surface as illustrated in FIG. 55, even when the elevated portion M of the toner reaches the upper wall surface or the ventilation tube 110, the front and the rear spaces of the toner containing unit 66 are communicated with each other via the ventilation tube 110. Therefore, air in the front space is not pushed out from the discharge port 67*b* together with toner, and the toner containing unit 66 is not contracted due to the negative pressure in the rear space, so that the toner aggregation (blocking) can hardly occur. The ventilation tube 110 may be formed integrally on the wall surface at the time of forming the toner containing unit 66, or may be fixed to the toner containing unit 66 with an adhesive agent or the like after the toner containing unit 66 and the ventilation tube 110 are separately formed. In FIGS. 55 to 58, 61, and 62, the pullout tray 62 is omitted.

Figure 56:
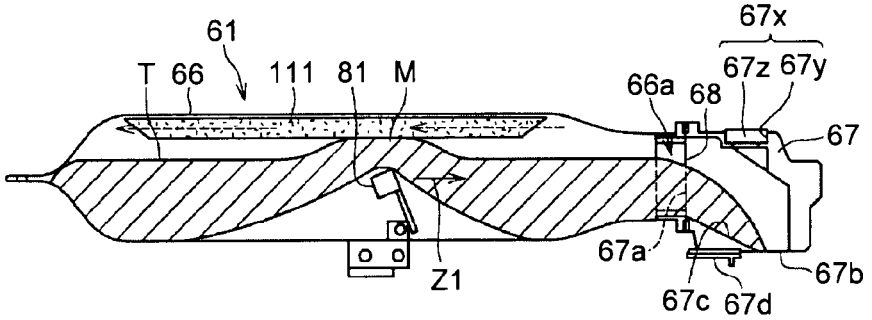
FIG. 56 is a cross-sectional view of the toner cartridge according to the third embodiment, for explaining a first configuration example.

FIG. 56 illustrates a first configuration example of the third embodiment, in which a porous member 111 is arranged instead of the ventilation tube 110. The porous member 111 is formed of a material that transmits air but can hardly transmit toner, similarly to a porous sintered body in which a number of fine holes are communicated with one another. The porous member 111 may be formed of one plate or a plurality of parallel strip-shaped plates. The porous member 111 is fixed to the upper wall surface by an adhesive agent or the like.

Figure 57A:
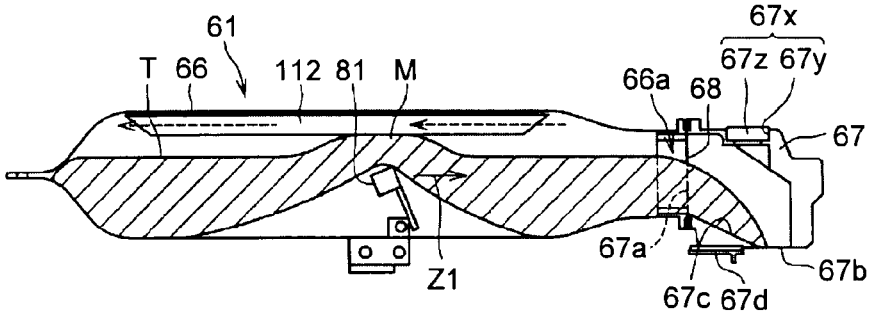
FIG. 57A is a cross-sectional view of the toner cartridge according to the third embodiment, for explaining a second configuration example.
Figure 57B:
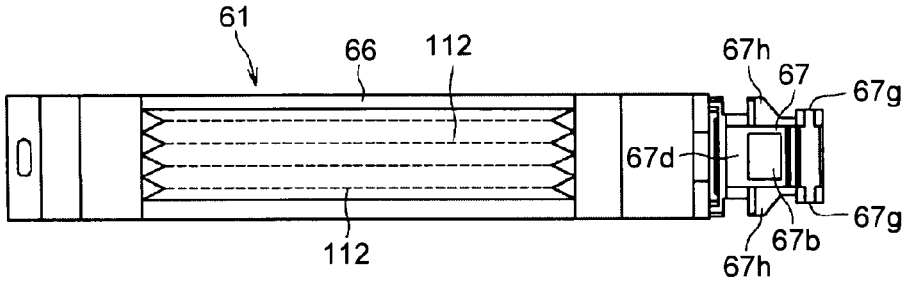
FIG. 57B is a plan view of the toner cartridge according to the third embodiment, for explaining the second configuration example.

FIGS. 57A and 57B illustrate a second configuration example of the third embodiment, in which a plurality of grooves 112 are formed as a gather by folding the upper wall surface of the toner containing unit 66 in an accordion shape, instead of the ventilation tube 110. With the gather, the stiffness of the wall surface can be increased such that the upper surface is not deformed even with the contact with the elevated portion M of the toner. At the same time, an airflow path between the front and the rear spaces separated by the elevated portion M can be ensured by the grooves 112. With the gather as illustrated in FIGS. 57A and 57B, the toner containing unit 66 can be naturally folded into a predetermined shape as the toner decreases, so that the toner cartridge 61 becomes compact when it is collected and collection costs can be reduced.

Figure 58:
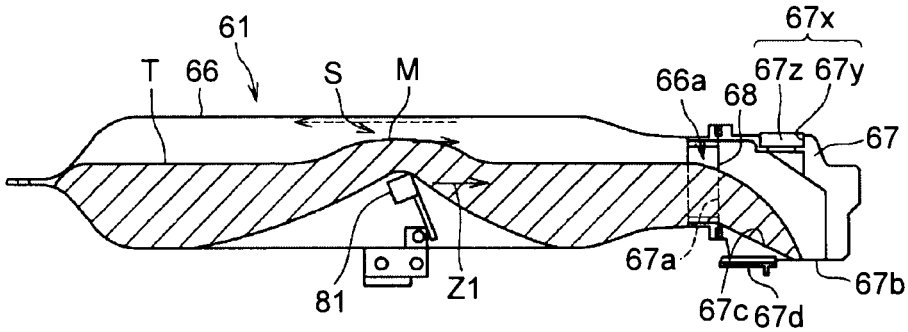
FIG. 58 is a cross-sectional view of the toner cartridge according to the third embodiment, for explaining a third configuration example.

FIG. 58 illustrates a third configuration example of the third embodiment, in which the maximum height of the delivery member 81 is set so that a space S as a ventilation portion can be ensured between the delivery member 81 and an opposing side wall. By setting the maximum height of the delivery member 81 as above, the elevated portion of the toner stacked by the delivery member 81 does not come into contact with the upper wall surface when the delivery member 81 moves, so that the interior of the toner containing unit 66 is not divided into the front and the rear spaces regardless of the amount of toner in the toner containing unit 66. Furthermore, because the space S for the airflow path as the ventilation portion is formed on the upper portion of the toner containing unit 66, it is possible to cause the pressurized air on the discharge port 67*b* side to flow toward the opposite side. Therefore, the toner does not spout from the discharge port 67*b*. Furthermore, the pressure in the rear side of the toner containing unit 66 does not decrease and the toner is not aggregated. Moreover, the delivery member 81 does not come into slide contact with the upper wall surface, so that toner is not sandwiched between the delivery member 81 and the upper wall surface and is not deteriorated due to the friction.

Figure 62:
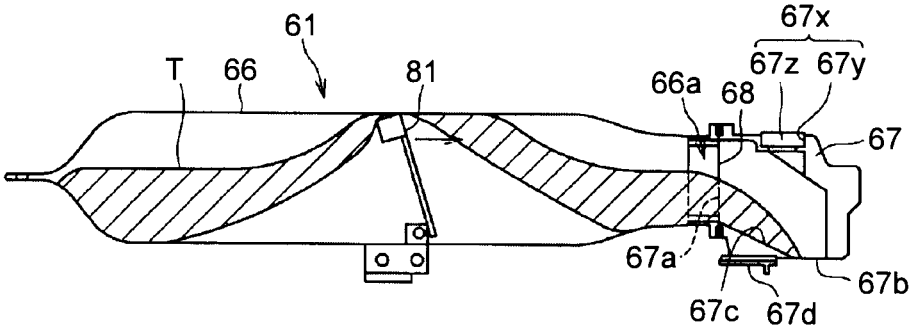
FIG. 62 is a cross-sectional view of the toner cartridge for explaining a problem with the toner cartridge.

On the other hand, as illustrated in FIG. 62, when the delivery member 81 reaches the upper wall surface of the toner containing unit 66, air in the front side of the toner containing unit 66 moves toward the discharge port 67*b* along with movement of the delivery member 81. If the pressure at the discharge port 67*b* increases due to the movement of the air, the amount of toner to be supplied increases. In the worst case, the toner spouts out. Furthermore, the pressure in the space on the rear side of the toner containing unit 66 decreases, so that the toner may be aggregated due to the contraction of the toner containing unit 66.

Figure 59:
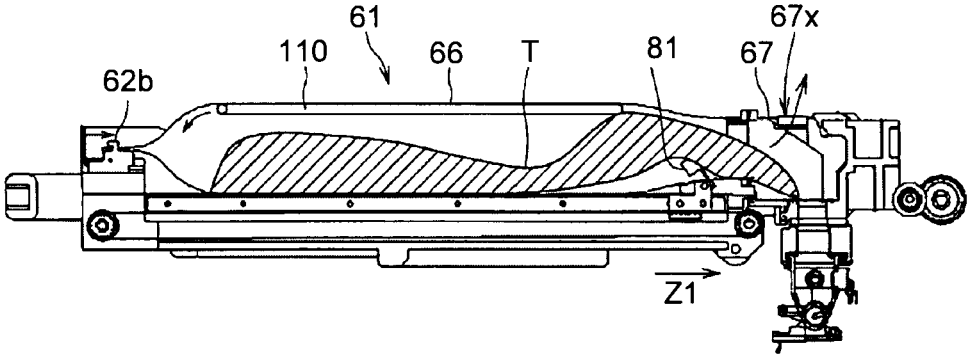
FIG. 59 is a diagram illustrating a state in which air is discharged through a respiration portion.

It is possible to arrange the respiration portion 67*x* (see FIG. 54A or 54D) on the toner cartridge 61 in addition to the ventilation portion as described above. Accordingly, as illustrated in FIG. 59, when the toner containing unit 66 is pushed and deformed inward by the delivery member 81 at the time of the toner delivery operation, air in the toner containing unit 66 moves from the front side to the rear side through the ventilation tube 110 as the ventilation portion, and excessive air that remains even after the movement of air is discharged to the outside through the respiration portion 67*x*. Therefore, it is possible to reliably prevent an increase in the inner pressure caused by deformation of the toner containing unit 66. As a result, it is possible to prevent problems related to an excess of the amount of toner to be supplied (the amount to be discharged) or an occurrence of toner dispersion in the developing device that is a conveyance destination.

Figure 60:
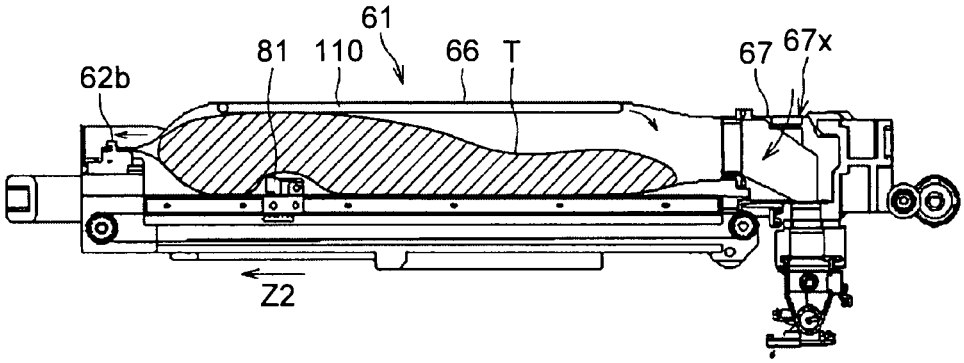
FIG. 60 is a diagram illustrating a state in which air is introduced through the respiration portion.

Furthermore, when the respiration portion 67*x* is provided, the toner cartridge 61 is pushed toward the discharging unit 67 side by the delivery member 81 at the time of the toner delivery operation as illustrated in FIG. 59, so that the hook portion 62*b* that hooks the end portion of the toner cartridge 61 is also pulled toward the discharging unit 67 side. Thereafter, even if the space on the rear side is separated by the stack of the toner when the delivery member 81 is returned as illustrated in FIG. 60, air in the rear space can flow back to the discharge port side through the ventilation tube 110. Therefore, it is possible to prevent the toner containing unit 66 from being irregularly deformed. Furthermore, when the delivery member 81 is returned, the toner cartridge 61 is pulled back in the direction opposite to the discharging unit 67 by the torsion coil spring 62*k* (see FIG. 6A) attached to the hook portion 62*b*. At this time, the toner containing unit 66 expands due to the pull-back operation, so that air is introduced from the respiration portion 67*x* and the toner inside the toner containing unit 66 is loosened by the introduced air. In this manner, because air is introduced through the respiration portion 67*x* after the toner delivery operation, it is possible to easily expand and restore the toner containing unit 66 to the initial shape and to loosen the toner by the introduced air. Therefore, the toner conveyance capability can be improved and stable toner conveyance can be realized.

The hook portion 62*b* is pulled toward the discharging unit 67 side by the delivery operation and thereafter pulled back by the biasing force of the torsion coil spring 62*k*. Therefore, a retraction movement of the toner containing unit 66 can be accelerated compared with a case that the hook portion 62*b* is fixed. Consequently, it is possible to increase the amount of air introduced into the toner containing unit 66, increasing the effect to loosen the toner. Furthermore, because the hook portion 62*b* is attached via the torsion coil spring 62*k*, it is possible to prevent a sudden increase in the load on the toner cartridge 61 by the delivery member 81 at the time of the delivery operation. Therefore, it is possible to suppress wear damage of the toner cartridge 61.

Moreover, the end portion of the toner cartridge 61 is fixed at the approximately same position by the hook portion 62*b*, so that it is possible to prevent the toner containing unit 66 from being irregularly deformed along with the toner delivery operation. Therefore, it is possible to prevent a failure in the toner conveyance or an excess load on the toner. Even when the hook portion 62*b* is attached without using the elastic member, such as the torsion coil spring 62*k*, the end portion of the toner cartridge 61 can be fixed at the approximately same position similarly to the above. Therefore, it is possible to prevent the toner containing unit 66 from being irregularly deformed, enabling to prevent a failure in the toner conveyance error or an excess load on the toner.

Furthermore, when the hook portion 62*b* is attached without using the elastic member, the end portion of the toner containing unit 66 is not returned back by the biasing force of the elastic member. However, the toner containing unit 66 can expand by the restoring force thereof or the weight of the toner, so that a certain amount of air can be introduced through the respiration portion 67*x*. Therefore, it is possible to easily expand and restore the toner containing unit 66 to the initial shape and to loosen the toner by the introduced air. As a result, it is possible to improve the capability and stability of the toner conveyance.

The third embodiment described above includes some aspects of the disclosure as set forth as follows.

According to a first aspect of the disclosure, a powder container includes a containing unit that houses powder and a discharging unit that discharges the powder from the containing unit to the outside. In the powder container, at least a portion of a wall surface of the containing unit is formed of a flexible wall surface that can be deformed so as to protrude to the inside of the containing unit. The powder can be moved toward the containing unit by moving the protrusion that is obtained by deforming the flexible wall surface so as to protrude inward, from the containing unit to the discharging unit. A ventilation portion for communicating a front space and a rear space that are separated by the protrusion inside the containing unit is provided in the containing unit.

In the powder container, when the powder inside the containing unit is pushed and moved toward the discharging unit by the protrusion protruding inward, air in the front space in front of the protrusion can flow back to the rear space behind the protrusion through the ventilation portion. Therefore, it is possible to suppress a temporary increase in the powder conveying speed due to an increase in the pressure at the discharging unit. As a result, it is possible to stabilize the powder conveying speed.

According to a second aspect of the disclosure, in the powder container as set forth in the first aspect of the disclosure, the containing unit has a shape of a horizontally long cylinder with a pair of side walls that are opposed to each other in a vertical direction. At least a portion of a lower side wall of the pair of the side walls is formed of the flexible wall surface, and the ventilation portion is formed adjacent to the inner surface of an upper side wall of the pair of the side walls.

In the powder container, the ventilation portion is formed adjacent to the inner surface of the upper side wall of the powder container. Therefore, when the powder inside the containing unit is pushed and moved toward the discharging unit by the protrusion protruding inward, an airflow return path that is not interfered with the powder can be ensured by the ventilation portion. Consequently, it becomes possible to suppress a temporary increase in the powder conveying speed due to an increase in the pressure at the discharging unit. As a result, it is possible to stabilize the powder conveying speed.

According to a third aspect of the disclosure, in the powder container as set forth in the second aspect of the disclosure, the ventilation portion is formed of one groove or two or more grooves on the inner surface of the upper side wall.

In the powder container, an airflow return path that is not interfered with the powder can be ensured by the grooves on the inner surface of the upper side wall. Therefore, it becomes possible to suppress a temporary increase in the powder conveying speed due to an increase in the pressure at the discharging unit. As a result, it is possible to stabilize the powder conveying speed.

According to a fourth aspect of the disclosure in the powder container as set forth in the second aspect of the disclosure, the grooves are formed as a gather by folding the upper wall surface in an accordion shape.

In the powder container, by folding the upper side wall in the accordion shape to make the gather, an airflow return path that is not interfered with the powder can be ensured and the hardness of the upper side wall can be increased. Therefore, it becomes possible to suppress a temporary increase in the powder conveying speed due to an increase in the pressure at the discharging unit. As a result, it is possible to stabilize the powder conveying speed.

According to a fifth aspect of the disclosure, in the powder container as set forth in the second aspect of the disclosure, the ventilation portion is formed of one ventilation tube or two or more ventilation tubes.

In the powder container, an airflow return path that is not interfered with the powder can be ensured by the ventilation tube. Therefore, it becomes possible to suppress a temporary increase in the powder conveying speed due to an increase in the pressure at the discharging unit. As a result, it is possible to stabilize the powder conveying speed.

According to a sixth aspect of the disclosure, in the powder container as set forth in the second aspect of the disclosure, the ventilation portion is formed of a porous member arranged on the inner surface of the upper side wall.

In the powder container, an airflow return path that is not interfered with the powder can be ensured by the porous member. Therefore, it becomes possible to suppress a temporary increase in the powder conveying speed due to an increase in the pressure at the discharging unit. As a result, it is possible to stabilize the powder conveying speed.

According to a seventh aspect of the disclosure, a powder conveying apparatus includes a containing unit that houses powder and at least a portion of which is formed of a flexible wall surface that is deformable so as to protrude to the inside of the containing unit; and a protrusion that is obtained by deforming the flexible wall surface to protrude to the inside of the containing unit by applying a pressure from the outside by a delivery member. In the powder conveying apparatus, the protrusion is moved from the containing unit to a discharging unit connected to the containing unit to convey the powder toward the discharging unit. The powder conveying apparatus further includes a ventilation portion between the powder elevated by the protrusion and an opposing wall surface.

In the powder conveying apparatus, the ventilation portion is formed between the powder elevated by the protrusion and the opposing wall surface. Therefore, when the powder in the containing unit is pushed and moved toward the discharging unit by the protrusion that is protruded inward by the delivery member, air in the font space in front of the protrusion can flow back to the rear space behind the protrusion through the ventilating unit. Consequently, it becomes possible to suppress a temporary increase in the powder conveying speed due to an increase in the pressure at the discharging unit. As a result, it is possible to stabilize the powder conveying speed.

According to a eighth aspect of the disclosure, in the powder conveying apparatus as set forth in the seventh aspect of the disclosure, the ventilation portion is formed on a wall surface facing the flexible wall surface such that the ventilation portion is not deformed by the pressure applied by the delivery member.

In the powder conveying apparatus, an airflow return path that is not interfered with the powder can be ensured by a groove or a ventilation tube that is not deformable. Therefore, it becomes possible to suppress a temporary increase in the powder conveying speed due to an increase in the pressure at the discharging unit. As a result, it is possible to stabilize the powder conveying speed.

According to a ninth aspect of the disclosure, in the powder conveying apparatus as set forth in the seventh aspect of the disclosure, the ventilation portion is formed of a space between the protrusion on the flexible wall surface and a wall surface opposite to the flexible wall surface.

In the powder conveying apparatus, an airflow return path that is not interfered with the powder can be ensured by the ventilation portion. Therefore, the powder is not rubbed between the wall surfaces, so that it is possible to prevent degradation in the quality of the powder.

According to a tenth aspect of the disclosure, an image forming apparatus includes the powder conveying apparatus as set forth in any one of the seventh to ninth aspects of the disclosure, as a toner conveying apparatus for conveying a developer.

In the image forming apparatus, a toner supply speed is stabilized, so that image quality can be improved.

The present invention has been made in view of the above problems, and there is a need to provide a powder conveying apparatus that can efficiently fluidize powder and conveying the powder smoothly and stably, and an image forming apparatus that includes the powder conveying apparatus.

According to one aspect of the present invention, driving of an oscillation applying unit can be controlled depending on the operation of a delivery member, so that powder can be efficiently fluidized. Therefore, it is possible to prevent packing or blocking of the powder, enabling to smoothly and stably convey the powder. Furthermore, it is possible to reduce the amount of powder that ultimately remains in a powder container. Therefore, it is possible to reduce running costs.

Furthermore, there is a need to provide a powder supply device that can successfully open and close a discharge port open-close member over time, and an image forming apparatus that includes the powder supply device.

According to another aspect of the present invention, it is possible to successfully open and close the discharge port open-close member over time.

Moreover, there is a need to provide a powder container and a powder conveying apparatus that, when a predetermined amount of powder is to be discharged from a discharging unit by moving a protrusion that is formed by deforming a flexible wall surface of the powder container so as to protrude inward, can prevent an excessive amount of toner from being discharged by the air that is pushed out of the powder container from the discharging unit together with the powder, and that can stabilize the amount of powder to be discharged.

There is also a need to provide an image forming apparatus that can obtain images in good conditions by stabilizing the amount of powder (developer) to be discharged.

According to still another aspect of the present invention, when powder in a container is pushed and moved to a discharging unit by a protrusion that protrudes to the inside of the container, air in a space in front of the protrusion flows back to a space behind the protrusion. Therefore, it is possible to suppress a temporary increase in a powder conveying speed due to an increase in the pressure at the discharging unit. As a result, it is possible to stabilize the powder conveying speed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A powder container comprising:

a containing unit that houses powder; and a discharging unit that discharges the powder from the containing unit to an outside, wherein at least a portion of a wall surface of the containing unit includes a flexible wall surface that can be deformed so as to protrude to the inside of the containing unit, a protrusion that is obtained by deforming the flexible wall surface so as to protrude inwardly is moved toward the discharging unit to thereby move the powder toward the containing unit, the containing unit includes a ventilation portion for communicating between spaces that are separated by the protrusion inside the containing unit, and the ventilation portion comprises grooves.

2. The powder container according to claim 1, wherein the containing unit includes a pair of side walls that face each other in a vertical direction, at least a portion of a lower side wall of the pair of the side walls includes the flexible wall surface, and the ventilation portion is located adjacent to the inner surface of an upper side wall of the pair of the side walls.

3. The powder container according to claim 1, further comprising a plurality of folds in the containing unit which define the grooves.

4. A powder container comprising:

a containing unit that houses powder; and a discharging unit that discharges the powder from the containing unit to an outside, wherein at least a portion of a wall surface of the containing unit includes a flexible wall surface that can be deformed so as to protrude to the inside of the containing unit, a protrusion that is obtained by deforming the flexible wall surface so as to protrude inwardly is moved toward the discharging unit to thereby move the powder toward the containing unit, and the containing unit includes a ventilation portion for communicating between spaces that are separated by the protrusion inside the containing unit, wherein:

the containing unit includes a pair of side walls that face each other in a vertical direction, at least a portion of a lower side wall of the pair of the side walls includes the flexible wall surface, the ventilation portion is located adjacent to the inner surface of an upper side wall of the pair of the side walls, and the ventilation portion comprises one ventilation tube or two or more ventilation tubes.

5. A powder container comprising:

a containing unit that houses powder; and a discharging unit that discharges the powder from the containing unit to an outside, wherein at least a portion of a wall surface of the containing unit includes a flexible wall surface that can be deformed so as to protrude to the inside of the containing unit, a protrusion that is obtained by deforming the flexible wall surface so as to protrude inwardly is moved toward the discharging unit to thereby move the powder toward the containing unit, and the containing unit includes a ventilation portion for communicating between spaces that are separated by the protrusion inside the containing unit, wherein:

the containing unit includes a pair of side walls that face each other in a vertical direction, at least a portion of a lower side wall of the pair of the side walls includes the flexible wall surface, the ventilation portion is located adjacent to the inner surface of an upper side wall of the pair of the side walls, and the ventilation portion comprises a porous member arranged on the inner surface of the upper side wall.

* * * * *